US006898912B2

(12) United States Patent
Bravinski

(10) Patent No.: US 6,898,912 B2
(45) Date of Patent: May 31, 2005

(54) SYSTEM AND METHOD FOR THE REINFORCEMENT OF CONCRETE

(76) Inventor: Leonid G. Bravinski, 5418 Yonge Street, Unit 2606, Toronto, Ont. (CA), M2N 6X4

( * ) Notice: Subject to any disclaimer, the term of this patent is extended or adjusted under 35 U.S.C. 154(b) by 0 days.

(21) Appl. No.: 10/122,457

(22) Filed: Apr. 15, 2002

(65) Prior Publication Data

US 2003/0192272 A1 Oct. 16, 2003

(51) Int. Cl.[7] ..... E04B 2/30
(52) U.S. Cl. ..... 52/426; 52/309.11; 52/565
(58) Field of Search ..... 52/426, 427, 428, 52/430, 442, 562, 565, 309.11, 677

(56) References Cited

U.S. PATENT DOCUMENTS

| | | | | | |
|---|---|---|---|---|---|
| 2,667,060 | A | * | 1/1954 | Campbell | 52/565 |
| 3,145,505 | A | * | 8/1964 | Cornelius | 52/712 |
| 4,864,792 | A | | 9/1989 | Andre et al. | |
| 4,901,494 | A | | 2/1990 | Miller et al. | |
| 4,972,646 | A | | 11/1990 | Miller et al. | |
| 4,999,965 | A | * | 3/1991 | Schmidgall et al. | 52/684 |
| 5,140,794 | A | | 8/1992 | Miller | |
| 5,287,672 | A | * | 2/1994 | Moore | 52/654.1 |
| 5,497,592 | A | | 3/1996 | Boeshart | |
| 5,566,525 | A | * | 10/1996 | Schwarz | 52/745.09 |
| 5,664,378 | A | | 9/1997 | Bettigole et al. | |
| 5,771,648 | A | | 6/1998 | Miller et al. | |
| 5,809,725 | A | | 9/1998 | Cretti | |
| 5,832,690 | A | * | 11/1998 | Kaines | 52/677 |
| 5,861,105 | A | * | 1/1999 | Martineau | 249/44 |
| 5,887,401 | A | | 3/1999 | Moore, Jr. | |
| 6,070,380 | A | | 6/2000 | Meilleur | |
| 6,176,059 | B1 | | 1/2001 | Cantarano et al. | |
| 6,216,412 | B1 | | 4/2001 | Offersen | |
| 6,321,498 | B1 | * | 11/2001 | Trovato | 52/426 |
| 6,536,180 | B1 | * | 3/2003 | Rosenblat et al. | 52/712 |
| 2002/0062614 | A1 | * | 5/2002 | Fleming | 52/562 |

* cited by examiner

*Primary Examiner*—Robert Canfield
(74) *Attorney, Agent, or Firm*—Senniger Powers

(57) ABSTRACT

A system for reinforcing a concrete structural member comprises a panel oriented longitudinally and at least one frame assembly module. The module is formed with several rod members and with a reinforcement member defines a retention cell having a generally vertically oriented opening for receiving a vertical reinforcement member. An additional rod member can be employed in abutment with an interior surface of the panel. The panel body can hold a connector, such as a mushroom shaped connector, which can be used for mounting the module and also be used in conjunction with a bracer to join two panels and their associated modules together. Adjacent abutting panels can have overlapping reinforcement members, which can be inclined or have angled end portions. Each panel can have associated with it a plurality of retention cells arranged, transversely, longitudinally and vertically. The reinforcement system can be used as part of formwork used in constructing a structural member, or used with conventional formwork. The system can be substantially preconstructed away from the construction site and then delivered to the construction site.

67 Claims, 34 Drawing Sheets

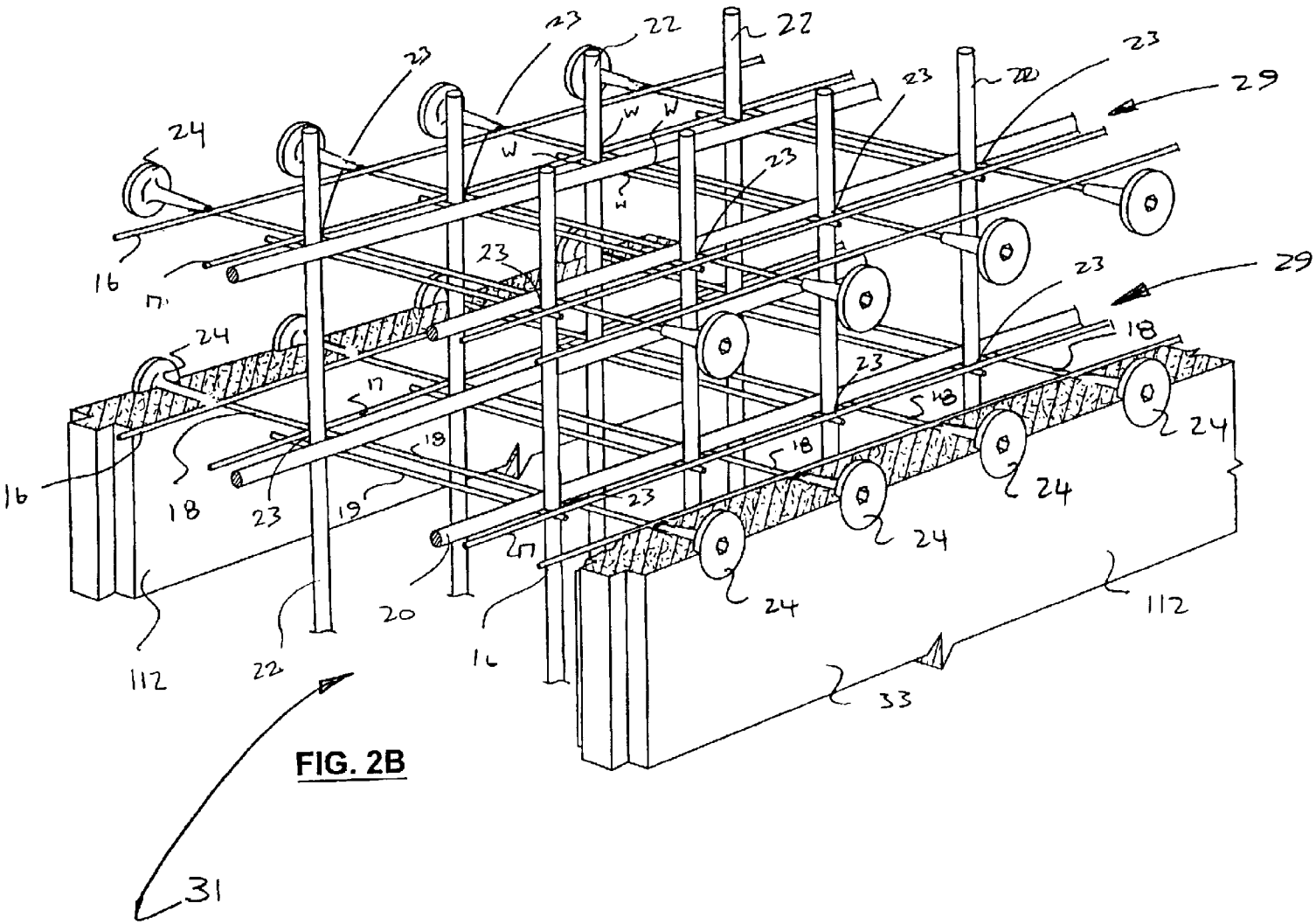
29
29
23
23
23

SYSTEM AND METHOD FOR THE REINFORCEMENT OF CONCRETE

FIELD OF THE INVENTION

The present invention relates to the reinforcement of concrete, including concrete structures such as concrete walls, and includes a system and method for the reinforcement of such concrete structures.

BACKGROUND

Concrete walls and other concrete structures, have traditionally been made by building a form. The forms were usually made from plywood and other wood members. Unhardened concrete is poured into the form space provided in the form. Once the concrete hardens, the form walls are removed leaving a concrete wall or other concrete structure/structural member.

Given the limitations in structural strength of concrete when subjected to certain types of loading such as tensile loading, it is known to provide reinforcement for the concrete. The reinforcement is typically accomplished by placing metal reinforcement bars (usually made from steel) within the space defined by the form. The precise positioning of the reinforcement bars is important and is selected to maximize the structural benefit and at the same time ensure other design criteria are met (e.g. ensuring a sufficient amount of concrete coverage for fire protection). After the reinforcement members are properly positioned, concrete is poured into the form space covering the steel reinforcement. The concrete is then allowed to harden, bonding the concrete to the steel reinforcement. The bonding between reinforcement and concrete is typically enhanced by providing reinforcement members that have ribbed outer surfaces. The overall composite structural member has enhanced load-bearing capacity and provides the possibility of being able to optimize the concrete structure thickness, and consequently economize on the materials and expenses for building erection.

The task of properly placing and positioning the reinforcement members within the form space however can be problematic. The reinforcement members are typically long steel rods. These rods must be supported if they are to be properly and securely positioned in the form space. Accordingly, systems have been developed to ensure that the reinforcement members are properly positioned within the form space and remain in their desired orientation and position throughout the concrete forming process.

One technique has been to form a cage of reinforcement members wherein larger reinforcement rods are bound together with binding wire. Building such a cage inside of a constructed form space is quite difficult and time consuming. One alternative is that the reinforcement cage can be constructed outside the form space and then lowered into the form space. However, for large structural members, this is often difficult given the large weight of the cage structure. Another possibility is that the cage can be first built and then the form constructed around the reinforcement cage.

These known methods require special devices for installation of the ribbed rods into the form space of the erected concrete structure, as well as a large amount of time to control the correctness of the reinforcement cage position.

Additionally, these known techniques are generally quite time consuming and costly due to the fact that additional steel material is consumed for the purpose of improving the bearing capacity of the concrete structure protection, to compensate for a failure to ensure high accuracy in the positioning of the ribbed rods. Therefore improvements in the method of placement of the reinforcement within a form space are desirable.

U.S. Pat. No. 6,216,412 to Offersen is directed to the reinforcement of a concrete structure that employs an assembly frame having pairs of transverse and longitudinal girders. Cut outs are provided in the outer sides of the assembly frame. The cut outs receive one or more reinforcements rods which are held in position in the cut outs by spring shackles. Additional reinforcement rods are provided oriented transverse to the first rods in the cut outs, and are held in place relative to the first rods in the cut outs by spring shackles. Although providing some improvements in the reinforcement of concrete, Offersen still requires the use of a fairly complex structure and method to create the necessary reinforcement.

Aside from providing improvements in the positioning of reinforcement in the forms, there is generally a need to improve overall concrete forming systems. Known improvements include improvements in the materials used in building the form walls that define the form space, and in the methods of constructing forms. For example, techniques have been developed whereby concrete walls are formed using modular panel components that can be interconnected to build the form. In some known form systems, the modular panels are made from a foam or plastic insulating material. The foam panels can remain in place after the concrete hardens as a permanent part of the building, providing such benefits as sound and heat insulation.

In such systems the panels can be interconnected as desired to provide an appropriate shaped and sized concrete wall.

In order to assist in keeping the modular panel walls properly spaced when concrete is poured between the form walls, transverse tie members are used in order to prevent transverse displacement of the walls due to the hydrostatic pressure created by the unhardened concrete. However, the incorporation of tie members into the overall form structure provides further complication and additional materials.

U.S. Pat. No. 5,887,401 issued to Moore Jr. on Mar. 30, 1999 discloses a concrete form system comprising two longitudinally-extending side panels with connectors contained in the body of the panels. The panels are spaced by means of horizontal wire meshes. The meshes are connected with said connectors. Each connector has a support portion, which receives the hydrostatic pressure of unhardened concrete, and a portion, which connects to the mesh. Despite the fact that this system reduces material consumption in concrete structure forming and in longitudinal reinforcing, it requires additional components, material and time for vertical reinforcement. Additionally, the locking connection of the panels with the horizontal meshes presumes building of the form only at the construction site due to the fact that they do not properly stabilize the panels used for forming during transportation from the plant to the construction site. The connection is only blocks the panels from transverse movement, but does not have the capability of being tightened these panels. Besides, installation of vertical reinforcement at the construction site is quite labor intensive.

U.S. Pat. No. 5,809,725 issued to Pierro Cretti on Sep. 22, 1998 discloses A concrete form system made from polystyrene boards, connected at a distance from each other by a prefabricated nog structure comprising plastic inserts with screw-type side surfaces and inside blind openings connected to the threaded end of a tie rod made of steel. In the plant environment or on the construction site, vertical and horizontal rods for reinforcement of concrete structure are fixed to tie-rods. Also, the invention presumes the combined installation of the reinforcement rods, namely, a part of vertical rods are fixed to the tie rods at the plant, and horizontal rods are installed on the construction site right before concrete pouring by means of installation via eyes made in the tie rods. This system solves the problem of the "air bridge" and presumes delivery of the panels together with vertical reinforcement to the construction site.

However, manufacturing of the formwork by means of connection of three elements with different strength by screwing of screw-shaped hollow insert from thermoplastic into the polystyrene board, and simultaneous screwing of the insert cavity onto the thread of the steel rod is very problematic. The result is typically damage to the less strong element, the polystyrene board's body. Consequently, such connection will have low bearing capacity for receiving hydrostatic pressure of the newly poured concrete and require increasing the width of polystyrene board or geometrical sizes of the insert, which increases the cost.

Also, it is necessary to note, that the installation separate vertical rods and fixing them to steel tie rods even at the plant is very labor consuming. Special equipment and a lot of time are required to control the proper installation of the reinforcement in the space of the formwork. Additionally, the manufacturing and proper installation of the tie rods with eyes for positioning of the horizontal reinforcement on the construction site is relatively complicated and relatively expensive.

U.S. Pat. No. 6,176,059 to Cantarano et al. discloses a modular construction system which uses modular wall panels, connectors and structural tie plates. In this system, the tie plates are elaborately formed with a series of integrally formed openings and clamps, which serve to lock in place both horizontal and vertical reinforcement bars. This system is, however, relatively complicated and would be relatively expensive to implement. Furthermore, providing these tie plates would likely create structural deficiencies and would in most cases not satisfy most building codes.

Accordingly, improved systems and methods for providing reinforcement of concrete structures are desired, as are improvements in the overall form systems used to make concrete structures that incorporate reinforcement.

SUMMARY OF THE INVENTION

In accordance with one aspect of the invention there is provided a system for reinforcing a concrete structural member comprising:

a) A panel oriented longitudinally;

b) At least one frame assembly module comprising:

first and second spaced, rod members oriented generally transversely, at least one of said first and second rod members extending to said panel and being mounted thereto;

a third rod member oriented generally longitudinally;

said first, second and third rod members being joined together to form said frame assembly module;

c) A longitudinal reinforcement member extending generally longitudinally, crossing said first and second rod members, being spaced from said third rod member, and joined to at least one of said first and second rod members said frame assembly module and said longitudinal reinforcement member cooperating to define a retention cell having a generally vertically oriented opening for receiving a vertical reinforcement member.

According to another aspect of the invention there is provided a method of reinforcing a concrete structural member comprising:

a) providing a longitudinally oriented panel having an inner surface;

b) providing at least one frame assembly module mounted to said panel, said at least one frame assembly module comprising:

first and second rod members oriented generally transversely, at least one of said first and second rod members extending to said panel and being mounted to said panel, said one member being adapted to assist in maintaining the orientation of said panel, said first and second rod members being spaced apart for each other, a third rod member spaced from said panel an oriented generally longitudinally and crossing both said first and second rod members, said first, second and third rod members being joined together to form said frame assembly module;

c) providing a reinforcement member extending generally longitudinally and spacing it apart from said third rod member, said third rod member being positioned between said panel and said rod member, said frame assembly and said longitudinal reinforcement member defining a retention cell having a generally vertically oriented opening for receiving a vertical reinforcement member;

d) placing a vertical reinforcement member through said vertical opening of said retention cell.

In another aspect of the invention there is provided a method of building a concrete structural member with reinforcement positioned in a form space, comprising:

a) providing a panel unit to a construction site, said panel unit comprising i) a panel having an inner surface;

ii) at least one frame assembly module in connection with said form space, said at least one frame assembly comprising:

first and second rod members oriented generally transversely, at least one of said first and second rod members extending to said panel and being mounted to said panel, said one member being adapted to assist in maintaining the orientation of said panel, said first and second rod members being spaced apart for each other, a third and a fourth spaced, rod members oriented generally longitudinally and crossing both said first and second rod members, said third rod member spaced from said panel, said fourth rod member positioned in abutment with an interior surface of said panel;

said first, second, third and fourth rod members being joined together to form said frame assembly module;

ii) a reinforcement member extending generally longitudinally and spacing it apart from said third rod member and rigidly engaged with at least one said first and second rod members, said third rod member being positioned between said panel and said rod member, said frame assembly and said longitudinal reinforcement member defining a retention cell having a generally vertically oriented opening for receiving a vertical reinforcement member;

iii) said panel in its body includes said connector for connecting said frame assembly module to said panel in such way that said frame assembly and said longitudinal reinforcement member are supported on said panel.

b) completing a form for said concrete structure to create a form space c) placing said frame assembly module with said longitudinally oriented reinforcement member in said form space;

d) placing a vertical reinforcement member in said retention cell; and e) placing pour concrete in said form space.

According to another aspect of the invention there is provided a system for forming reinforced concrete including:

a) First and second, longitudinally oriented panels, each said first and second panel having an inner surface and an outer surface and being oriented with said inner surfaces facing towards each other;

b) A transversely oriented in respect of said inner surfaces of said first and second panels, reinforcing mesh formed from a plurality of longitudinally oriented rods, at least some of said plurality of rods being ribbed rods, and transverse rods, at least some of those transverse rods having a length of more than the distance between inner side of said panels, but said length being less than the distance between outer sides of said panels, ends of said rods entering each of said panels and acting as tie rods for said panels;

c) Connectors placed in said body of said panels secured to said end of said tie rod, said connectors each having a shaft portion with a central, longitudinal axis and a cap portion; and d) a plurality of vertical reinforcement member supported in said reinforcing mesh.

According to still yet another aspect of the invention there is provided a reinforcement system for a concrete structural member comprising:

a) A first panel oriented longitudinally b) A second panel spaced from said first panel and oriented generally longitudinally, said first and second panels partly defining a form space between an inner surface of said first panel and an inner surface of said second panel;

c) At least one frame assembly module comprising first and second rod members spaced apart and oriented generally transversely between said first and second panels, at least one of said first and second rod members being mounted to said first panel and said second panel with first and second connectors respectively, and extending between said first and second panels, said one member adapted to assist in maintaining the positioning of said first panel relative to said second panel;

a third and a fourth spaced, rod members oriented generally longitudinally and crossing both said first and second rod members, said third rod member spaced from said panel, said fourth rod member is positioned in abutment with an interior surface of said panel;

said first, second, third and fourth rod members being joined together to form said frame assembly module;

d) A reinforcement member extending generally longitudinally, crossing said first and second rod members and being spaced from said third rod member;

said frame assembly module and said longitudinal reinforcement member defining a retention cell having a generally vertically oriented opening for receiving a vertical reinforcement member.

According to another aspect of the invention there is provided a method of reinforcing a concrete structural member comprising:

a) providing first and second panels each having an inner surface at least in part defining a form space therebetween b) providing at least one frame assembly module in connection within said form space, said at least one frame assembly comprising:

first and second spaced rod members oriented generally transversely, at least one of said first and second rod members mounted to said first and second panels and extending therebetween, said one member being adapted to assist in maintaining the orientation of said panel;

a third and a fourth spaced, rod members oriented generally longitudinally and crossing both said first and second rod members, said third rod member spaced from said panel, said fourth rod member is positioned in abutment with an interior surface of said panel;

said first, second, third and fourth rod members being joined together to form said frame assembly module;

c) providing a longitudinal reinforcement member extending generally longitudinally and spacing it apart from said third rod member, said longitudinal reinforcement member being positioned between said panel and said third rod member, said longitudinal reinforcement member being joined to said frame assembly module, said frame assembly module and said longitudinal reinforcement member defining a retention cell having a generally vertically oriented opening for receiving a vertical reinforcement member;

d) placing a vertical reinforcement member through said vertical opening of said retention cell.

According to still yet another aspect of the invention there is provided a system for reinforcing a concrete structural member comprising:

i) First and second panel units, each panel unit comprising a) A panel member oriented longitudinally;

b) At least one frame assembly module comprising first and second spaced, rod members oriented generally transversely, at least one of said first and second rod members extending to said panel and being mounted thereto;

a third and a fourth spaced, rod members oriented generally longitudinally and crossing both said first and second rod members, said third rod member spaced from said panel, said fourth rod member is positioned in abutment with an interior surface of said panel;

said first, second, third and fourth rod members being joined together to form said frame assembly module;

c) A reinforcement member extending generally longitudinally and being spaced from said third rod member, said third rod member being positioned between said panel and said rod member;

said frame assembly and said longitudinal reinforcement member defining a retention cell having a generally vertically oriented opening for receiving a vertical reinforcement member;

d) A connector secured to the end of said one rod member;

said first and second panel units arranged in longitudinal abutting, alignment;

ii) a bracer interconnecting said connectors of said first and second panel units, whereby said first panel unit is joined to said second panel unit.

According to another aspect of the invention there is provided a system for reinforcing a concrete structural member comprising first and second panel units, each panel unit comprising i) A panel member oriented longitudinally;

ii) At least one frame assembly module comprising first and second spaced, rod members oriented generally transversely, at least one of said first and second rod members extending to said panel and being mounted thereto;

a third and a fourth spaced, rod members oriented generally longitudinally and crossing both said first and second rod members, said third rod member spaced from said panel, said fourth rod member is positioned in abutment with an interior surface of said panel;

said first, second, third and fourth rod members being joined together to form said frame assembly module;

iii) A reinforcement member extending generally longitudinally and being spaced from said third rod member and crossing said first and second rod members;

said frame assembly and said longitudinal reinforcement member defining a retention cell having a generally vertically oriented opening for receiving a vertical reinforcement member;

iv) a connector secured to the end of said one rod member;

said first and second panel units arranged in such that said panels of said first and second panel units are in longitudinal abutting, alignment;

said panel of said first panel unit having a leading side face and said panel of said second panel unit having a trailing side face, said leading side face having a centrally positioned tongue portion and said trailing side face having a centrally positioned groove portion to provide a tongue in groove connection between said panels.

According to still yet another aspect of the invention there is provided A system for creating a concrete form comprising said first and second panels arranged such that said first and second panels are in longitudinal abutting and alignment, said first panel unit having a leading side face and said second panel having a trailing side face, said leading side face having a centrally positioned tongue portion and said trailing side face having a centrally positioned groove portion to generally provide a tongue in groove connection, wherein said leading face has side flange portions on either side of said tongue portion and said trailing face has side flanges on either side of said groove portion, and wherein when said panels are interconnected in abutting alignment, only the outer part of said side flanges are in contact with each other, and an air gap is otherwise provided between said side flanges and said tongue and groove portions.

According to another aspect of the invention there is provided a system for reinforcing a concrete structural member comprising:

a) A panel member oriented longitudinally and having an interior surface;

b) First and second spaced, rod members oriented generally transversely, said first rod member extending to said panel and being mounted thereto;

c) A reinforcement member extending generally longitudinally, crossing said first and second rod members said first and second rod members being joined together with said longitudinal reinforcement member;

said second rod member having a loop portion, which overlaps said first rod member in two places is fixedly connected with first rod member where it crosses with said first rod, said loop portion configured to co-operate with said first rod member and said longitudinal reinforcement member and defining a retention cell having a generally vertically oriented opening for receiving a vertical reinforcement member.

According to still yet another aspect of the invention there is provided a system for reinforcing a concrete structural member comprising:

a) A panel member oriented longitudinally and having an interior surface;

b) First and second spaced, rod members oriented generally transversely, said first rod member extending to said panel and being mounted thereto;

c) A reinforcement member extending generally longitudinally, crossing said first and second rod members said first and second rod members being joined together with said longitudinal reinforcement member;

said second rod member being fixedly connected to said reinforcement member and having a longitudinally oriented extension portion, configured to co-operate with said first rod member and said longitudinal reinforcement member to define a retention cell having a generally vertically oriented opening for receiving a vertical reinforcement member.

According to another aspect of the invention there is provided a system for reinforcing a concrete structural member comprising:

i) First and second panel units, each panel unit comprising a) A panel member oriented longitudinally;

b) At least one frame assembly module comprising first and second spaced, rod members oriented generally transversely, at least one of said first and second rod members extending to said panel and being mounted thereto;

a third and a fourth spaced, rod members oriented generally longitudinally and crossing both said first and second rod members, said third rod member spaced from said panel, said fourth rod member is positioned in abutment with an interior surface of said panel;

said first, second, third and fourth rod members being joined together to form said frame assembly module;

c) A reinforcement member extending generally longitudinally and being spaced from said third rod member, said third rod member being positioned between said panel and said rod member;

said frame assembly and said longitudinal reinforcement member defining a retention cell having a generally vertically oriented opening for receiving a vertical reinforcement member;

said first and second panel units being connected in longitudinal abutting, alignment, said longitudinal reinforcement member of said first panel not extending to said longitudinal reinforcement member of said second panel;

ii) a reinforcement connector having a pair of vertical reinforcement member each received in a slot between said third rod member and said longitudinal reinforcement member of each said frame assembly module of said first and second panel units, and said reinforcement connector also having a longitudinal reinforcement member positioned in overlapping relationship with said longitudinal reinforcement member of said first panel unit and said longitudinal reinforcement member of said second panel unit.

In another aspect of the invention there is provided a system for reinforcing a concrete structural member comprising:

i) First and second panel units, each panel unit comprising
  a) A panel member oriented longitudinally;
  b) At least one frame assembly module comprising
    a rod member oriented generally transversely and extending to said panel and being mounted thereto;
  c) a connector secured to the end of said rod member;

said first and second panel units arranged in longitudinal abutting, alignment;

ii) a bracer interconnecting said connectors of said first and second panel units, whereby said first panel unit is joined to said second panel unit, said bracer comprising a generally c-shaped structure having a pair of spaced apart legs extending from a body proximate each end of said body, externally positioned legs, each of said legs positioned on an opposite side of a shaft portion of one of said connectors associated with one of said panels of said first and second panel units, whereby rotation of said connector on each panel will cause said bracer to create a force on each connector tending to push said first and second panels together.

In another aspect of the invention there is provided a panel unit for use in connection with forming a concrete structural member, said panel unit comprising i) A panel oriented longitudinally and having upper and lower substantially parallel faces;

ii) At least one frame assembly module comprising a plurality of transversely oriented, longitudinally spaced rod members extending to said panel and being mounted thereto;

said plurality of rod members supporting at least one longitudinal reinforcement member each of said plurality of rod members having a connector secured to the end of each said rod member to mount each of said rod members to said panel; said connectors being arranged such that said longitudinal reinforcement member supported by said rod members, is oriented at an angle to said lower face of said panel.

According to another aspect of the invention there is provided a system of formwork using a reinforcement system, said reinforcement system comprising:

a) A panel oriented longitudinally;

b) At least one frame assembly module comprising:
  first and second spaced, rod members oriented generally transversely, at least one of said first and second rod members extending to said panel and being mounted thereto;
  a third rod member oriented generally longitudinally;
  said first, second and third rod members being joined together to form said frame assembly module;

c) A longitudinal reinforcement member extending generally longitudinally, crossing said first and second rod members, being spaced from said third rod member, and joined to at least one of said first and second rod members said frame assembly module and said longitudinal reinforcement member cooperating to define a retention cell having a generally vertically oriented opening that holds a vertical reinforcement member.

BRIEF DESCRIPTION OF THE DRAWINGS

In drawings which illustrate by way of example only, preferred embodiments of the present invention:

FIG. 2B is a front, side perspective view of another implementation of the reinforcement system of FIG. 1;

DETAILED DESCRIPTION

Figure 1A:
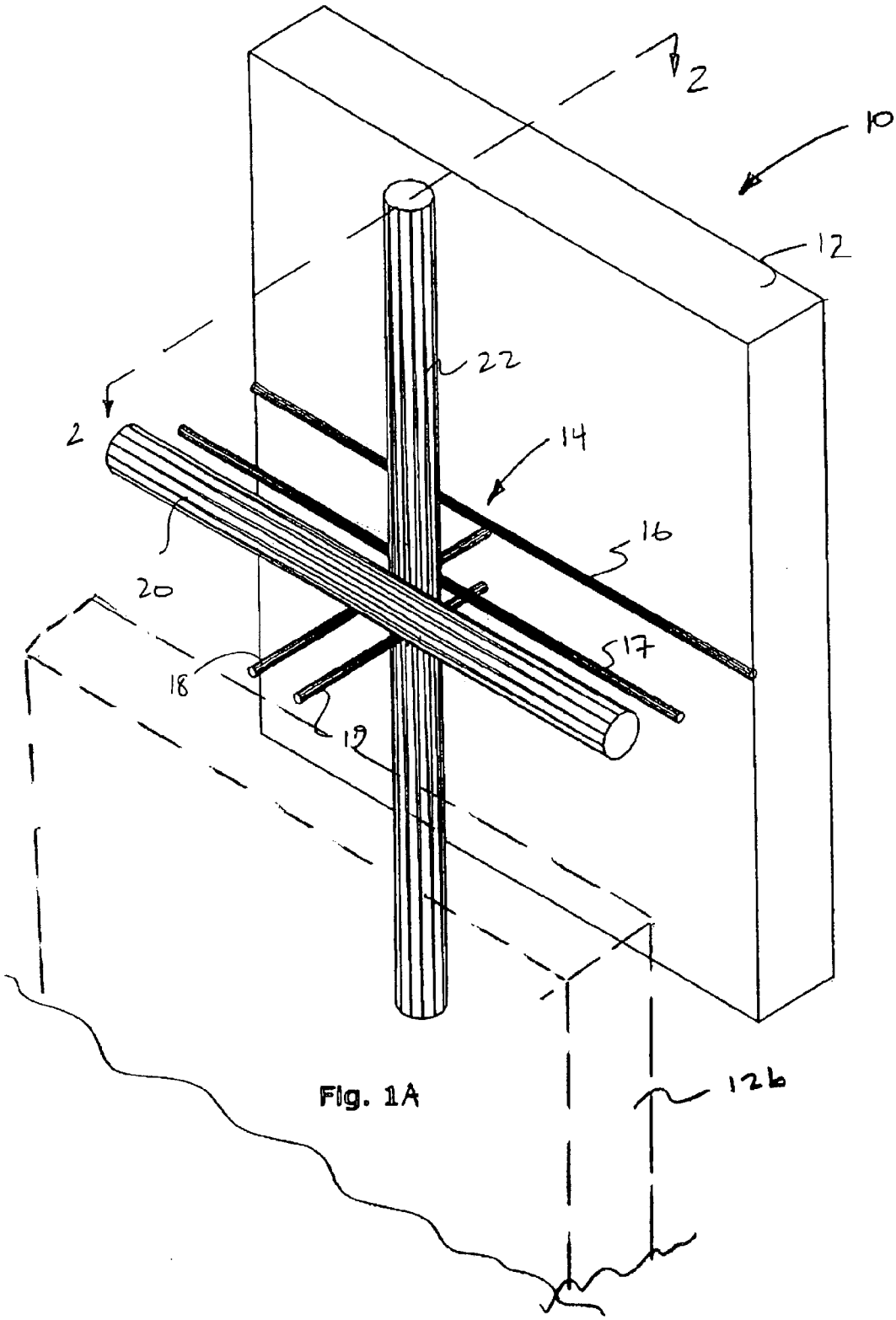
FIG. 1 is a perspective view illustrating a portion of a reinforcement system made in accordance with an embodiment of the invention.
Figure 2:
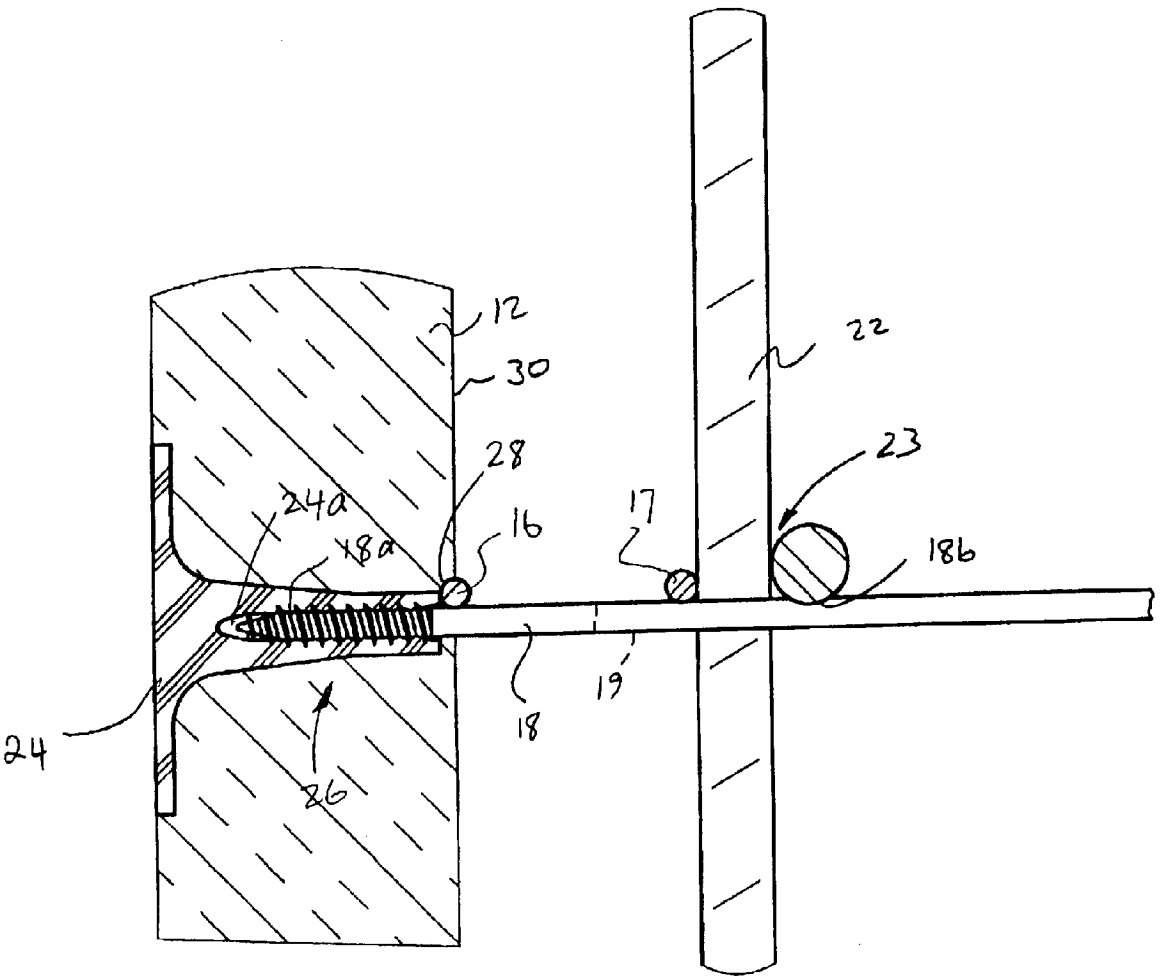
FIG. 2 is a side elevation cross sectional view at the plane defined by 2—2 in FIG. 1.
Figure 2A:
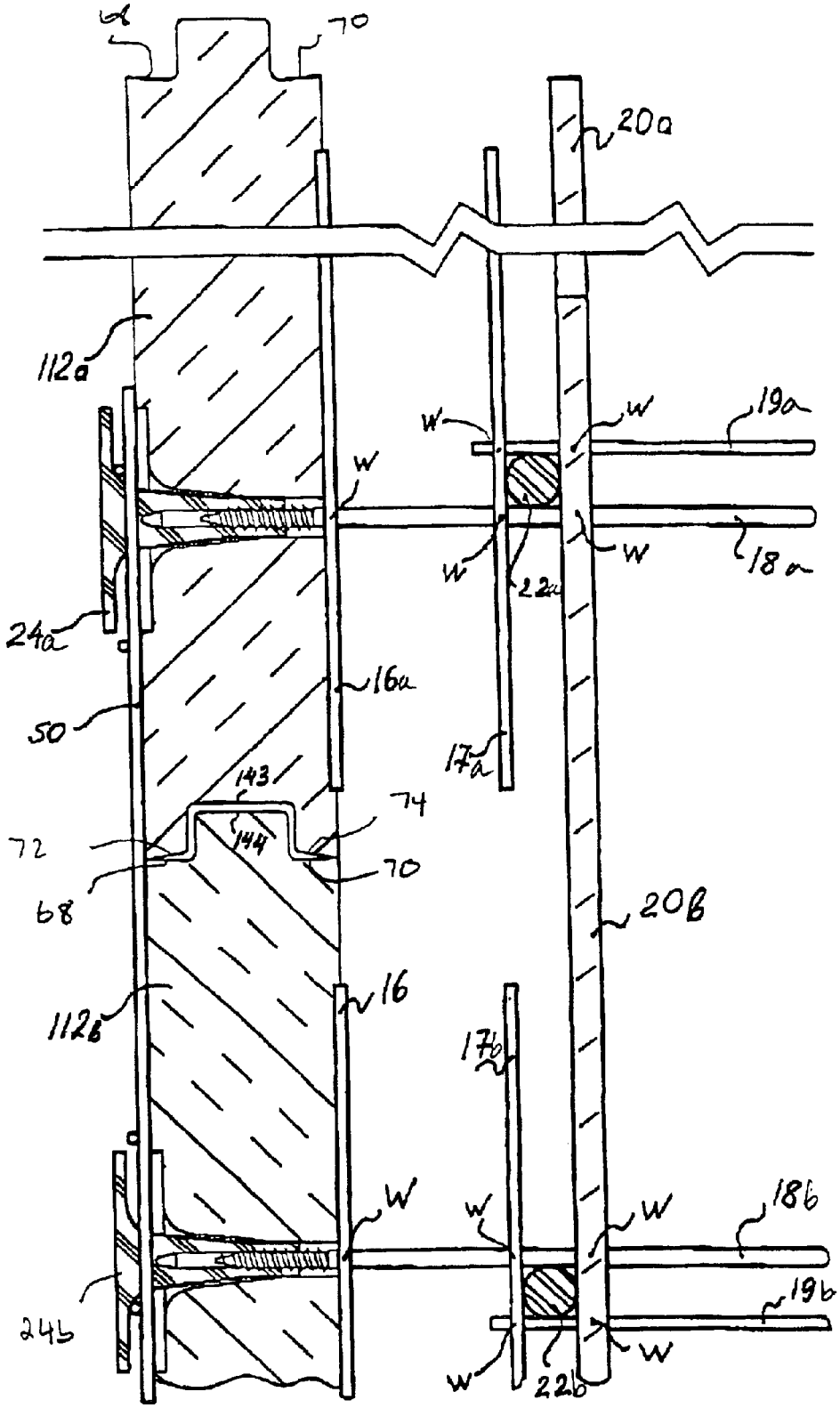
FIG. 2A is a top plan view illustrating an implementation of the reinforcement system in accordance with an embodiment of the invention, showing two panels connected together.
Figure 3:
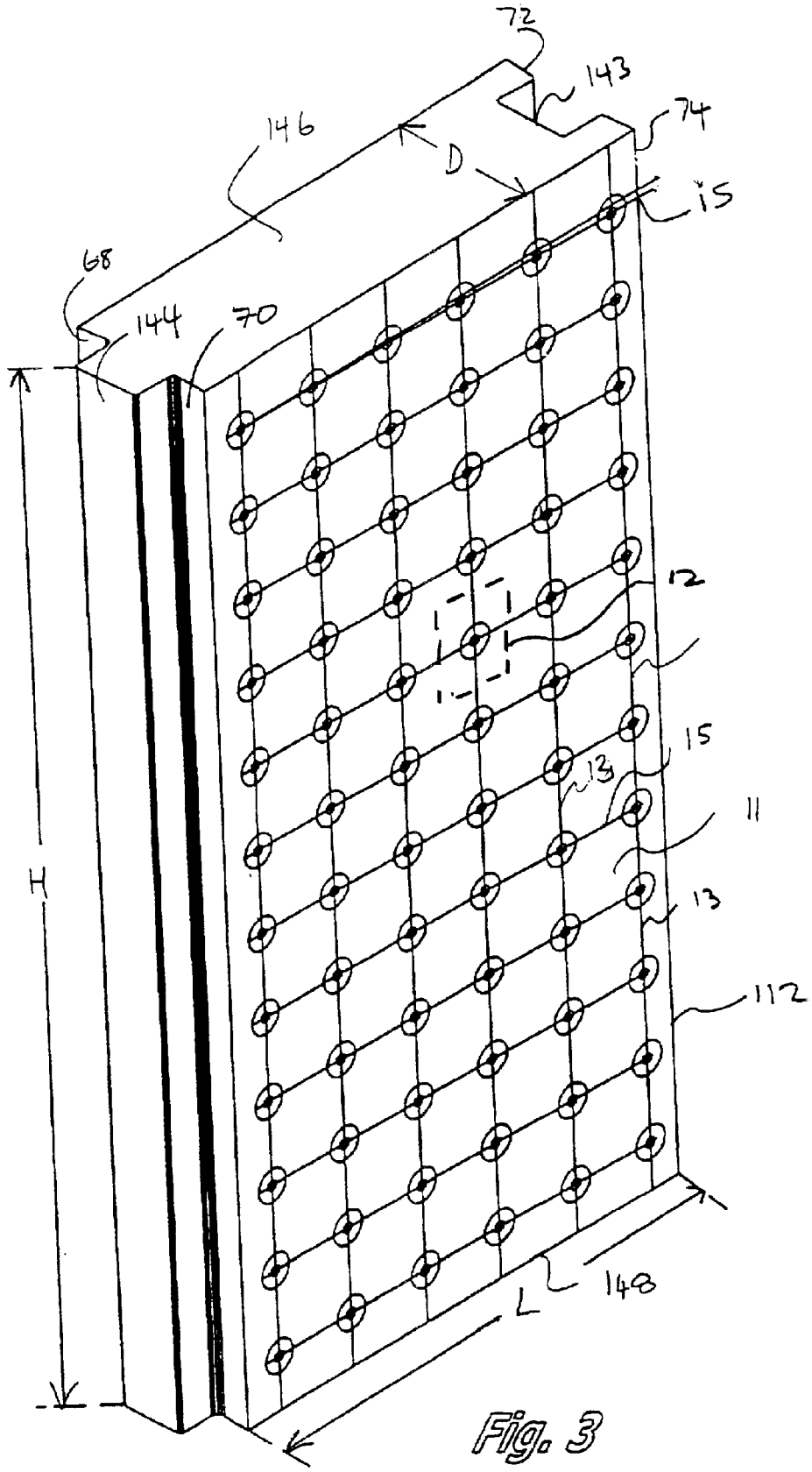
FIG. 3 is a top, side perspective view of a panel with connectors contained in the body of said panel illustrating a reinforcement mesh comprising parallelograms, the vertical face of which is parallel to the side faces of the said panel, with and another face is inclined towards horizon, employed in the reinforcement systems of FIGS. 2A–2D.

With reference to FIGS. 1 and 2, the basic components of a reinforcement system generally designated 10 are disclosed and include a portion 12 of a panel 112 (see FIGS. 2A and 3). Portion 12 is integral with the rest of panel 112. Panel 112 can be made from any conventional suitable materials employed in concrete forms such as expanded polystyrene foam and extruded polystyrene foam. The system also includes an assembly frame module generally designated 14 and horizontal reinforcement bars 20. Horizontal reinforcement bar 20 is preferably standard steel rebar having a cross sectional diameter of between 5 and 12 mm, and preferably carries ribs on its outer surface to promote bonding with the concrete.

Assembly frame module 14 includes longitudinally oriented wire rods 16 and 17, and transversely oriented wire rods 18 and 19. Wire rods 16, 17, 18 and 19 are preferably made from steel, but could be made from other suitable materials such as some other metals and selected fiber composite materials. Rods 16, 17 and 19 preferably have a diameter in the range of between 2.5 and 3.5 mm. Rod 18 has a shaft portion, which preferably has a diameter of between 4 and 6 mm. The end portion 18*a* of rod 18 is preferably made as a machine tap with the step of the spiral as 1.5–4.0 mm and outer diameter from 4.5 to 7.0 mm and with a length of approximately 30–40 mm. The end tap 18*a* is preferably made by the known method of rolling in contrast to the forming method of cutting.

Also, while connecting reinforcement bar 20 to rod 18 by means of spot welding, an outer cut 18*b* is formed in the rod 18, which generally has a circular profile and the depth of which is 6–8% of the diameter of the bar 20 and rod 18. This provides a proper connection but does not significantly lessen the strength of the connected rod. Rod 19 would be connected to bar 20 in the same manner as rod 18, and during the process of spot welding cut-outs will be formed.

It should be noted from FIGS. 1 and 2 that in the preferred embodiment, wire rod 19 extends past longitudinal rod 17 but does not extend all the way to contact the inner surface 30 of panel portion 12.

Figure 2C:
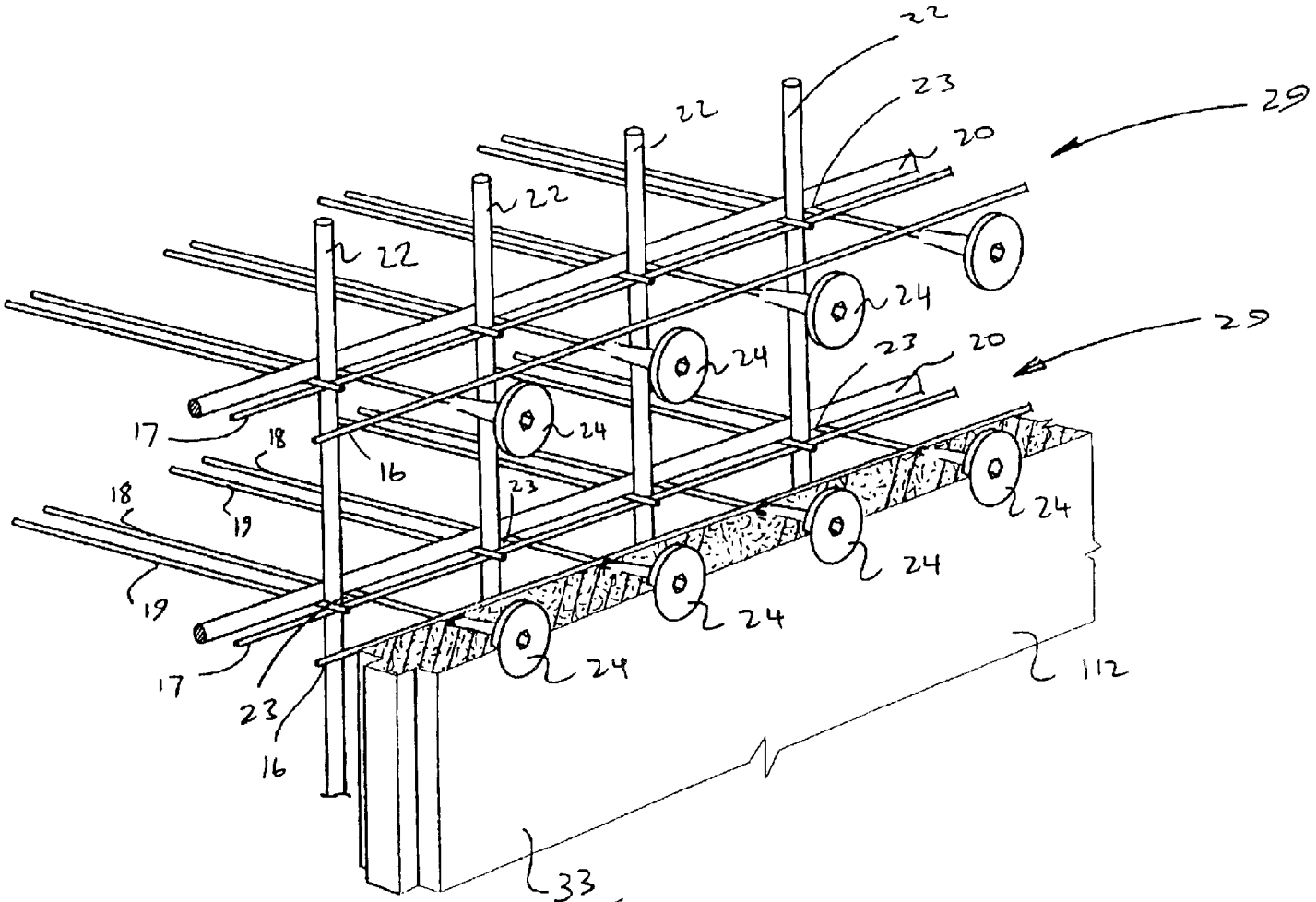
FIG. 2C is a front, side perspective view of a reinforcement system, similar to the reinforcement system illustrated in FIG. 2B.
Figure 2D:
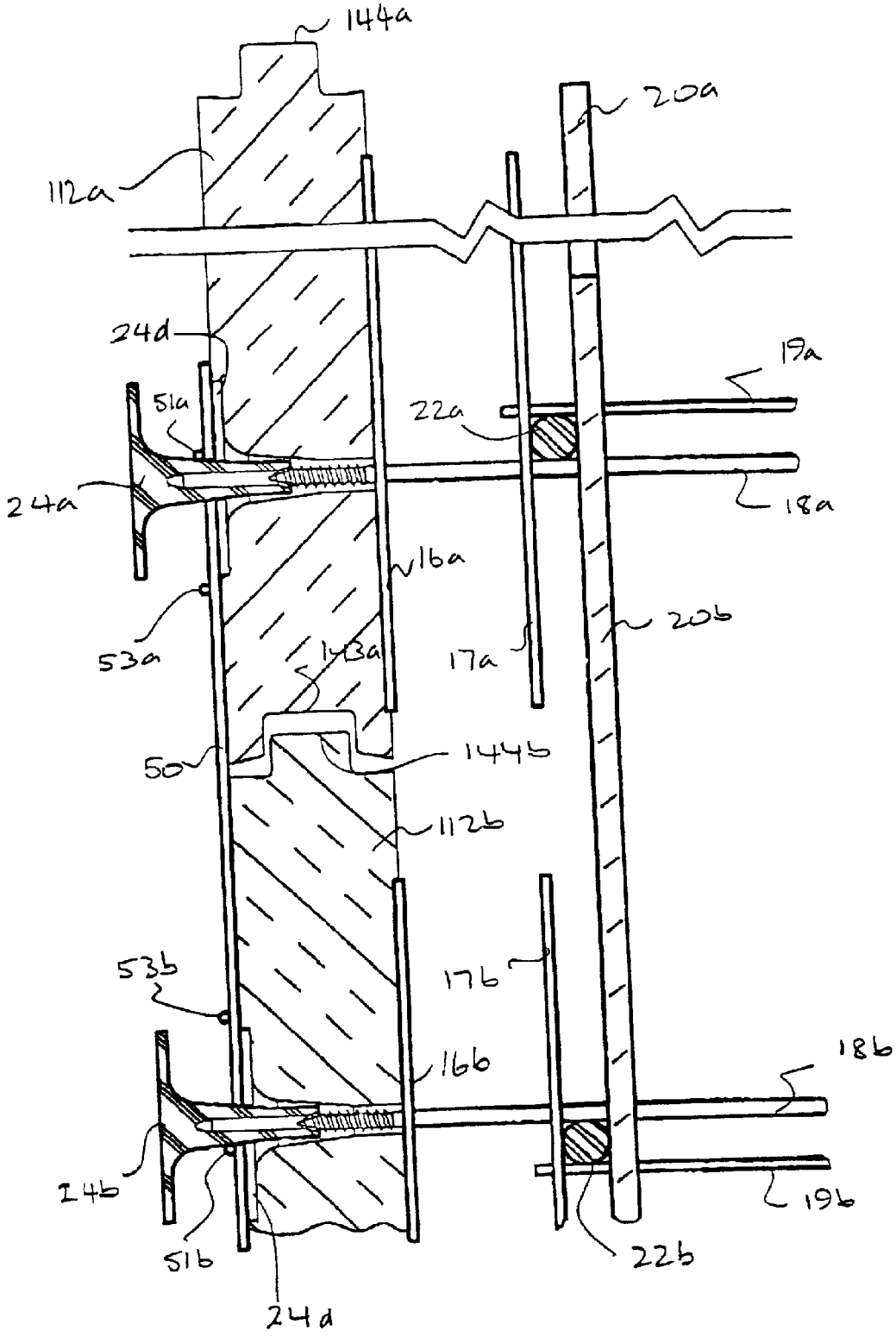
FIG. 2D is a top view of the reinforcement system of FIG. 2A, illustrating the initial positioning of the panel members and associated components.
Figure 2F:
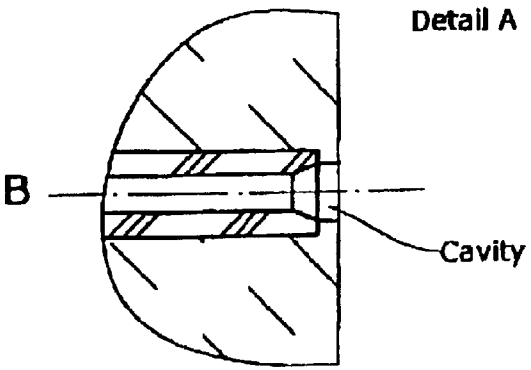
FIGS. 2E, 2F, 2G, 2H, 2I, 2K are top views illustrating the process of joining a frame assembly module with a connector, to form the connection shown in FIG. 2A.
Figure 2E:
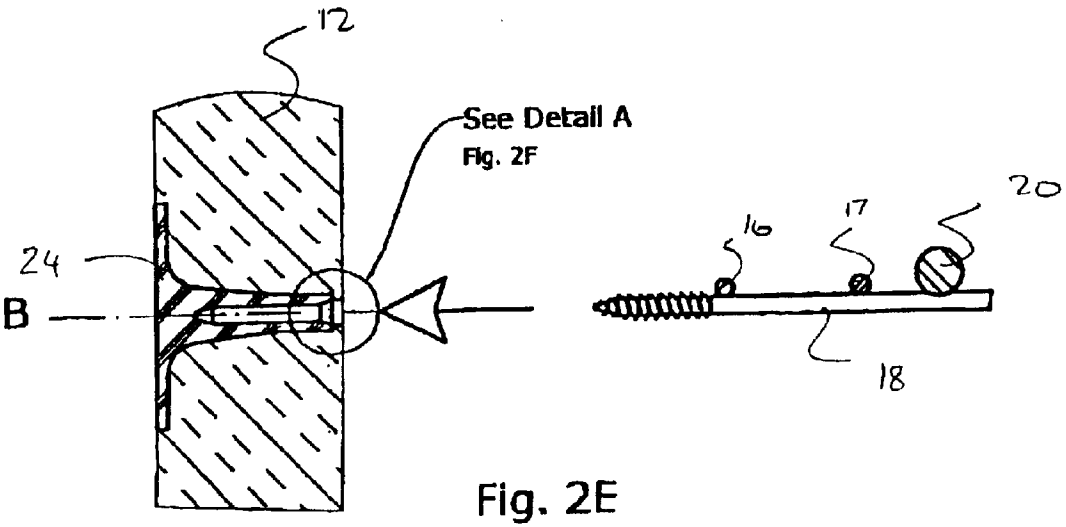
Figure 2H:
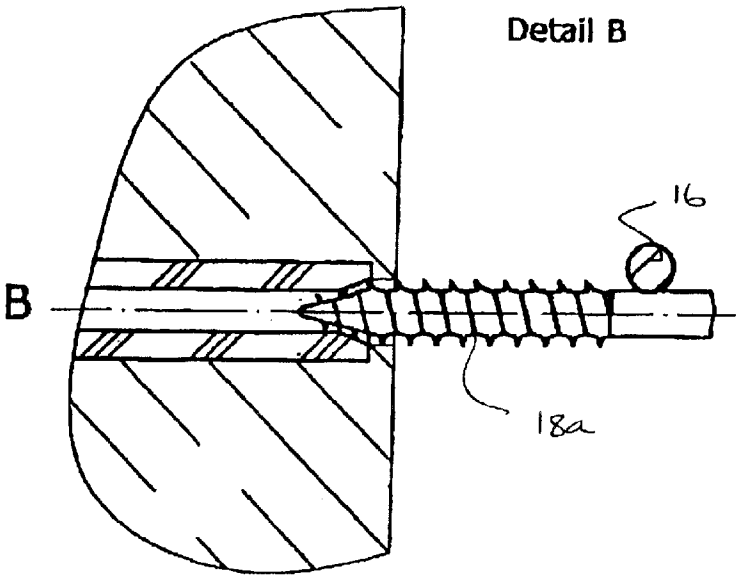
Figure 2G:
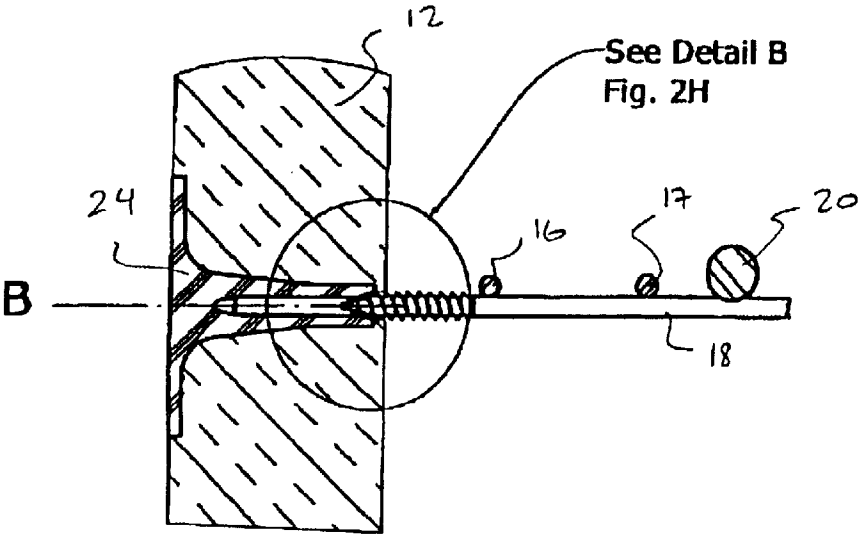
Figure 2K:
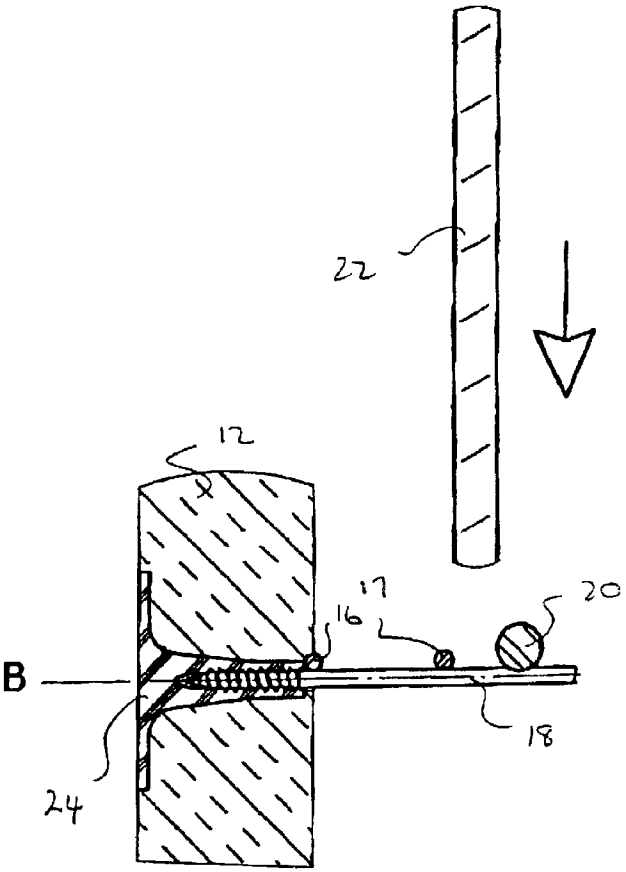
Figure 2I:
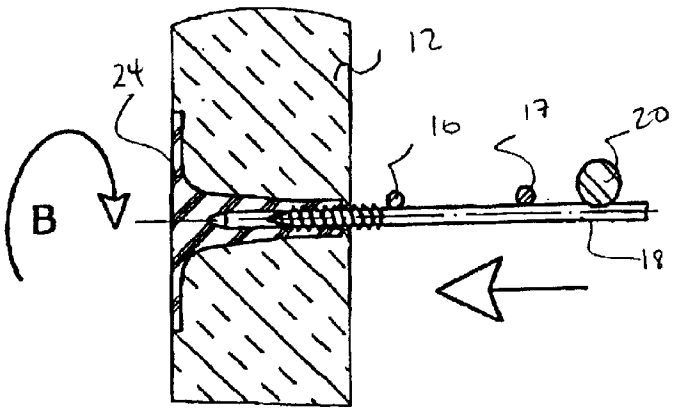
Figure 4A:
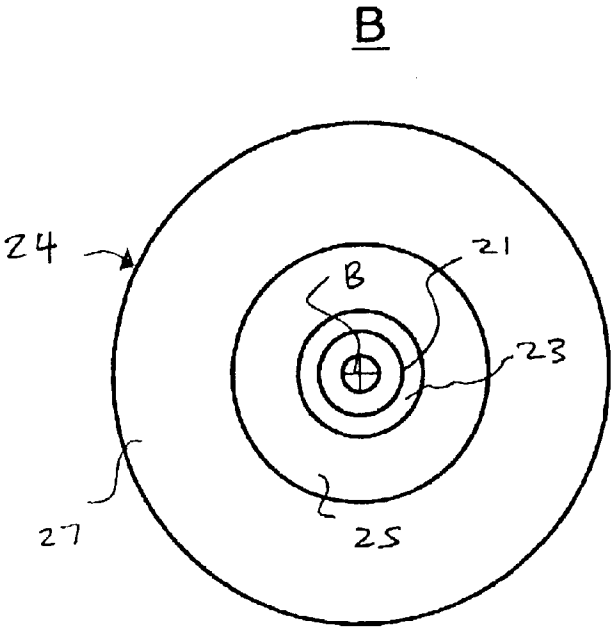
FIG. 4A is an end view of a connector in FIG. 4 showing that its shape consists of co-axial figures of rotation.
Figure 4:
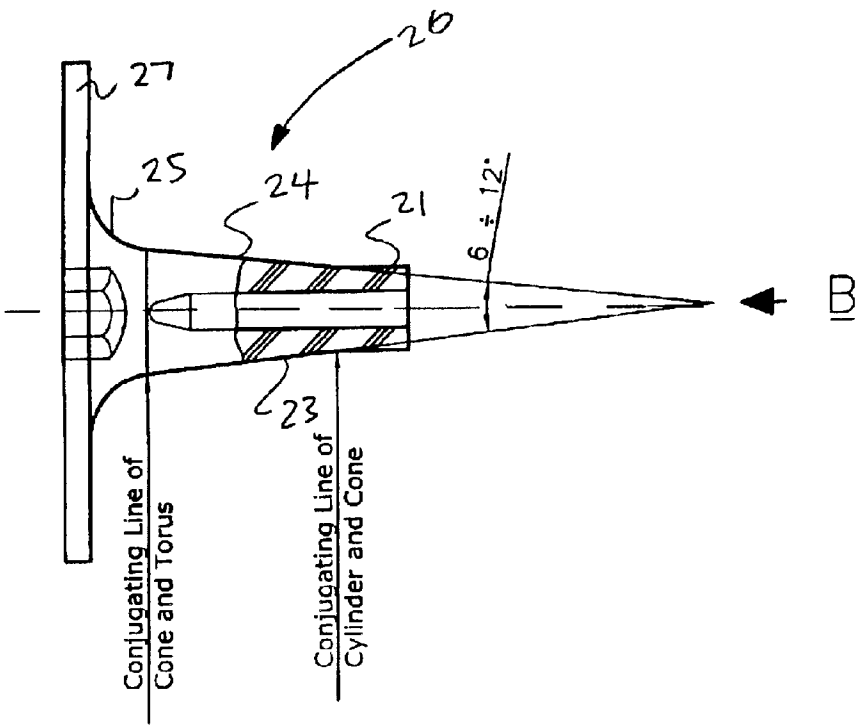
FIG. 4 is a side view partially cut away of a connector contained in the body of the said panel in the reinforcement system of FIGS. 1, 2, 2A, 2B, 2C, 2D and 3.

The preferred connection between connector 24 and rod 18 is achieved by means of utilizing the machine tapping end 18*a* of rod 18 to tap the inner walls of a hollow inner cavity extending in a leg portion 26 of connector 24 as shown in FIGS. 2E, 2F, 2G, 2H, 2I and 2K. Transverse wire rod 18 passes into the opening to the inner cylindrical cavity in the connector, which is positioned co-axially to axis B. Connector 24 has its longitudinal axis of its leg portion 26 oriented along axis B (See FIG. 4A). Connector 24 is contained in the panel body portion 12. Machine tapping end 18*a* of transverse rod 18 enters the blind opening of connector 24 and passes to abut the front of the walls of the opening to the inner cavity. The inner cavity has a diameter which is less than a diameter of the tap (e.g. 0.7–0.85 of the tap's diameter) such as is illustrated in FIGS. 2G, 2H. Rotation of connector 24 in a clockwise direction will cause the tap end 18*a* of rod 18 move inwards into the inner cavity to form a tapped connection between connector 24 and rod 18.

By way of further explanation, connector 24 can be started to be rotated and the steel tap of end 18*a* of wire rod 18 taps the inner walls of the inner cavity 24*a* of the connector 24 as shown in more detail in FIGS. 2H, 2I, 4 and 4A. Connectors 24 are preferably made from a suitable composite materials, and most preferably are made from polypropylene with glass fiber reinforcement. The rotation of connector 24 can be assisted by the presence of grooves (note shown) in its upper surface, which a tool can be inserted into to assist in effecting the rotational movement. While rotating of the connector 24 during tapping of inner walls of the inner cavity 24*a*, the wire rod 18 makes forward movement from inner surface of panel 12 toward the outer surface of the panel 12, as shown in more detail in FIG. 21. This forward movement finishes when connector 24 abuts into rod 16 (see FIGS. 2 and 2K). Although the preferred type of connection between connector 24 and rod 18 is as described, in some embodiments of the invention, other types of connections can be used.

Connectors 24 and rod 18 co-operate to perform several functions together. First, connector 24 connects rod member 18 (and its associated frame assembly module) to a panel portion 12 and thus to a panel 112. This connection of the frame assembly to the panel 112 can be enhanced when connector 24 is tightened on rod 18, thus compressing panel portion 12 between the cap portion of connector 24 and rod 16. The forces resulting from this compression enhance the rigidity of the connection. This is particularly useful when the rod 18 and its frame assembly module are only supported at one end of rod 18 on one panel (i.e. in a cantilever arrangement). It is important to note, however that the end of leg portion 26, of connector 24, when the frame assembly 14 is properly positioned, will be in contact with wire rod 16. This is particularly important when panel 12 is made of a material like polystyrene which does not resist compression very well and does not have a resisting force that increases with displacement and the connector 24 is made of a material like plastic. As noted above, the length of the leg portion 26 of the connector 24 is preferably selected so that the end of leg portion 26 will stop the rotation of the connector 24 when it abuts with the rod 16 thus limiting the amount of rotation. Without a stopping element like rod 16, if connector 24 is made of a plastic, the wire rod 18 can continue to be tapped into the connector piercing its cap portion. Additionally, if the length of the connector 24 is not suitably chosen, the continued tapping of rod 18 into connector 24 can cause rod 16 to cut into the body of the polystyrene panel 12.

In some embodiments, the frame assembly module is supported between two opposed spaced panels 112, at each end of rod 18. Each end of rod 18 typically has a connector 24 attached thereto (FIG. 2B). In this embodiment, rod 18, in addition to being a component of the frame assembly module, also acts as a tie rod. Thus, in combination with connectors 24 at each end, rod 18 functions to hold panel 112 in position when panel 112 is subjected to hydrostatic pressure from the concrete poured in the form. Rod 18 and connector 24 could also be utilized to hold the panel in position if instead of being held between two panels, the other end of rod 18 is otherwise secured.

Additionally, some connectors 24 on each panel 112 can be used to cooperate with a generally c-shaped joint bracer 50 (FIGS. 2A, 5A, 5B, and 6) and a connector 24 on an adjacent panel 112 to provide a tight connection between adjacent panels.

Aside from the frame assembly module 14, and a connector 24, the reinforcement system includes at least one reinforcement member (rebar) 20, which is oriented generally longitudinally and is most preferably made from suitable reinforcement steel. Preferably it has a cross sectional diameter of between 6 and 12 mm. It is preferred if the length of rod 20 is in the range of 30–50 times its diameter.

Wire rod members 16, 17, 18 and 19, as well as longitudinal rebar member 20, are all joined together at W (FIGS. 2A and 2B) by conventional techniques, preferably by spot welding when the components are made from weldable materials. Other techniques can be used including binding with wire or other suitable techniques. The spot welding of rebar member 20 is typically accompanied by arcuate cut-outs or indentations 18*b* in rod members 18 and 19, created by the spot welding, as shown in FIG. 2. As mentioned above, the depth of cut-out is preferably 6–8% of total amount of diameter of the joining rebars and rod members. For rod 18, a cut-out typically can have a depth from 0.7 mm to 1 mm and for rods 17 and 19, cut-out typically can have a depth from 0.5 mm to 0.8 mm. Typically when welding bars or rods of different diameters, the cut-out tends to form in the rod with the smaller diameter because it has less electrical resistance and thus melts faster. Thus, during welding of rod 17 (e.g. 3 mm) and rod 18 (e.g. 5 mm) cutouts typically occur in rod 17. Likewise during welding of rod 19 (e.g. 3 mm) and 18 (e.g. 5 mm) cut-outs typically occur in rod 19. Similarly during welding of rebar member 20 (e.g. 10 mm) and rod 19 (3 mm) cut-outs usually occur in rod 19.

Together, assembly frame module 14 comprising the rods 17, 18 and 19, and longitudinal rebar 20, provide an overall frame assembly structure and are arranged to form a retaining cell 23 providing a vertically oriented opening which can receive vertical rebar 22 therethrough. It is preferable, although not necessary, that the retaining cell 23 and its corresponding opening be square or rectangular in shape. However, other shapes provided by the intersection of rods 17, 18 and 19 and reinforcement bar 20, will also provide a suitable retaining cell. Once vertical reinforcement bar 22 is inserted through the vertical opening of retaining cell 23, it is longitudinally and transversely retained in cell 23. In many applications it is not necessary, that the vertical rebar member 22 be secured in any other way (such as by spot-welding or wire binding). Reinforcement bar 22 is preferably made from suitable reinforcement steel, but could also be made from other suitable materials such as certain composite fibers including carbon fiber composites or glass fiber composites.

Although not illustrated clearly as such in FIGS. 1, 2B and 2C it will be appreciated that is some preferred embodiments, the rod members 16 and 17 cannot extend beyond the front and rear faces of the panels. Accordingly, the rod members cannot be overlapped in one of the ways in which reinforcement members 20 or adjacent panels are overlapped, as described herein.

With reference again to FIGS. 2, 3 and 4, it will be noted that during connection of panel 12 (which is preferably of a thickness of about 50 mm) with the frame assembly module 14 by rotating plastic connector 24 contained in the panel body 12 (preferably to a depth of 48 mm from the outer surface), the wire rod 18 moves co-axially with axis B. The wire rod 18 movement is a result of the tapping of the inner cavity of the blind opening 24*a* of connector 24 (preferably with a depth of 40 mm and diameter of 4.4 mm) while rotating of the connector 24 around end of wire rod 18*a*. As mentioned previously, end 18*a* is formed as a machine tap (in one preferred embodiment with a length of 35 mm and outer tap diameter of 5.4 mm). Movement of wire rod 18 results in forward movement of the frame assembly module 14. As a result, the longitudinal rod 16 (preferably with a diameter of 3 mm) of the frame assembly module 14 is driven towards the inner surface of panel 12 (preferably made from expanded or extruded polystyrene with a density preferably of 1.8–2.0 lb/f3). Movement of frame assembly module 14 continues until the end of leg portion 26 of connector 24 reaches wire rod 16. In a preferred embodiment, connector 24 is tightened on rod 18 to a position where wire rod 16 in combination with connector 24 compresses the panel body and wire rod 16 makes a channel or indentation 28 with a depth of preferably about 2 mm in the inner surface of the said panel 12. As a result, frame assembly module 14 will be in a position to provide proper positioning of the longitudinal reinforcement rod 20 and vertical reinforcement rod 22. The connection of these jointed elements with the tightening action, provides for the possibility to pre-assemble the structure at a plant located away from the construction site and then the structure can be transported to the construction site with the desired geometric parameters already provided.

As will become evident hereafter, a plurality of assembly frame modules 14 and one or more horizontal rebar members 20 will typically be provided in connection with each panel, to create a plurality of retaining cells 23 spaced longitudinally along the length of panel 112 to create a web layer 29. This can be achieved by providing a series of spaced pairs of transverse rods 18 and 19, that co-operate with a single longitudinal rod 17 and single longitudinal rebar member 20. The intersection of the series of pairs of rods 18 and 19 with the common rod 17 and rebar 20 creates a series of longitudinally extending retention cells 23 associated with a single panel 112 (e.g. FIGS. 3 and 6).

Thus, for a complete panel 112, rods 18 in combination with connectors 24 secure each frame assembly module 14, and thus the rebar 20, in their proper positions relative to the inner surface 30 of panel 112. Once the retention cell 23 is properly formed and positioned, it is ready to receive through the opening, a vertical rebar member 22.

Additional pairs of longitudinal members 17 and corresponding rebar members 20 can be provided to create a series of retention cells 23 that extend transversely away from inner surface 30 of panel portion 12 and panel 112. It should also be noted that two transversely spaced retention cells could be provided comprising one longitudinal rebar member 20, with a transverse rod member 17 on each side thereof. Thus, two transversely spaced retention cells 23 could be formed using a common reinforcement member 20. The transversely spaced retention cells 23 share common transverse rods 18 and 19. The combination of a plurality of cells extending both longitudinally and transversely creates a generally horizontally oriented web layer 29 that extends both longitudinally and transversely of retention cells 23 (see FIG. 2B).

Figure 6:
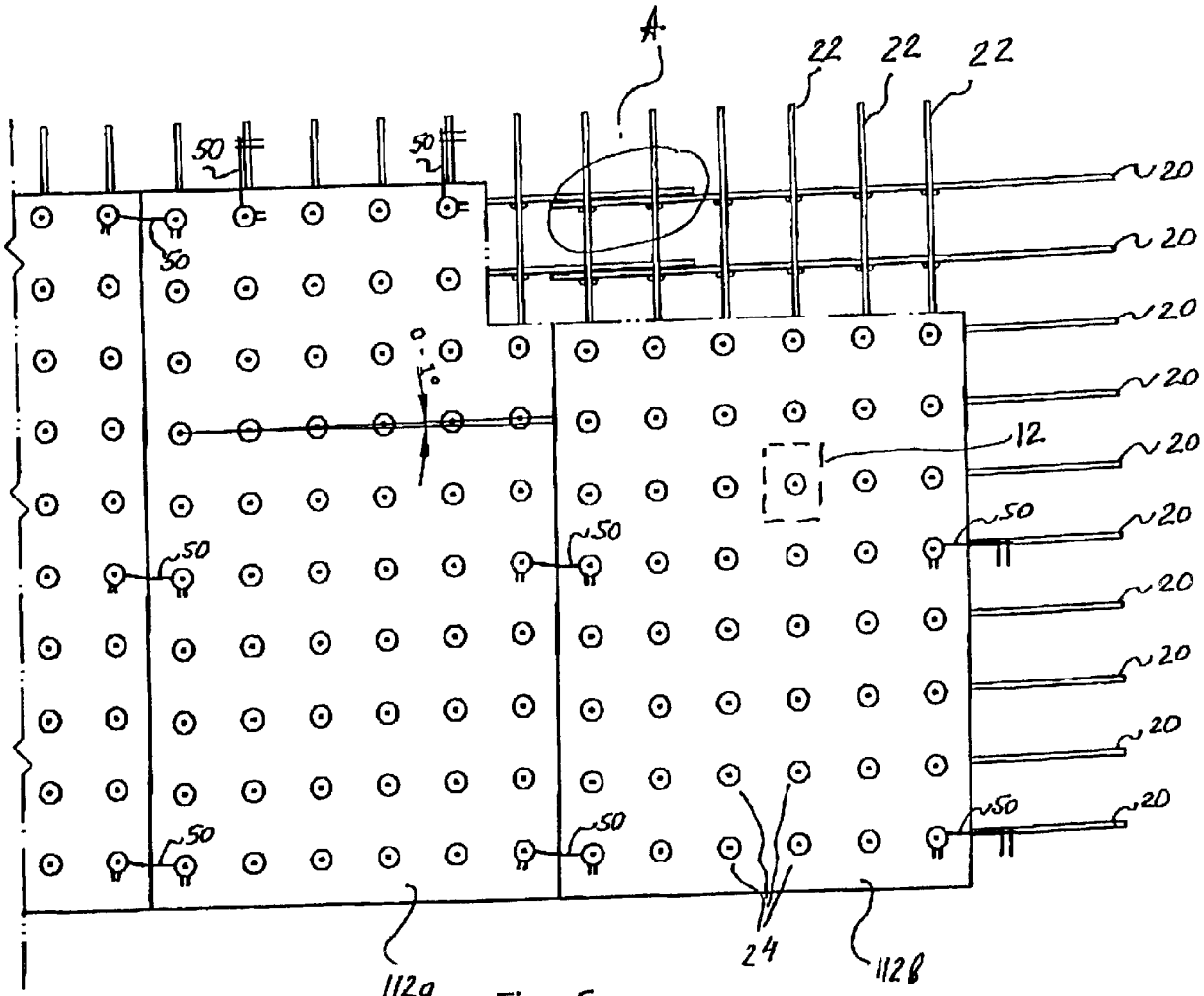
FIG. 6 is a front view of the reinforcement system of FIGS. 2A–2D, FIG. 5B employed with multiple panel members.

Furthermore, several vertically stacked web layers 29 of generally horizontally oriented retaining cells 23 will typically be provided in a wall structure, such as is illustrated in FIGS. 2B, 2C and 6. Thus, a series of vertically stacked assembly frame modules 14 will be associated with each panel 112, each assembly frame module being separated vertically from another module in another layer. It will be appreciated that in this way, each of a plurality of vertical rebar members 22 can be supported at several different vertical positions along their lengths within a series of vertically spaced retention cells 23.

As discussed briefly above, it is contemplated that in some embodiments each web layer 29 will be supported transversely between two opposite panels 112 as illustrated in FIG. 2B. Each web layer 29 is supported at multiple longitudinal positions on each of the two panels 112 by rods 18 and connectors 24. In FIG. 2B, the upper portions of the opposed panels 112 are shown partly removed for clarity of illustration. Each of rods 18 is supported and mounted at each end by at a panel portion 12 and connector 24. In this embodiment, rods 18, in addition to supporting the rest of the frame assembly 14 and the rebar members 20, also serve the purpose of acting as a tie rod, holding the panels in position when the form space 31 is filled with unhardened concrete.

As an alternative to having a reinforcement system supported between two panels, as disclosed in FIG. 2B the system can be supported at a single panel at only at one end of rods 18, such as disclosed in FIG. 2C. Thus each web layer 29 is cantilevered from a panel 112 as the layer is held by the interaction of connector 24 with rod 16, that provides a stiff connection to panel 112 (i.e. the panel 112 is compressed to some extent between connector 24 and rod 16). The form can then be completed using conventional techniques, including using the panel as one of the walls, or as part of a wall for the form. Also the single panel could be supported between two conventional parallel form walls, with the panel having its rear surface 33 supported by the surface of one of the form walls. In these latter embodiments, however, rods 18, typically would not provide the function of providing tie rods to support the panel 112 when subjected to the pressure from the unhardened concrete in the form space. But rods 18 do function to support the frame assembly module and rebar member 20 and assist in forming the retention cell 23.

It should be noted that other variations in the specific construction of the frame assembly 14 and reinforcement bar 20 can provide an adequate retention cell with the same components. For example, as shown in FIG. 2C, rod 18 can be joined to rod 17, with rod 18 supporting rod 17 from beneath. Rod 17 supports rod 19, which is in a different vertical position to relative to rod 18, from beneath rod 19. Rebar 20 is then supported from below by rod 19. Although the overall shape and structure of this retention cell disclosed in FIG. 2C is similar to the retention cell shown in FIGS. 1, 2A and 2B, it is not be joined together in as many places and so is not as strong.

Either such structure comprising either a single panel 112 or two panels 112, along with the reinforcement system having a plurality of frame assemblies and rebar members 20, can be built off site and delivered to a construction site ready for placement. The vertical rebar members 22 can then be inserted once the structure is properly positioned, simply by dropping the vertical rebar down through successively aligned retention cells 23 associated with each web layer.

The form will also have to be completed once the structure of panel and reinforcement system are properly positioned. This may only require the ends of the form to be provided where two panels are provided, or an additional wall may be required instead of the second panel 112. Once the form is completed and vertical rebar 22 is in place, the concrete can be poured into the form space such as space 31 (see FIG. 2B).

The overall result is a very efficient use of materials to both support and properly position both the horizontal and vertical rebar members, and to maintain the integrity of the form as a whole when the concrete is poured into the form space.

It should be noted that in this document the term "vertical" is used to describe the relative orientation of the openings 26 in the retention cells 23 and the relative orientation of rebar members 22 to the longitudinal and transverse directions. In most applications, it will be preferable that the members 22 will be actually oriented at or close to true vertical relative to level ground (vertical being oriented in the direction of the force of gravity). However, it is possible to obtain many of the benefits of the invention if the "vertical" orientation is not vertical relative to level ground. Although not preferred, the reinforcement system could be utilized with the retention cell openings and rebar 22 being oriented at an angle other than vertical relative to true level ground. For example, members 16 and 17 could be oriented vertical and members 22 horizontal, relative to true level ground (i.e. parallel to flat ground).

With reference now to FIGS. 3 and 6, a panel portion 12 is shown as part of a panel 112. Panel 113 has a functional length L, height H and depth D. Panels 112 can be formed as described above with connectors 24 oriented in the positions shown in FIGS. 3 and 6. Panels 112 can be combined, such as is shown in FIG. 6, to create a combined structure that forms a part of a composite form 100 for a concrete wall.

It will be observed that in this embodiment, for each panel 112, reinforcement bar 20 extends beyond the leading edge 144 of the panel (FIG. 3). Preferably the extension beyond the leading edge should be in the range of 30–50 times the diameter of rod 20. Thus, when two panels 112 are put into abutting, adjacent longitudinal relationship with each other, horizontal reinforcement members 20 will overlap as is required in normal construction practice, as for example is illustrated in both FIGS. 2A and 6. However, wire rods 16 or 17 preferably terminate before reaching front faces 68, 70 or rear edges 72, 72 of the panel 112, as best illustrated in FIG. 2A.

As previously discussed, and as is evident from FIGS. 3, 2B, 2C and 6, retention cells 23 for vertically oriented reinforcement members 22 are created with a series of vertically stacked web layers, each layer comprising a plurality of frame assembly modules 14 and one or more rebar members 20.

With reference again to FIGS. 3 and 6, it should be noted that connectors 24 and thus the frame assembly members 16 and 17 are not oriented horizontally (i.e. parallel to surface 146 of panel 112). The positioning of connectors 24 is such that a series of parallelograms 11 are formed with generally vertical lines 13 through a column of connectors 24 are oriented parallel to front face 144 of panel 112 (FIG. 3). Additionally, horizontal lines 15 through a row of connectors 24 are mounted to provide a small angle from the horizontal faces 146 and 148, of preferably of between 0 and 1 degree. Such angle is sufficient if the length L of the panel if 4 feet or more. If the length L of panel is between about 8 inches and 4 feet, the angle should be selected between about 1 and 7 degrees. The overall result of this configuration is that rod members 18 are sequentially mounted on a slope downwards from left to right in FIG. 3. This results in a sloping of the rod members 16, 17 relative to the longitudinal base faces 146 and 148 and corresponding sloping of horizontal reinforcement members 20 at the same slope. The result, as illustrated in FIG. 6, is that two adjacent panel units 112*a*, 112*b* can be placed into abutting adjacent relationship, with each other with their respective horizontal rebar members 20 overlapping one above the other as the leading portion of rebar members 20 (at a tongue side of a panel) in the left hand side panel 112*a* passes over the trailing ends of rebar members 20 of the right hand side panel (groove side face of panel) 112*b*. This provides an effective method of and system for overlapping the rebar 20 between adjoining adjacent panels 112. Thus, connectors 24 contained in the body panel 112 (as was described above) have lines passing through each central axis B of adjacent connectors 24 to form a grid in the shape of parallelograms. In doing so, one of the sides is vertical and parallel to vertical face of the panel 112. The connectors 24 are connected with rod members 18, which are located vertically in each layer and form a retention cells 23 in each layer oriented for vertical installation of reinforcement members 22 (FIG. 6)

With reference now to FIGS. 2A, 2D, 4, 4A, 5A, 5B, and 6 the securing of two adjacent modular panels 112*a*, 122*b* using generally C-shaped bracers 50, and connectors 24 is illustrated. Bracers 50 are preferably steel rods that are fairly uniform in depth and preferably are rectangular or circular in cross section. It should be noted that in FIG. 2A, two panels 112*a* and 112*b* are shown with an overlapping of one longitudinal reinforcement rod 20*b* from panel 112*b* above the other rod 20*a* of panel 112*a* (see FIG. 6—detail A). In a preferred embodiment the connectors 24 of one row are inclined to angle 0.6–1 degrees when the length L of the panel is approximately 4 feet.

Connector 24 is preferably made from glass fiber reinforced polypropylene and is contained and/or held in the body of the panel 112 preferably made from expanded or extruded polystyrene, as mentioned above. Considering the shape of connector 24 in FIG. 4, 4A and the fact that the adhesion or friction between glass fiber reinforced polypropylene and expanded or extruded polystyrene is very low, connector 24 can freely rotate about a transverse axis, relative to panel 112. As mentioned above, connector 24 has a blind cylindrical opening 24*a* that is co-axial with axis B from the side of said inner surface of said panel 112. The shape of the shaft portion of connector 24 can be described as a figure rotation of a line around central axis B. As a result, the shape of said connector 24 is formed from four consecutively connected figures of rotation. A first FIG. 27 has the shape of a cylinder, the second FIG. 25 has the shape of a truncated toroid, the third FIG. 23 has the shape of a truncated cone and the fourth FIG. 21 has the shape of a cylinder. The surface provided by the first FIG. 27 prevents displacement of connector 24 towards said inner surface of said panel 112 (i.e. it maintains the cap of connector 24 at or near the outer surface). Thus, overall the connector 24 has a mushroomed shape for its outer surface consisting of a shaft portion comprising figures of rotation 21, 23, 25 and a cap portion comprising the FIG. 27.

Prior to installation of said panels 112 at the desired position on the construction site, each pair of the connectors 24 of two adjacent panels, which should be connected with generally C-shaped bracers 50, are rotated counterclockwise which moves the connectors that are to be connected to the bracers to the position shown in FIG. 2D. In a preferred embodiment, connector 24 is rotated until the fourth cylindrical Figure. 21 is positioned 7–10 mm from outer surface of the panels 112. This leaves a cavity 241 in the body of panels 112*a*, 112*b*.

Figure 5A:
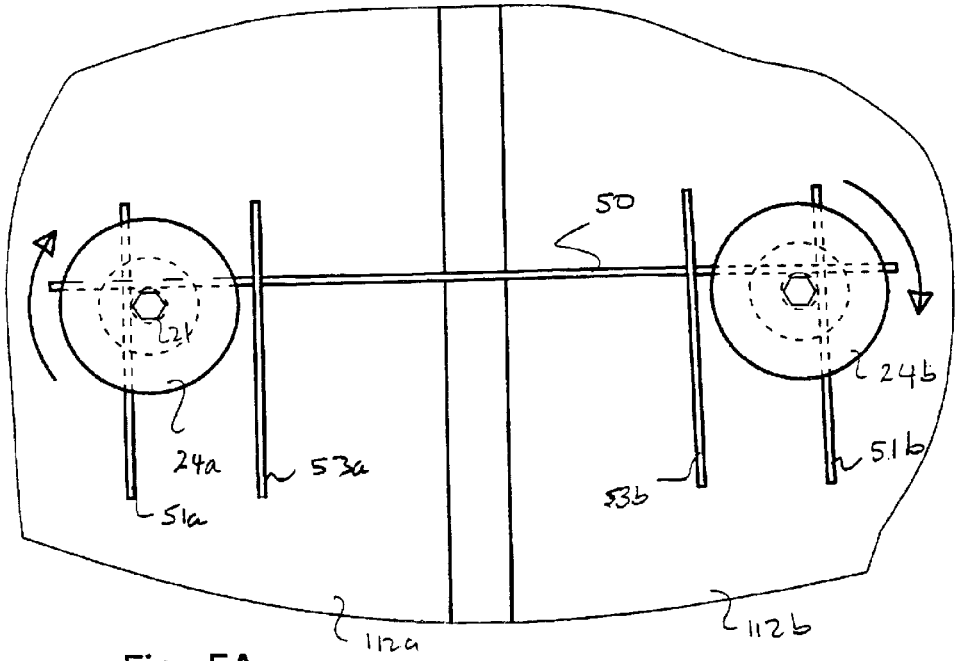
FIG. 5A is a front view of beginning of joining two connectors contained in the body of two adjacent panels portions by means of a panel bracer, as illustrated in FIG. 2D.
Figure 5B:
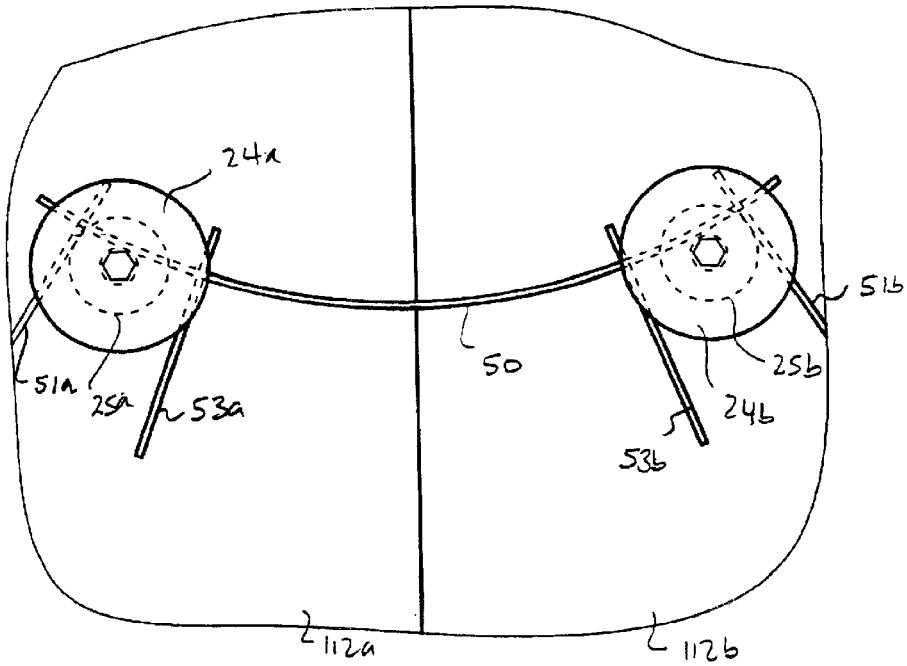
FIG. 5B is a front view of two connected panels portion of FIG. 5A, the top view of which is FIG. 2A, FIG. 9 and FIG. 16.

The cylindrical figure portion 21 of the said shaft portion of the connector 24 permits the relatively easy placement of a pair of end legs 51, 53 of a panel bracer 50 around the said shaft portion of each connector 24, as shown in detail in FIGS. 2D and 5A. Panel bracer 50 is preferably made from one or more longitudinal steel rods (collectively 50) and two or more transverse steel rods (51, 53). It will be appreciated that the pushing together of the panels 112*a*, 112*b*, using bracer 50, is primarily effected by the interaction of the outer legs 51*a*, 51*b* of bracer 50 on the outer surface of connector 24*a*, 24*b*. Therefore, and with reference to FIGS. 2A and 2D in particular, the spacing of the outer legs 51*a* and 51*b* on bracer 50 is preferably selected as follows: when connectors 24*a* and 24*b* are in the positions shown in FIG. 2D they are in close proximity, and most preferably abut, the outer side of the surface of connectors 24*a*, 24*b* in the vicinity of conical section 23. The spacing of outer legs 51*a* and 51*b* must also be such that when connectors 24*a* and 24*b* are rotated to the position shown in FIG. 2A, the positioning on the outer side surface of connectors 24*a*, 24*b*, is such that a compressive if generated by legs 51*a*, 51*b* causing panels 112*a* and 112*b* to be pushed together. This occurs as legs 51*a*, 51*b* ride along the outer surface in conical section 23 and into toroid section 25. This expands the distance that legs 51*a* and 51*b* are from the respective axes B of connectors 24*a*, 24*b*, causing the connectors to be drawn together, thus drawing panels 112*a* and 112*b* together.

Longitudinal and transverse steel rods are welded in the crossing spots and each has a diameter in the range of about 2.5–3.5 mm. The length of the leg portion of bracer 50 is usually not less than a diameter of cap portion of said connector 24 and preferably is in the range of 50–60 mm. Of course, other materials of different thickness and cross sections can be employed.

When connector 24 is thereafter rotated clockwise, the tapped inner surfaces of cavity 24*a* slide over the surface of the tap of the end of rod 18 and connector 24 (its portion 27) moves towards the outer surface of the panel 12 (FIG. 5A). The outer legs of panel bracer 50, start to ride up the cylindrical section and then the toroid section of leg portion 26, and tend to be driven generally in a direction that is curved outward. The interaction primarily of the outer legs 51*a*, 51*b* of bracer 50 with the outer surfaces of the conical portion 23 and the toroid portion 25 of the leg portion 26 of connectors 24 cause bracer 50 to be put under increasing tension which creates an opposite compressive force on the two adjacent connectors 24 drawing their associated panels 112*a* and 112*b* toward each other. The overall effect on the bracer 50 is to cause bracer 50 to deflect into the bowed shape illustrated in FIG. 5B.

For those connectors that have a bracer 50, when the connector 24 has been rotated anti-clockwise and then clockwise to secure the bracer in position and join the adjacent panels, the bracer 50 interacts with the cap of connector 24 and panel 12 to serve as a stopping element to resist rotation of connector 24 and its piercing with the end 18*a* of rod 18.

As mentioned above, when the system is being used in and as part of a form system such as is illustrated in FIG. 2B, the frame assembly module 14 (comprising wire rods 16, 17, 18 and 19) acts as a frame structure to hold the panels 112 in position perpendicular to its plane. The generally mushroomed shaped connectors 24 serve to assist in transmitting transverse load exerted on the panel 112 by the hydrostatic pressure from poured, unhardened concrete to the frame by connecting with rod 18 to resist the transverse load that is exerted on the panel 112.

Figure 4C:
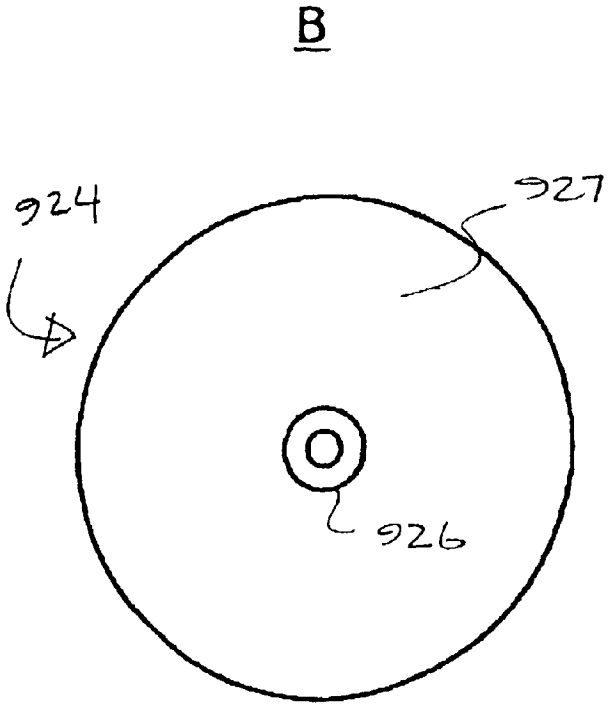
FIG. 4C is an end view of a connector as in FIG. 4B showing that its shape consists of co-axial figures of rotation.
Figure 4B:
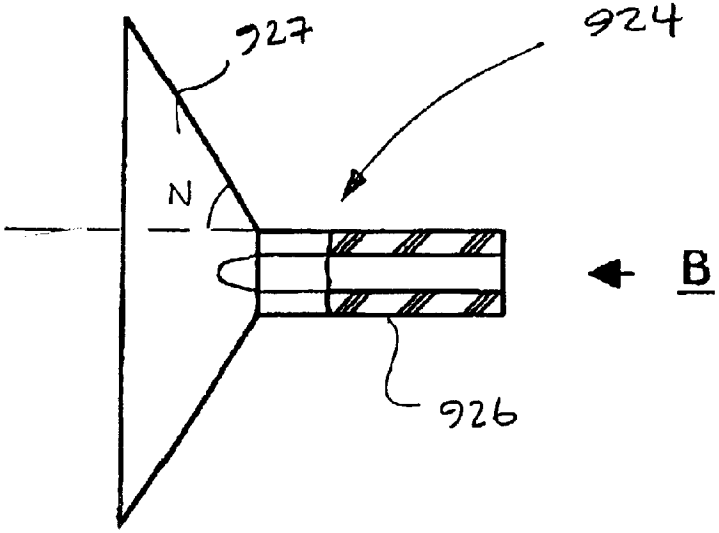
FIG. 4B is a side view partially cut away of a connector for use in the body of a panel and the reinforcement system of FIG. 1 according to another embodiment of the invention

Different types of known connectors can also be used in the reinforcement system disclosed herein. However, particularly, for those connectors which are used in joining frame assembly module 14 to a panel (and which are not used in conjunction with a bracer 50 to join two adjacent panels the connector 924 in FIGS. 4B and 4C is preferred. This connector 924 is particularly well adapted to resist hydrostatic pressure effecting the panel 112 caused by unhardened concrete.

Connector 924 has a shape, which can be described as figure of rotation around the central axis of two consequently connected figures of rotation. The first FIG. 927 has a shape of truncated cone; the second FIG. 926 is in the shape of a hollow cylinder. The surface provided by the first figure prevents displacement of the connector 24 relative to inner surface of the panel 112, a generator of which is inclined to axis B at an angle N of 70–85 degrees.

Figure 4D:
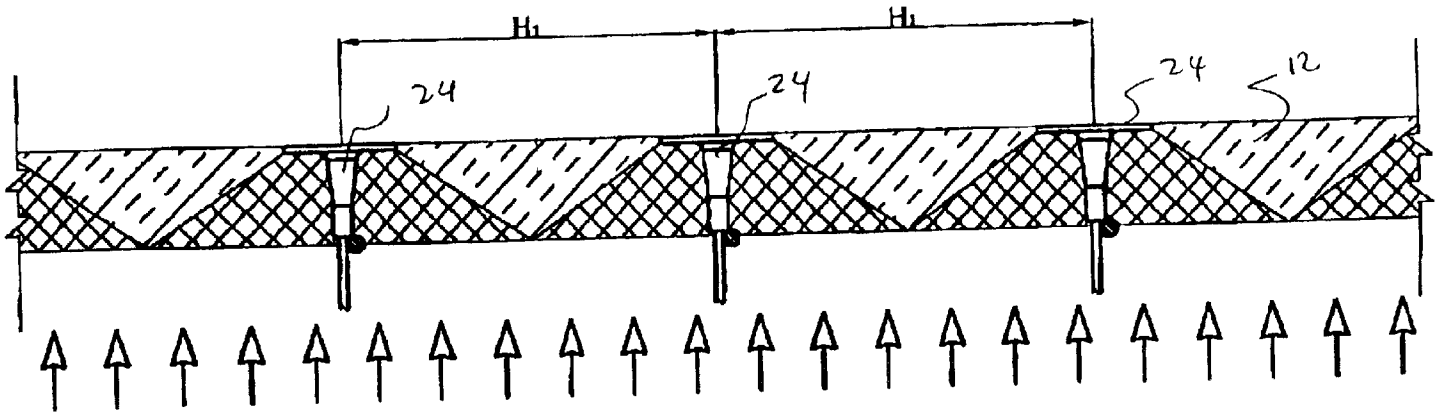
FIGS. 4D, 4E are schematic top views illustrating the compression state of the formwork panels, caused by hydrostatic pressure of poured concrete (indicated in arrows) resulting from the use of connectors illustrated in FIGS. 4, 4A and FIGS. 4B, 4C respectively.
Figure 4E:
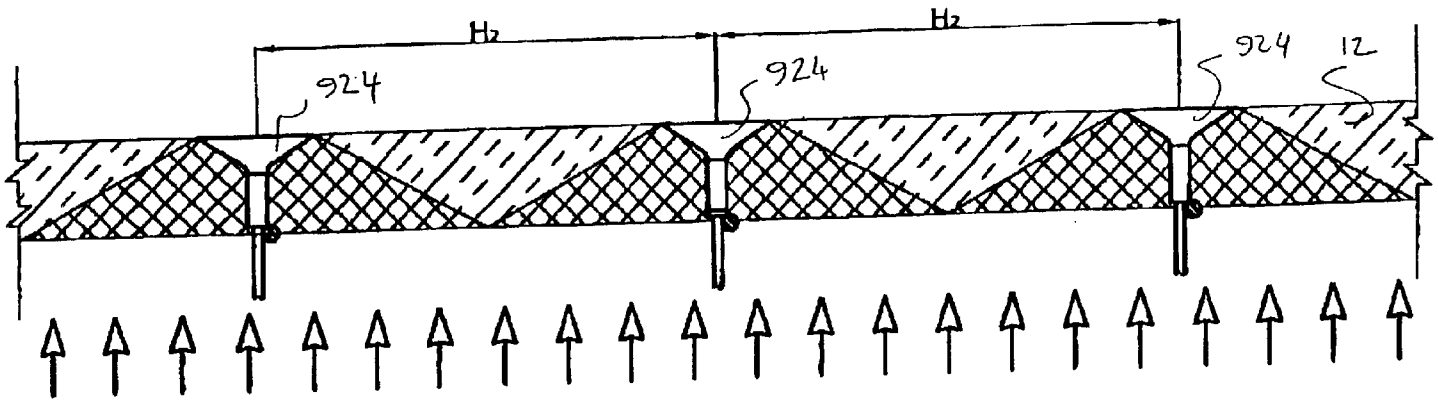

The effect of providing a connector 924 with such a shape is schematically shown in FIGS. 4D and 4E. FIG. 4D shows the compression pressure in the body of panel 112 resulting from using connectors 24 from FIGS. 4 and 4A to resist the hydrostatic pressure from unhardened concrete. The connector 924, however, having a wedge-type shape cap, interacts with the body of the panel as illustrated in FIG. 4E, to increase the area in the body of the panel that resists the load from the hydrostatic pressure of unhardened concrete. In other words, the wedge shape of the cap in connector expands the area of compression and puts "non-working areas" of the body of the formwork panels into compression. The effect is that connectors 924 can be spaced at a distance H2 which is greater than the spacing of connectors H1, yet still carry the same compression load in the body of the panels 112.

Accordingly, it is advantageous that in comparison with the connector 24, the cap of which has a flat surface faced towards the inner surface of the panel, it is possible to decrease the quantity of connectors 924 required per a unit of area of the concrete formwork in accordance with the present invention, or decrease the sizes of the connector and the sizes of the machine tap of the rod 18, etc.

Figure 7:
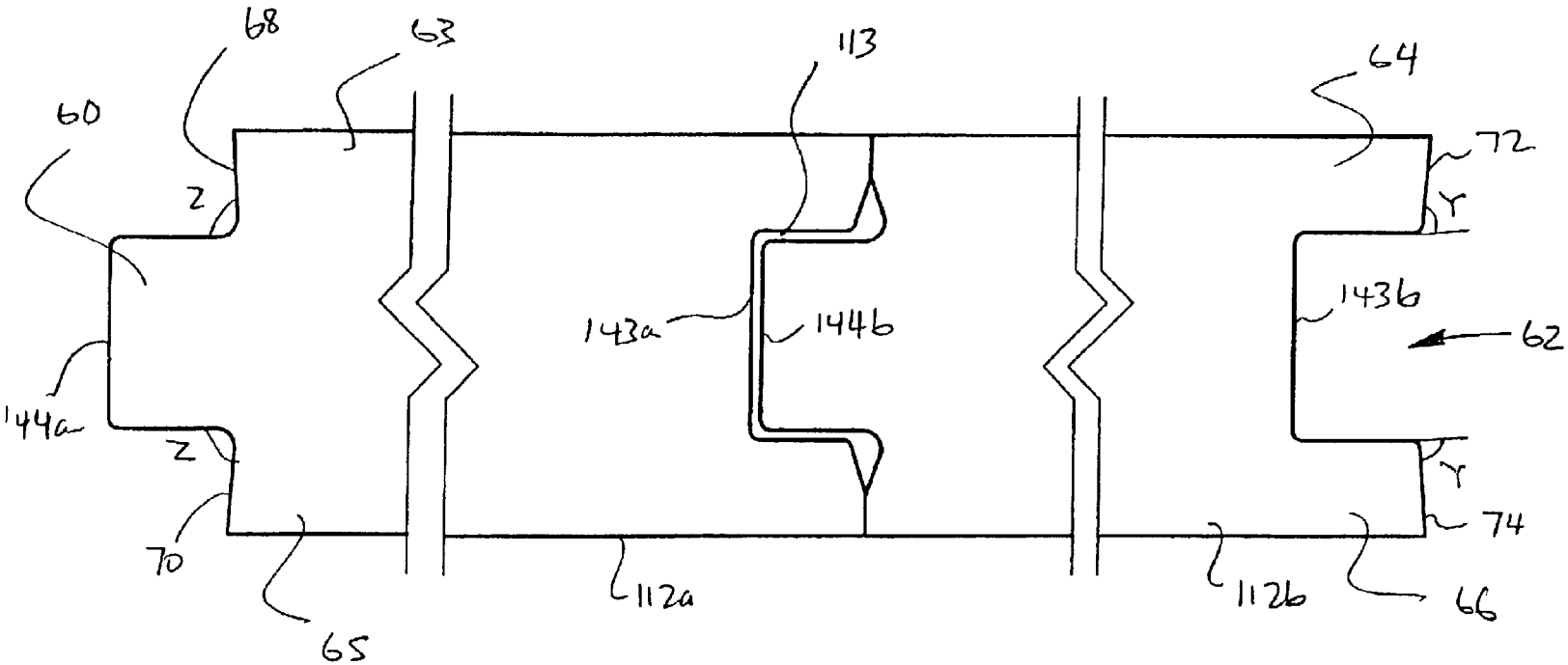
FIG. 7 is a top plan view illustrating in detail the interconnection and sealing of the joint between two adjacent panel members such as the panel illustrated in FIG. 3 when connected in the manner shown in the system illustrated in FIG. 2A and FIG. 6, FIG. 9 and FIG. 16.

With reference to FIG. 7, interconnection of two adjacent panels 112*a*, 112*b* are shown in greater detail. It will be observed that the connection is a tongue and groove connection (or male and female connection) but with some specific enhancements. Panels 112*a*, 112*b* have a vertically extending tongue portion 60 positioned between forward facing, vertically extending surfaces 68 and 70. Surfaces 68 and 70 are oriented at angle Z, which is preferably a little less than 90° to the sides of tongue 60.

Each trailing portion of the panels 112*a*, 112*b* has a vertically extending groove 62 formed between trailing flanges 64 and 66. Flange 64 has a rearward facing surface 72, which is again oriented at an angle Y of slightly less than 90°. Likewise, flange 66 has a rearward facing surface 74 that is also oriented at an angle Y of slightly less than 90°. As illustrated in FIG. 7, when two adjacent panels 112*a*, 112*b* are brought into interlocking, abutting relationship, only the outer portions of the outer surfaces 68 and 70 of panel 112*b* will physically contact with the inner facing surfaces 72 and 74 of the panel 112*a*. It will be noted that an air gap 113 is also provided at the tongue and groove connection, between tongue 60 and groove 62. The gap 113 facilitates an relatively easy interconnection of the panels, and the abutting surfaces of the outer portions provide for a seal once the adjacent panels are connected at the interfaces between the surfaces 68, 72 and 70, 74. This interconnection is possible due to the connection of the panel 112*a* and 112*b* (preferably made from foam polystyrene) with bracer 50 (FIGS. 5*a* and 5*b*) resulting in crumpling of surfaces 68 and 72, 70 and 74 in pairs when compressed together.

Figure 8:
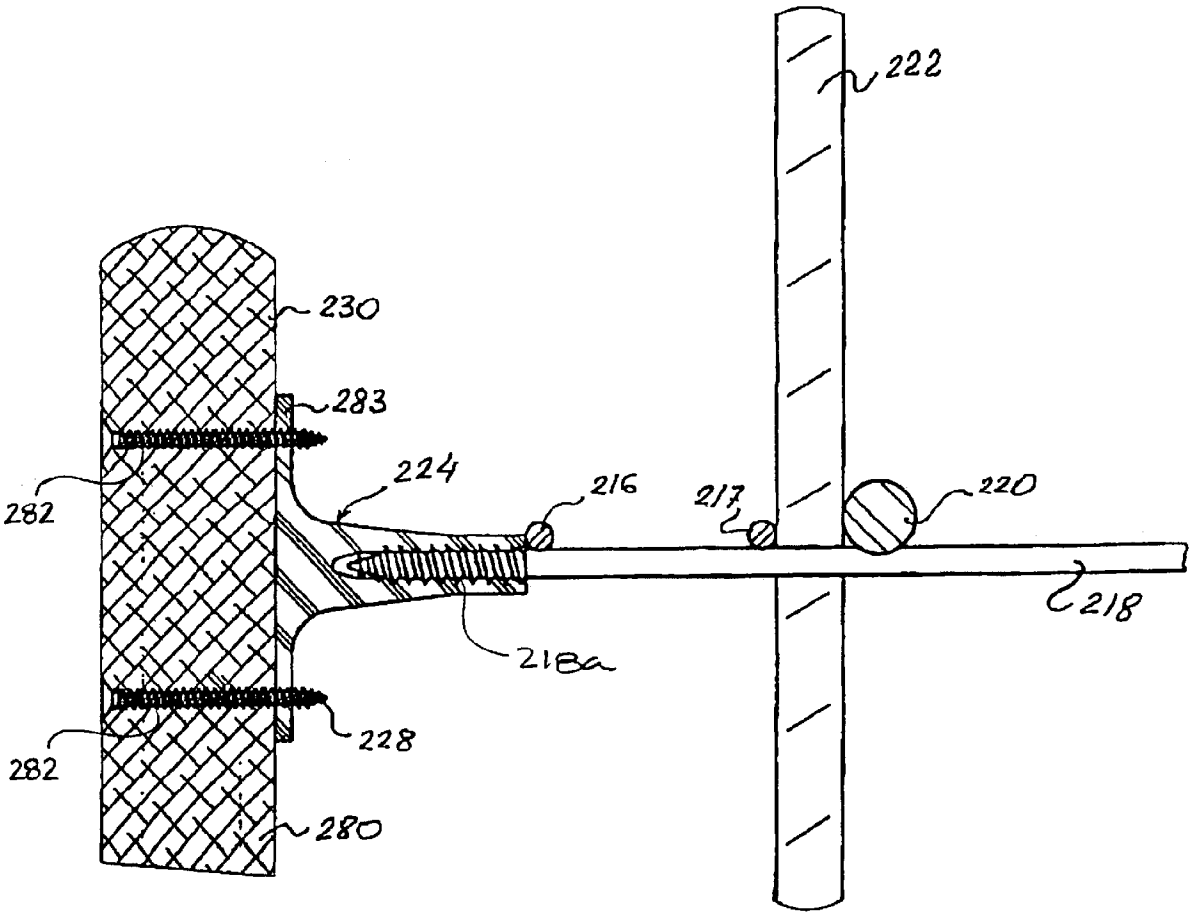
FIG. 8 is a cross sectional side elevation view similar to FIG. 2 illustrating a reinforcement system in accordance with another embodiment of the invention.

With reference now to FIG. 8 an alternative embodiment for a system for and method of reinforcing concrete is disclosed. In this embodiment, a frame assembly module comprises two longitudinal wire rods 216 and 217, and two transverse wire rods (like the previous embodiment) only one of which, wire rod 218, is shown. A retention cell 223 is formed with the transverse wire rods, rod 217 and reinforcement member 220. A vertical reinforcement member 222 is received in the retention cell 223. Like in the embodiment of FIGS. 1 and 2, wire rod 218 is received into a mushroom shaped connector 224, which is preferably like connector 24. Connector 224 is interconnected by screws 282 received through apertures 283 in connector 224 to the screw-holding board of the concrete form such as part of a plywood board 280, which would typically stay in place as a wall surface after concrete pouring and hardening.

In setting up this reinforcement system, first connector 224 is rotated clockwise around end of wire rod 218, which as before has an end 218*a* made as a machine tap. While rotating, the inner cavity of connector 224 (like connectors 924 or 24) are tapped and connector 224 moves towards rod 216 and stops when its end abuts with rod 216. Once this is done, the plywood 280 can be attached to the connector 224, by attaching screws 283 through the plywood and into connector 224. If connector 224 is made of a suitable material, such as glass fiber reinforced polypropylene the screws can be screwed directly into the connector. The position of the connector 224 ensures that the frame assembly and horizontal rebar 220 are properly positioned relative to plywood board 280.

Also, an alternative embodiment for a system for and method of reinforcing concrete is disclosed in the following way: once the concrete has been poured and has hardened, screws 282 can be removed from the plywood board 280. Connectors 224 and the plywood 280 can be removed from the concrete wall. The connectors 224 can remain in the concrete wall, or they could be removed and then the holes that remain patched. Multiple frame assembly modules would normally be provided in any actual use of this system, in a manner similar to that described above. The reinforcement system could be provided with an opposite end secured to another panel 280 in a like manner, and thus panels 280 could provide form walls by means of frame assembly module 14 comprising wire rods 216, 217 and rod 218 acting as a tie rod.

Figure 9:
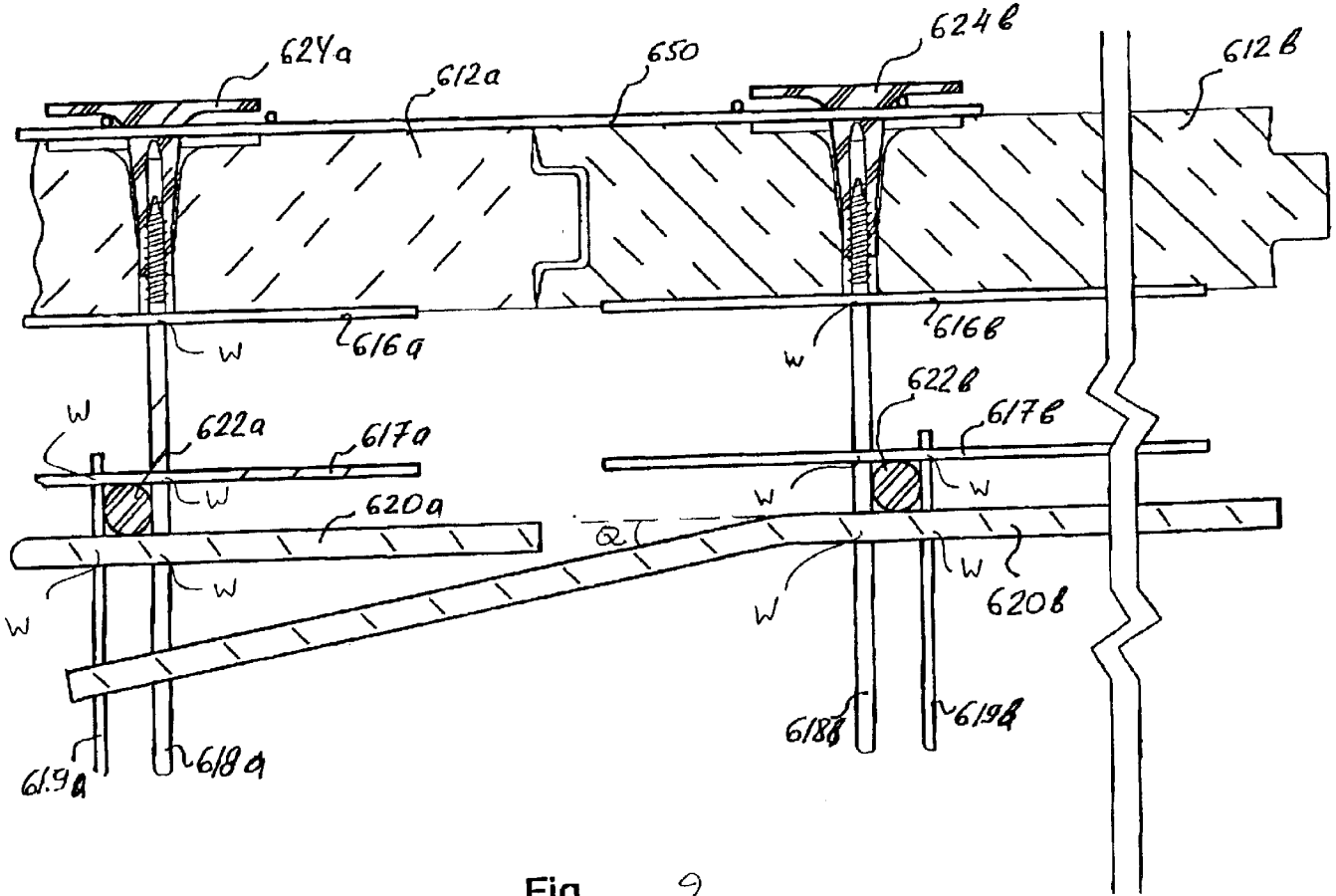
FIG. 9 is a top plan view showing an alternative interconnection between two panels employing the reinforcement system of FIGS. 1, 2 and 2A and side-by-side overlapping of longitudinal reinforcement rods when connectors of one row are inclined to angle 0–0.6 degrees.
Figure 10:
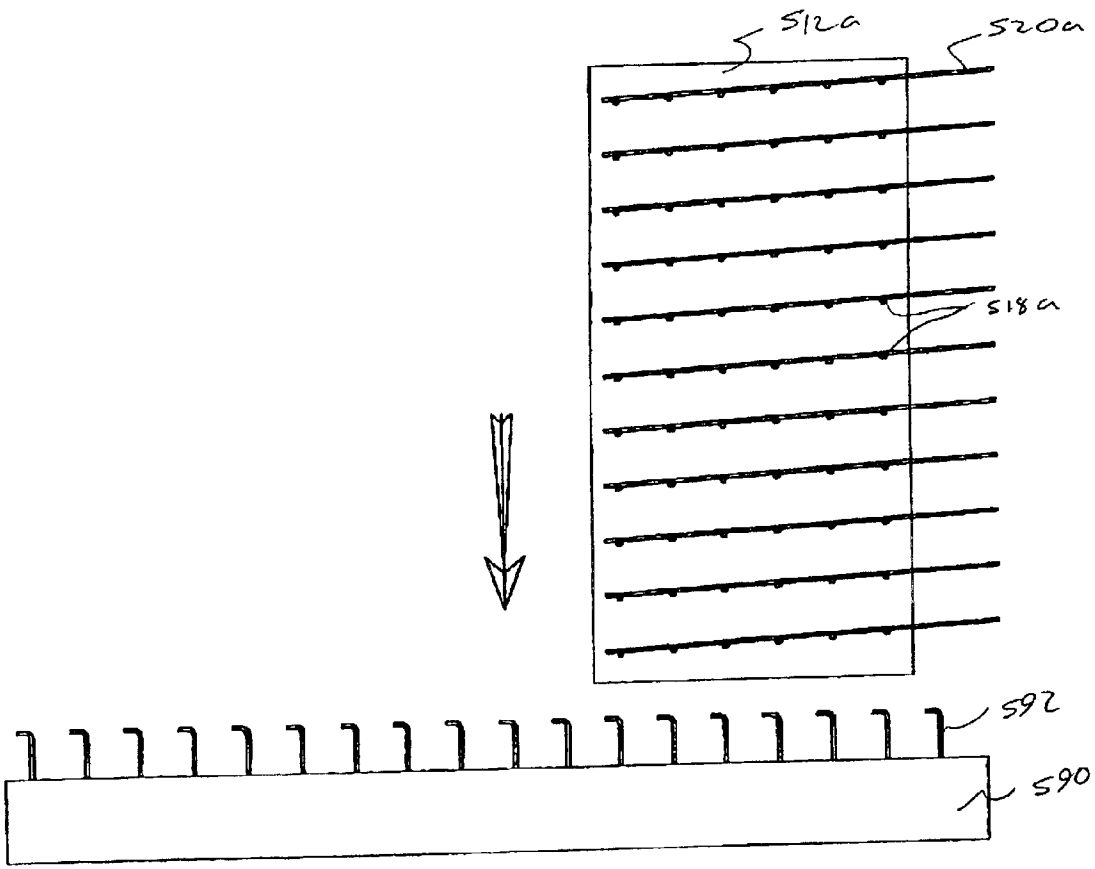
FIGS. 10, 11, 12, 12A, 12B, 12C, and 12D are front views illustrating the installation and connection of panels having reinforcement systems of FIGS. 1, 2A–2D and 3, on a footing.

As an alternate mechanism to FIG. 2A, where it shown how connectors 24 of one web layer are tilted on the angle 0.6–1 degree to horizon permitting the overlap of the ribbed bars 20, FIG. 9 illustrates how two adjacent panels 612*a* and 612*b* and their accompanying structures for reinforcement can be joined together while permitting the overlap of the horizontal re bar members 620 of the adjacent panel members, when the angle of horizontal inclination of the connectors 624 equals zero or less than 0.6 degree.

Two panels 612*a*, 612*b* are shown, each having associated therewith a connector 624*a*, 624*b*, like connectors 24. The two connectors 624 are joined by bracer 650 like bracer 50 described above. The reinforcement system associated with each panel also includes transverse wire rod members 618 and 619 and longitudinal wire rod members 616 and 617. The wire rod members 616, 617, 618 and 619 comprise a frame assembly module which in combination with horizontal rebar member 620 form the cells 623 for retaining vertical rebar member 622. As an alternate to the configuration shown in FIG. 6, when, as described above, angle of inclination of frame assembly module 14 is 0 degree and horizontal reinforcement rods 620 of the same horizontal layer of said reinforcement member and oriented substantially in the same horizontal plane, are placed at the same axis in the connected panels 612*a* and 612*b*. This permits overlapping of re bar members 620*a*, 620*b*, in the embodiment of FIG. 9, with the leading portion of each re bar member 620 being configured at an angle Q preferably of between 0 and 10 degrees which will permit re bar 620*b* from a first panel 612*b* to overlap the rebar 620*a* from the adjacent abutting panel 612*a*. Preferably the amount of longitudinal overlap will be in the range of 30–50 times the diameter of the rods 620*a*, 620*b*.

Figure 11:
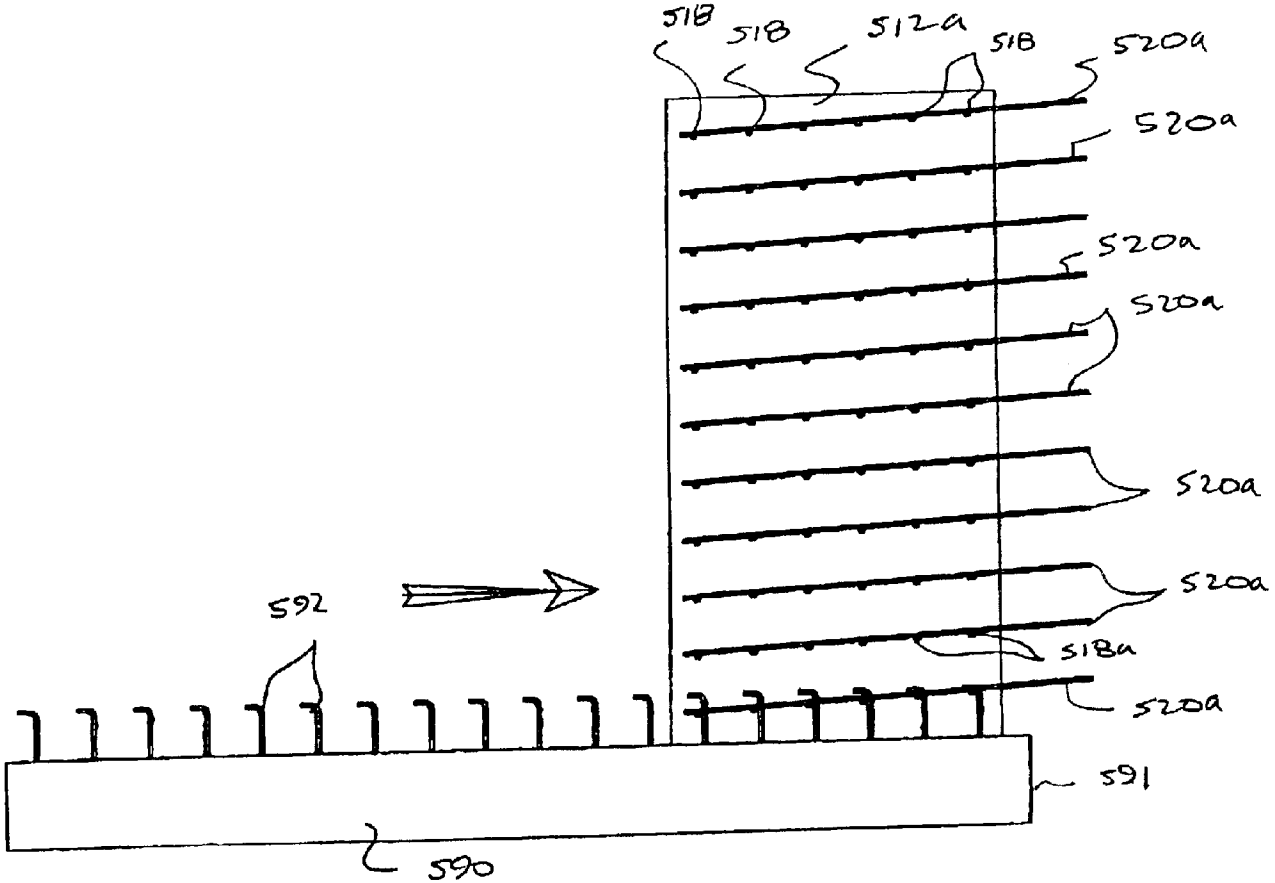

With reference now to FIGS. 10, 11, 12, 12A, 12B, 12C and 12D, illustrate a step-by-step method of installing panels 512*a*, 512*b* and 512*c* (constructed like panels 112 above) on a conventional footing 590 that has upward extending rebar members 592. Each of panels 512*a*, 512*b*, and 512*c* is constructed with the frame assembly structures including frame assembly modules like modules 14, and rebar members 520*a–c*, cantilevered from their respective panels, as described above. First, as illustrated in FIG. 11, panel 512*a* is lowered onto footing 590 and pushed toward front end 590*a*. Panel 512*a* has its rebar members 520 sloped upward, toward front end 590*a* of footing 590 (as do the other panels 512*b* and 512*c*) (the amount of slope is exaggerated in these Figures for clarity). It will be noted that the transverse rods 18 will fit between upstanding spaced rebar members 592. When pushed forward to the position shown in FIG. 11, the rods 18 will abut rear sides of rebar members 592.

Figure 12:
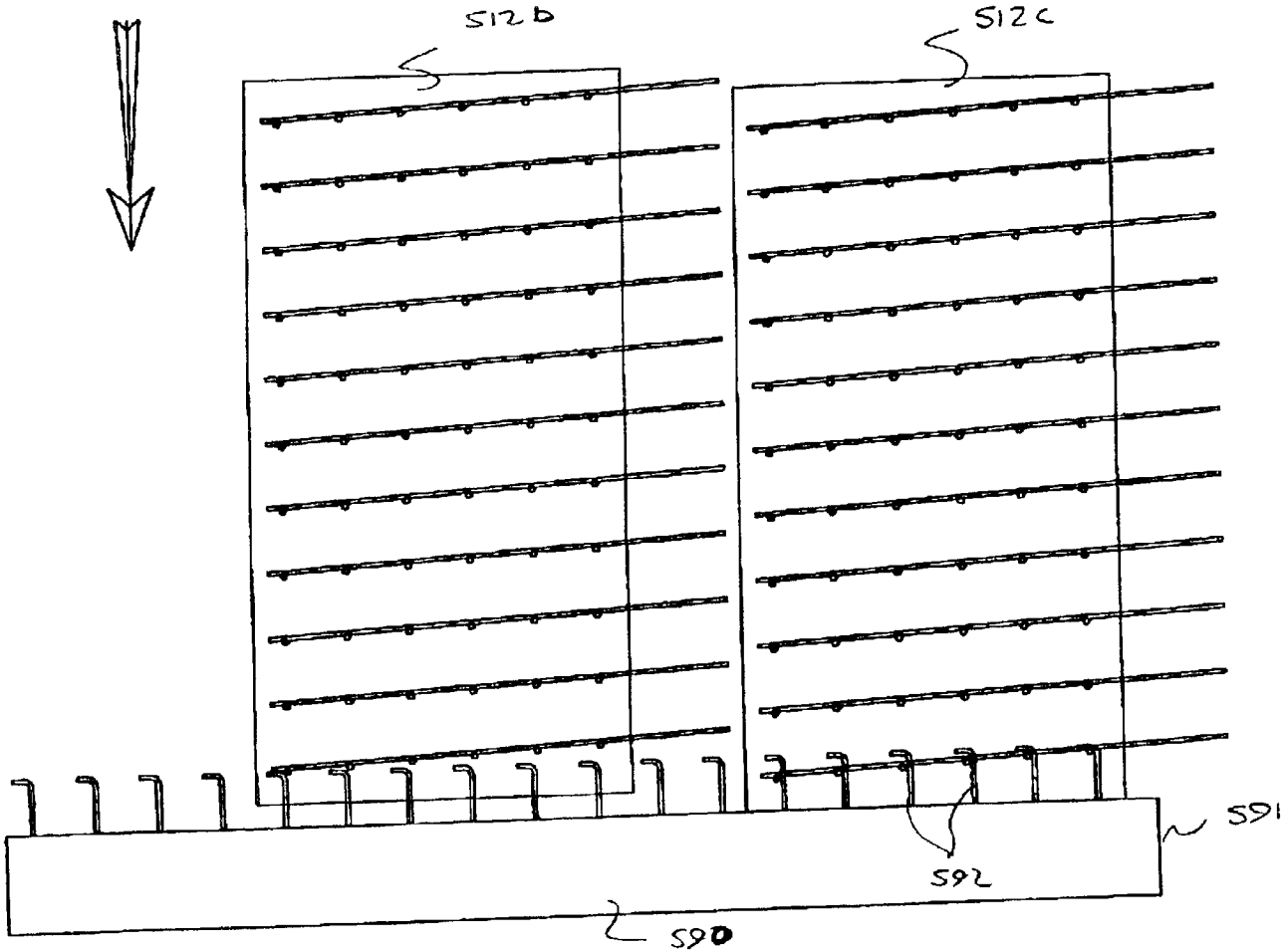
Figure 12A:
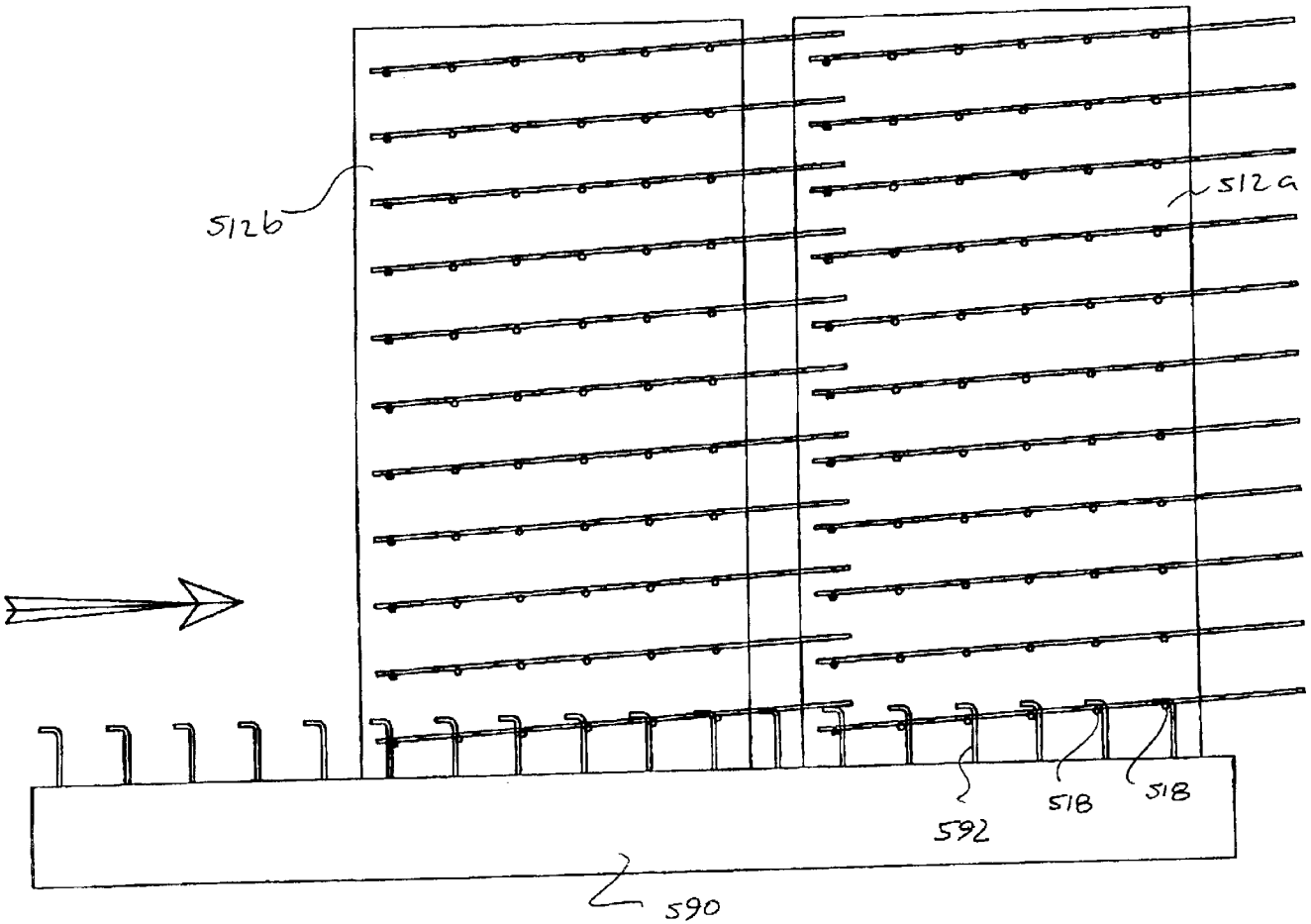

As shown in FIGS. 12 and 12A, a second panel 512*b* is then lowered onto footing 590 behind panel 512*a* and then moved horizontally forward toward panel 512*a*. This causes leading portions of rebar members 520*b* of panel 512*b* to overlap above the trailing ends of rebar members 520*a* of panels 512*a*. Panel 512*b* is brought into close proximity to panel 512*a*. Likewise a panel 512*c* is lowered onto footing 590 and brought into a similar position in relation to panel 512*b* and rebar members 592, as shown in FIG. 12B.

Figure 12B:
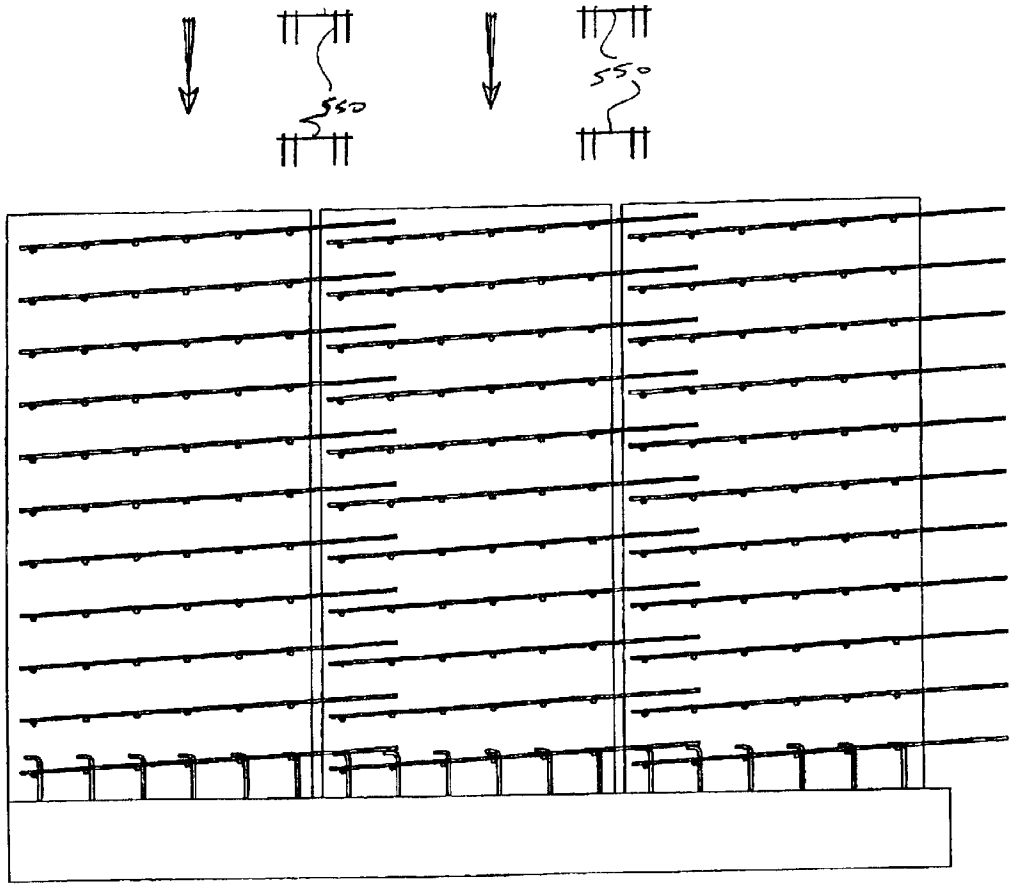
Figure 12C:
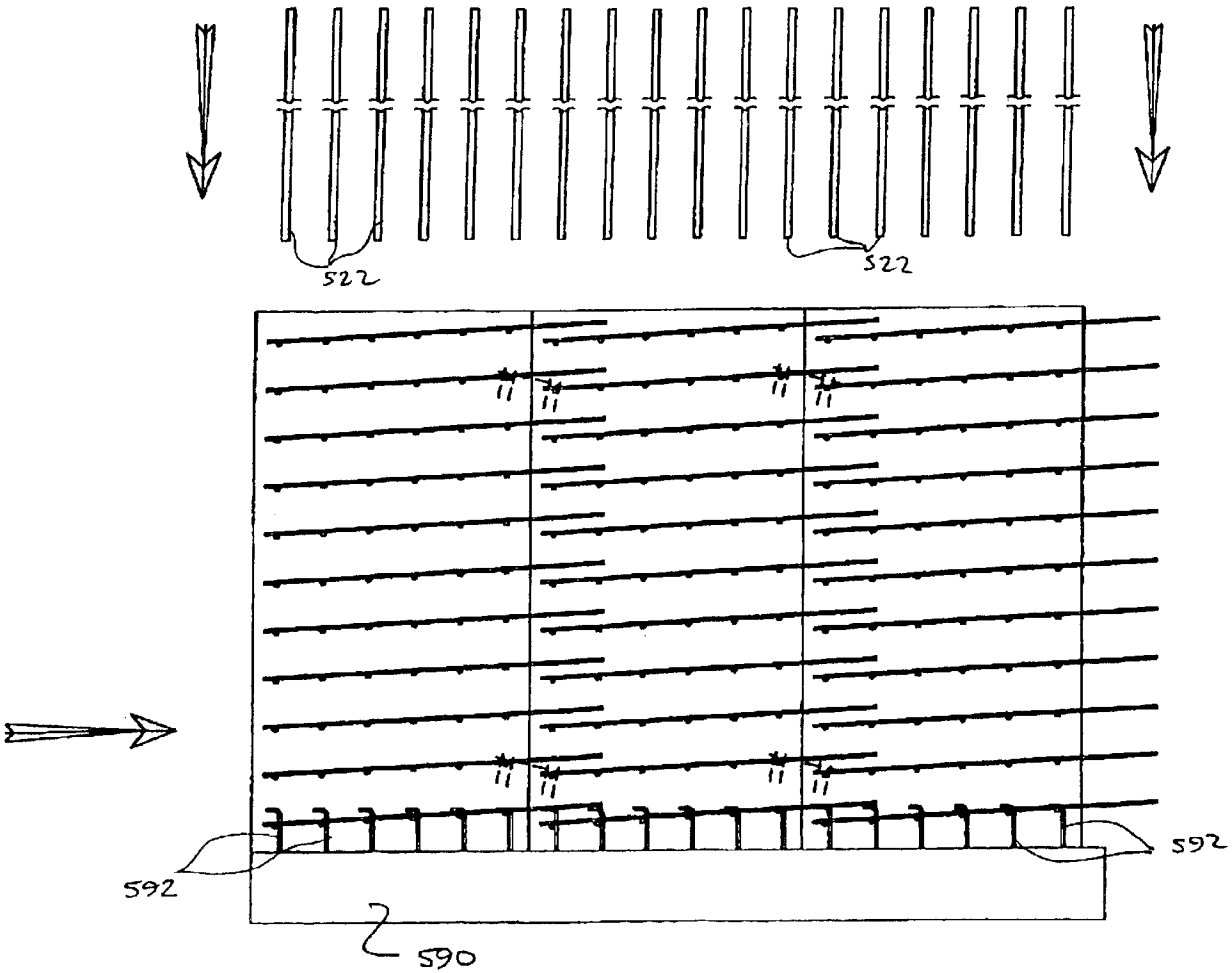

Thereafter, as shown in FIGS. 12B and 12C, bracers 550 (like bracers 50 above) are utilized to interconnect panel 512*b* to panel 512*a*, and panel 512*c* to panel 512*b* in the manner described above. FIGS. 12B and 12C illustrate only the idea of the method and rods 18 and the precise positioning of extended rods 592 relative to the panels 512*a–c* is not accurately shown. Rods 592 are positioned in such a way, that they don't prevent movement of panels 512*b* towards 512*a*, and 512*c* towards 512*b*.

Figure 12D:
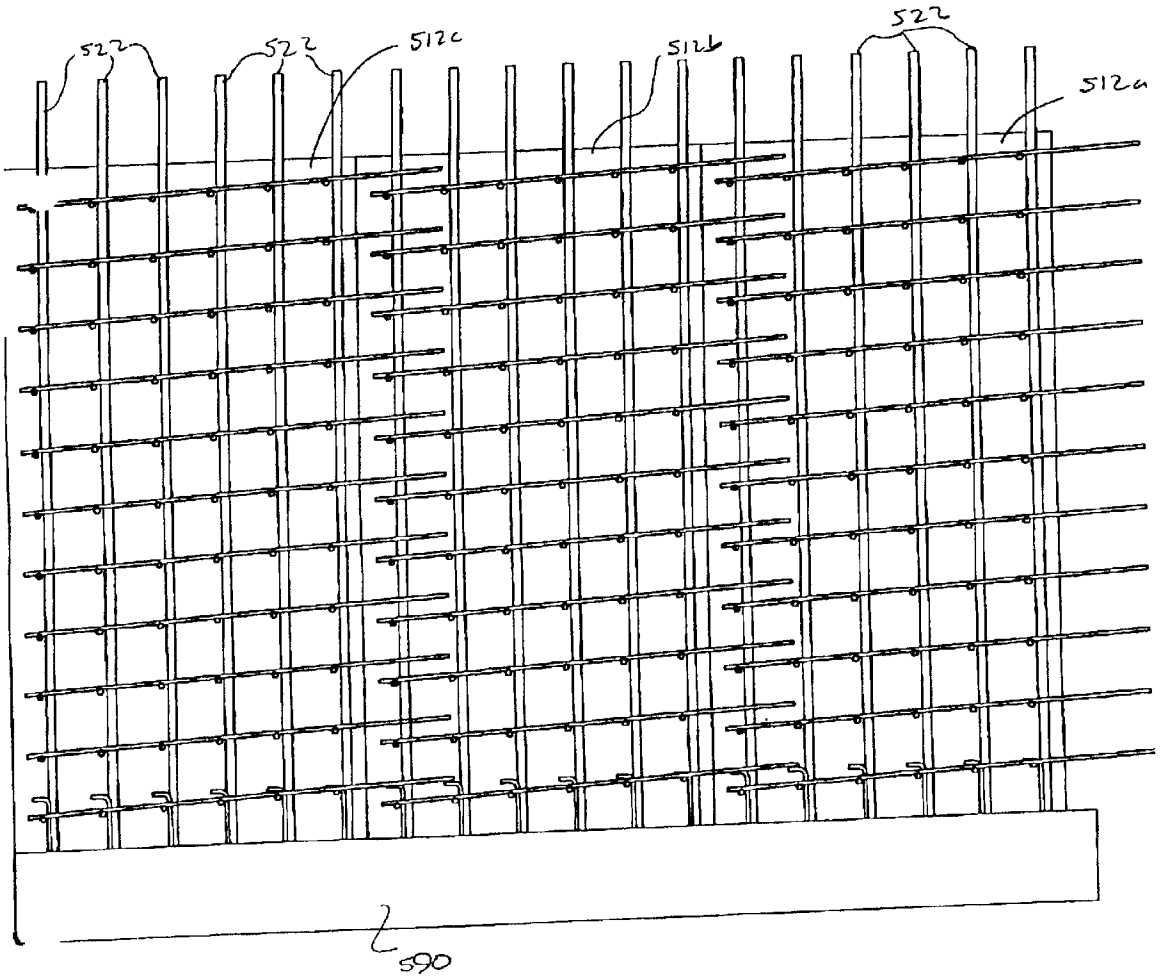

Finally, as illustrated in FIGS. 12C and 12D, vertical reinforcement members 522 can be inserted in the retention cells that are formed as described above, and rest on the footing 590. Vertical rebar members 522 extend above the top of the panels 512*a–c* in this embodiment, for possible interconnection to another concrete structure.

Figure 13A:
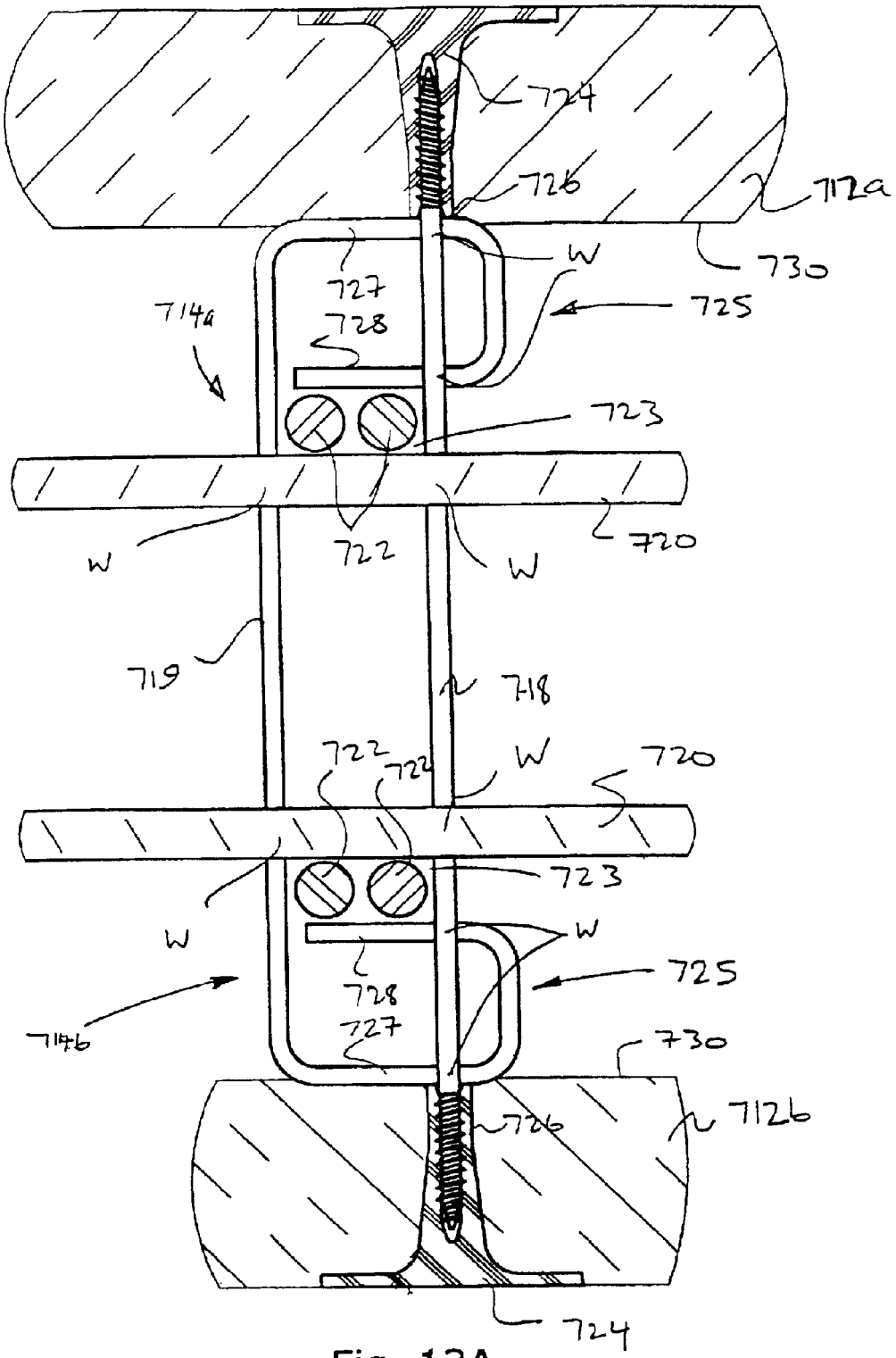
FIG. 13*a* is an enlarged plan view of part of a reinforcement system in accordance with another embodiment of the invention with the reinforcement system being used as formwork.
Figure 14A:
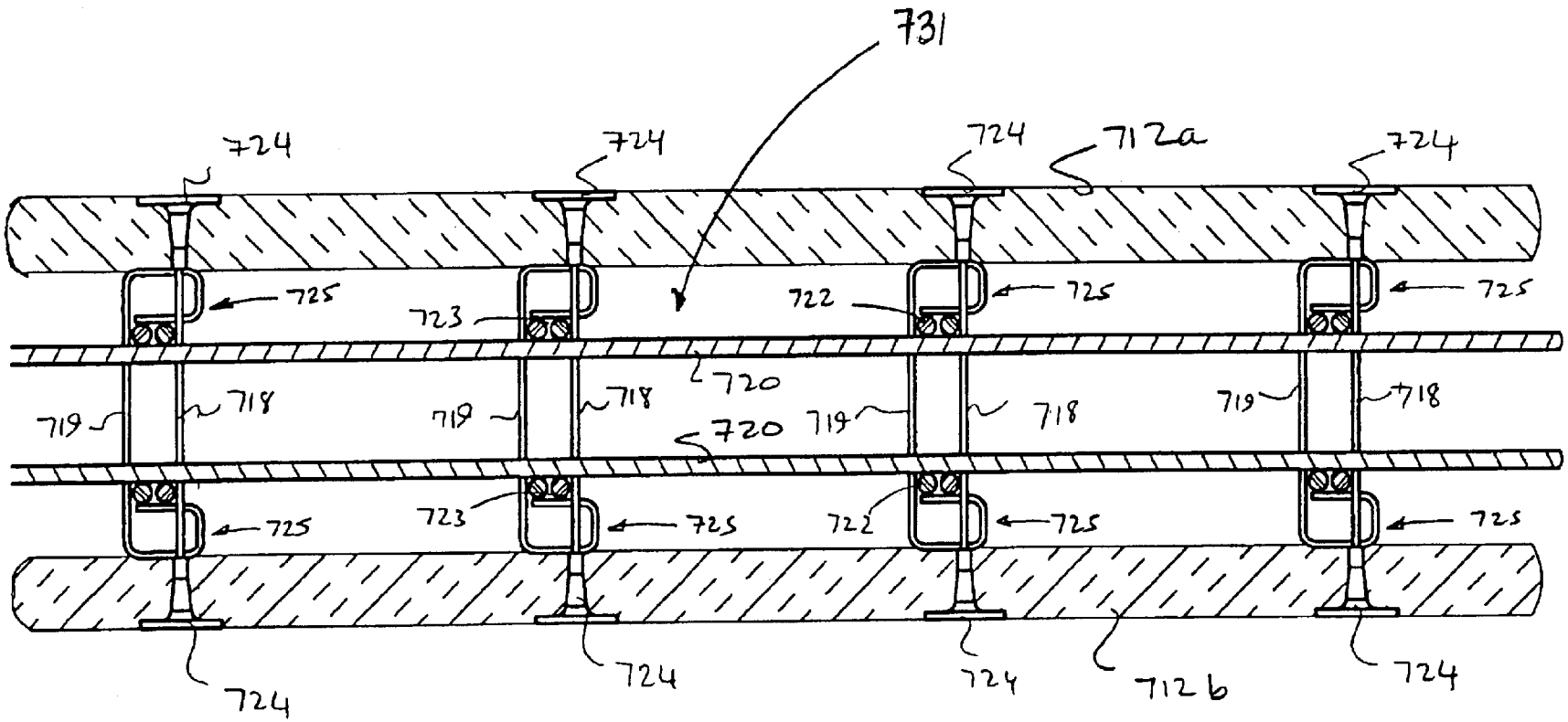
FIG. 14*a* is a plan view of reinforcement system of FIG. 13*a* with the reinforcement system being used as formwork.

With reference now to FIGS. 13A and 14A, another embodiment is shown in which a form space 731 is created between two panels 712*a* and 712*b*. The frame assembly modules 714*a* and 714*b* share wire rods 718 and are formed in a manner similar to frame assembly module 14 with wire rods 18. Frame assembly modules 714 are held between panels 712 by connectors 724 (which are like connectors 24). In this embodiment, each pair of frame assembly modules 714*a* and 714*b* is completed with rod member 719. Rod 719 has a looped portion 725 at each end thereof. Each loop portion 725 first abuts a panel 712*a*, 712*b*, and an end of the leg portion of connector 724 and then twice crosses the rod 718. Each loop portion 725 is welded at the points of crossing with rod 718 by spot welding and then ends with a portion 728 that is positioned opposite, but spaced apart from, horizontal rebar members 720. The end 728 of each loop portion 725 co-operates with rod 718, rebar 720 and part of the straight portion of itself rod 719 to provide a retention cell 723. Accordingly, a series of retention cells 723 are formed which have openings each for receiving at least one, and in this embodiment two, vertical bar members 722.

Each frame assembly module 714 is joined to, preferably by spot welding, and supports, a reinforcement bar 720. There are joins W of rebar 720 to both rod 718 and 719, as shown in FIG. 13A. A portion 727 of loop 725 is in abutting relationship with the inner surface 730 of a panel 712. Since connectors 724 can be tightened on rods 718, portion 727 can be pushed into panels 712*a* and 712*b* a little, as the expanded polystyrene can be partly compressed and deformed until the ends of the legs of connectors 724 are in abutment with portion 727 of loop 725. Thus, an indentation in the panel can be formed which by virtue of the interaction of connector 24, panel 12 and portion 727, will assist in supporting and stabilizing both frame assemblies and reinforcement bars 720. The portion 727 also serves as a stopping element to prevent the over rotation of connector 724, like that discussed previously.

As illustrated in FIG. 14A, a plurality of pairs of opposed frame assembly modules 714 are associated with a pair of rebar member members 720 to provide pairs of longitudinally spaced retention cells 723. Each longitudinally spaced frame assembly module pair also serves as a tie member and in this way panels 712*a* and 712*b* also provide form walls that generally don't need to be independently supported in a transverse direction.

Figure 13B:
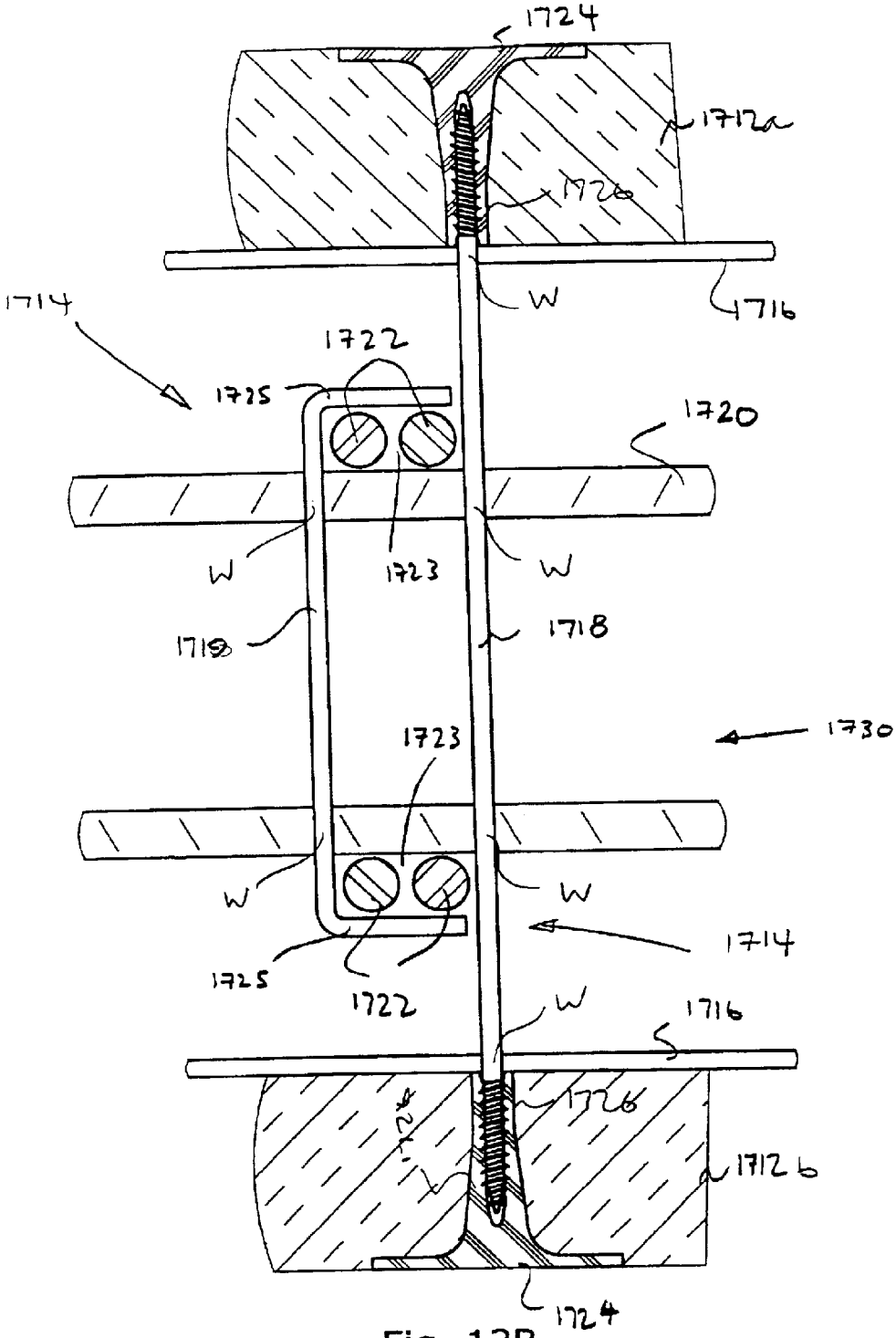
FIG. 13*b* is an enlarged plan view of part of a reinforcement system in accordance with another embodiment of the invention which is similar to the embodiment in FIG. 13A, with the reinforcement system being used as formwork.

With reference now to FIG. 13B, another embodiment is shown in which a form space 1730 is created between two panels 1712*a* and 1712*b*. The frame assembly module has wire rods 1716 and 1718 formed in a manner similar to frame assembly modules 14 and particularly 714 with wire rods 1716,1718 and 1719 and with welds W. Frame assembly modules 1714 are held between panels 1712*a* and 1712*b* by connectors 1724. In this embodiment, each frame assembly module 1714 is completed with rod member 1719. Rod 1719 has a bent portion 1725 at each end thereof and spaced apart from, horizontal rebar members 1720. Rod 1718, rebar members 1720 and a part of the straight portion of rod 1719 and bent portion 1725 cooperate to provide a retention cell 1723. Accordingly, a series of retention cells 1723 are formed which have openings each for receiving at least one of vertical rebar members 1722. While connecting the connector 1724 with the rod 1718, wire rod 1716 of frame assembly module 1714 is indented into the panel 1712 made from expanded or extruded polystyrene. The interaction of the end of leg portion 1726, will assist in supporting and stabilizing both frame assemblies and reinforcement bars 1720. Also, rod 1716, acts as a stopping element for connector 1724.

Figure 14B:
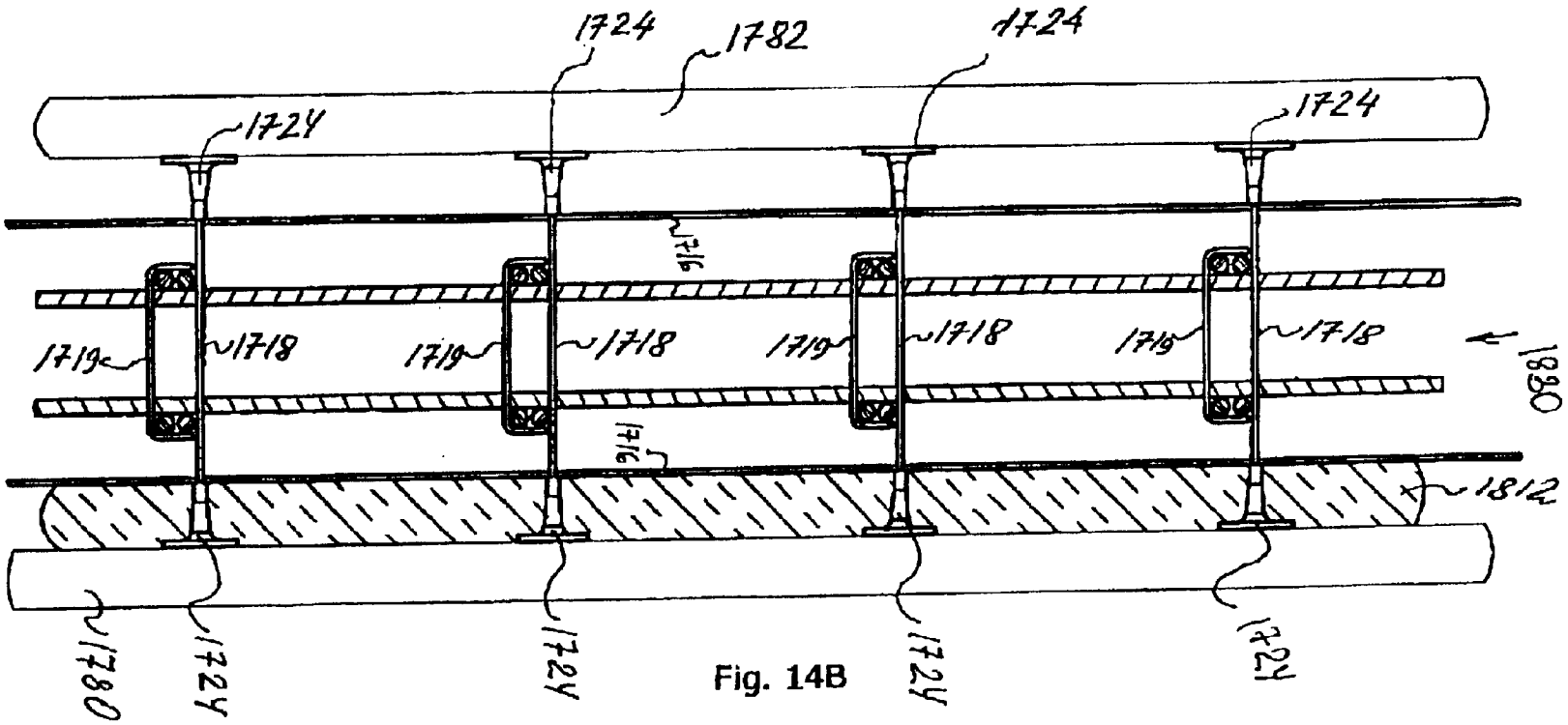
FIG. 14*b* is a plan view of a variation in the implementation of the reinforcement system similar to the reinforcement system in FIG. 14*a* with the reinforcement system being used in a conventional formwork.

In FIG. 14B, the general configuration of FIG. 13B is combined with separate, conventional form walls 1780 and 1782 to provide the structural stability for the form, but with only one panel 1812. The frame assembly structure, including single panel 1812, is for holding the reinforcement in a proper position in the form space 1830. In this embodiment, connectors 1724 facing form wall 1782 can be secured thereto, such as by for example the manner illustrated in FIG. 8 above.

Figure 15:
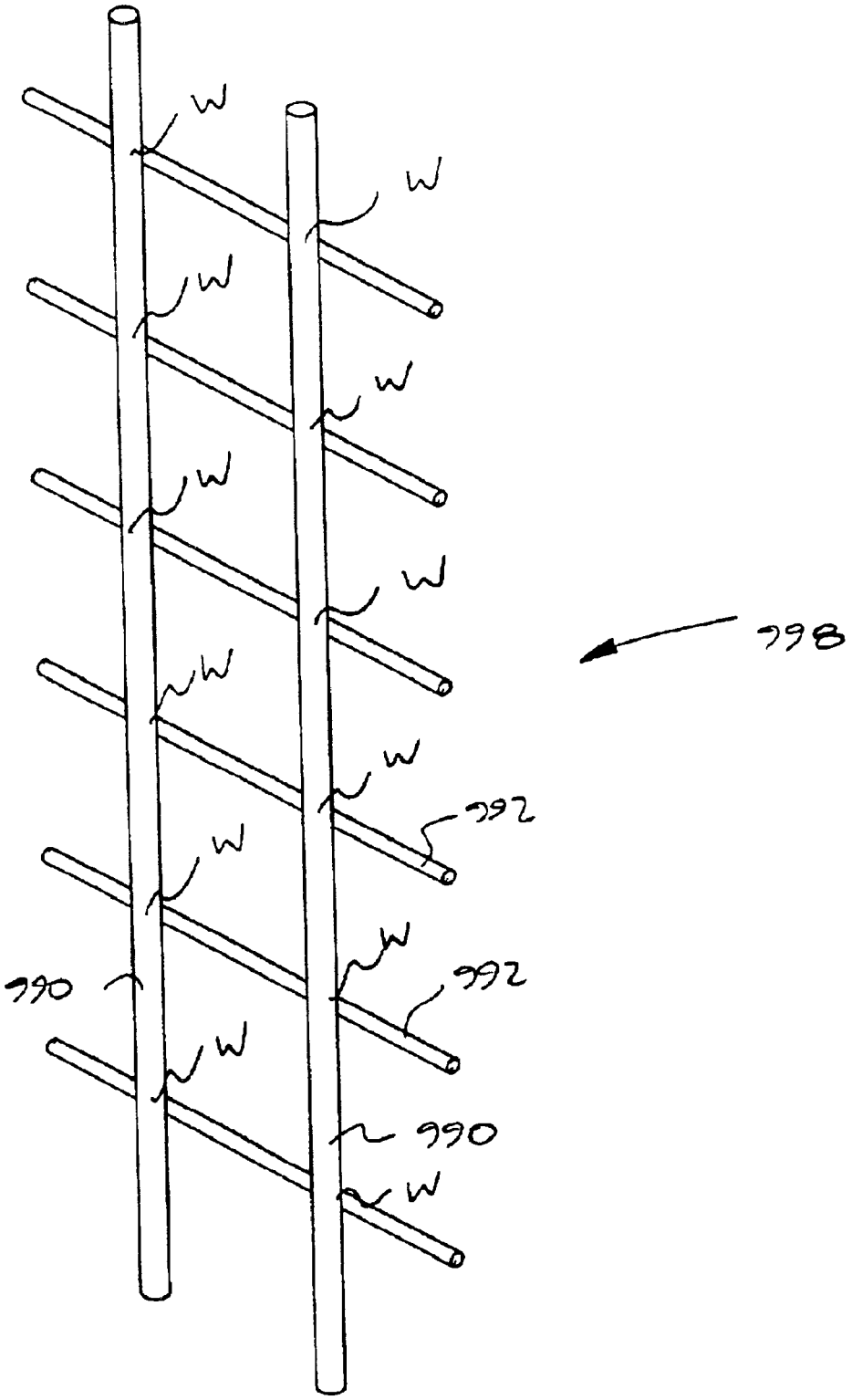
FIG. 15 is a perspective view of a reinforcement component used to build a concrete structure reinforcement system in connecting two panel units having reinforcement in accordance with an embodiment of the invention.
Figure 16:
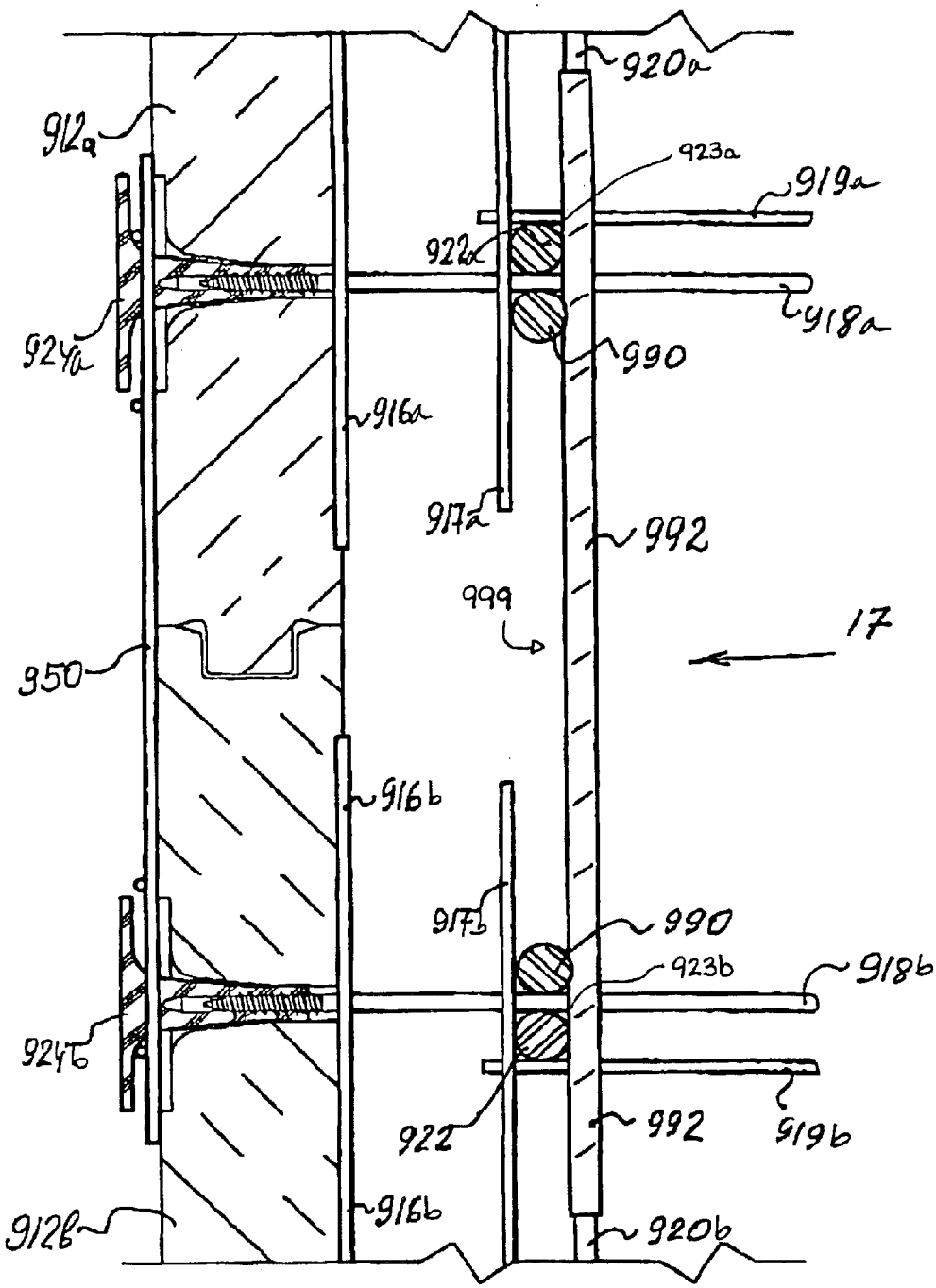
FIG. 16 is a top plan view of connected panels in accordance with another embodiment of the invention and employing the reinforcement component of FIG. 15 and a panel bracer of FIG. 5B with overlapping of longitudinal reinforcement rod of the reinforcement component above the longitudinal reinforcement rods of adjacent connected panels.
Figure 17:
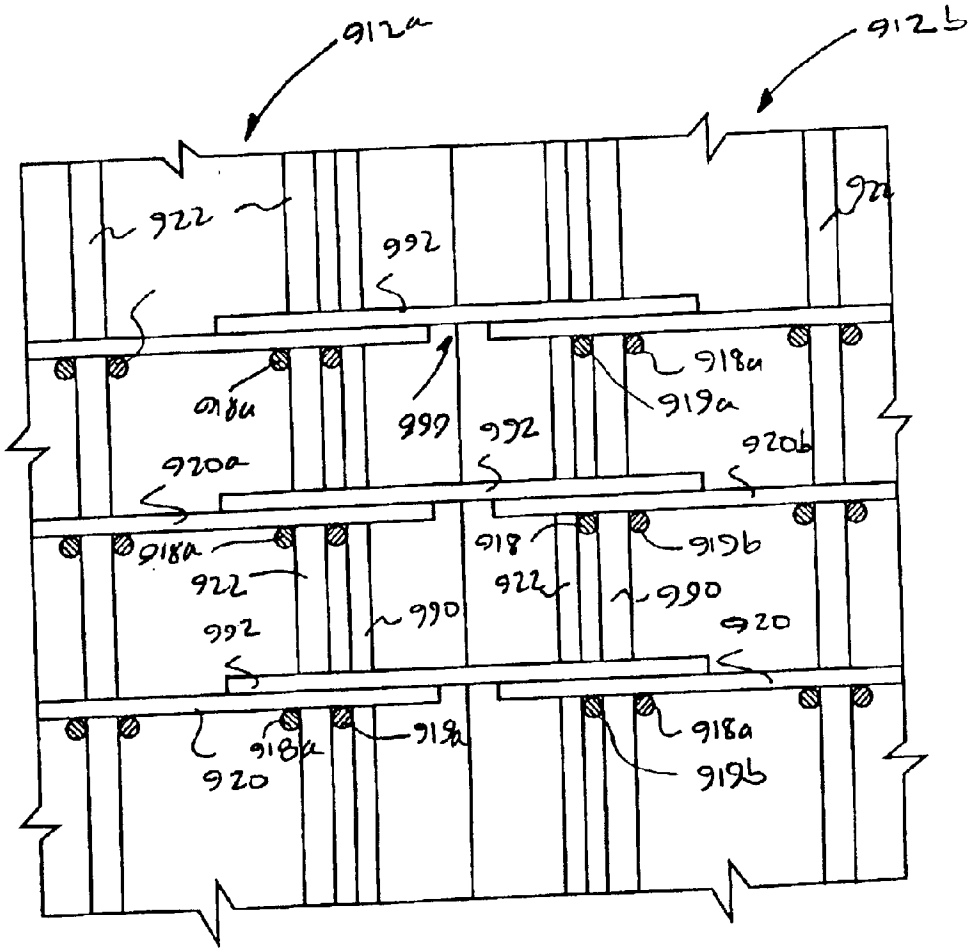
FIG. 17 is a front view at 17 in FIG. 16.

With reference now to FIGS. 15, 16 and 17 an alternate device and method of ensuring proper overlap of longitudinal rebar between rebar members 920 associated with adjacent, connected panels 912*a*, 912*b* is shown. Generally the configuration in FIG. 16 is the same as the configuration in FIG. 2A above, although reinforcement members 920*a* and 920*b* do not overlap each other. Two panels 912*a*, 912*b* (like panels 112) are connected using a bracer 950 (like bracer 50), which interconnects connectors 924. Each panel has a frame assembly module comprising transverse rods 918*a*, 918*b* and 919*a*, 919*b* respectively that co-operate with rods 917*a*, 917*b* and rebar 920*a*, 920*b* to form a retention cell 923*a*, 923*b* for vertical rebar 922, in the same manner described above. It should be noted, however, that rebar 920*a*, 920*b* of each panel 912*a*, 912*b* does not extend beyond the edge of its associated panel. Thus, a gap 999 is provided between the rebar 920*a*, 920*b* of two adjacent panels 912*a*, 912*b*.

A rebar connector member 998 has a pair of spaced vertical rebar members 990 and a plurality of longitudinal, spaced rebar members 992. As shown, member 998 is positioned between the vertically stacked, end retention cells 923*a*, 923*b* of the two adjacent panels 912*a*, 912*b*. In particular, a longitudinal member 992 will overlap and bridge the gap 222 between the two adjacent longitudinal rebar members 920*a*, 920*b* in each web layer. Vertical rebar members 920*a*, 920*b* are held in slots 997 between, rebar members 920*a*, 920*b* and 992, and rods 917. Although not necessary, member 998 can be secured in place by appropriate bonding or other joining to members 920*a*, 920*b* and/or rods 917*a*, 917*b*.

Figure 18:
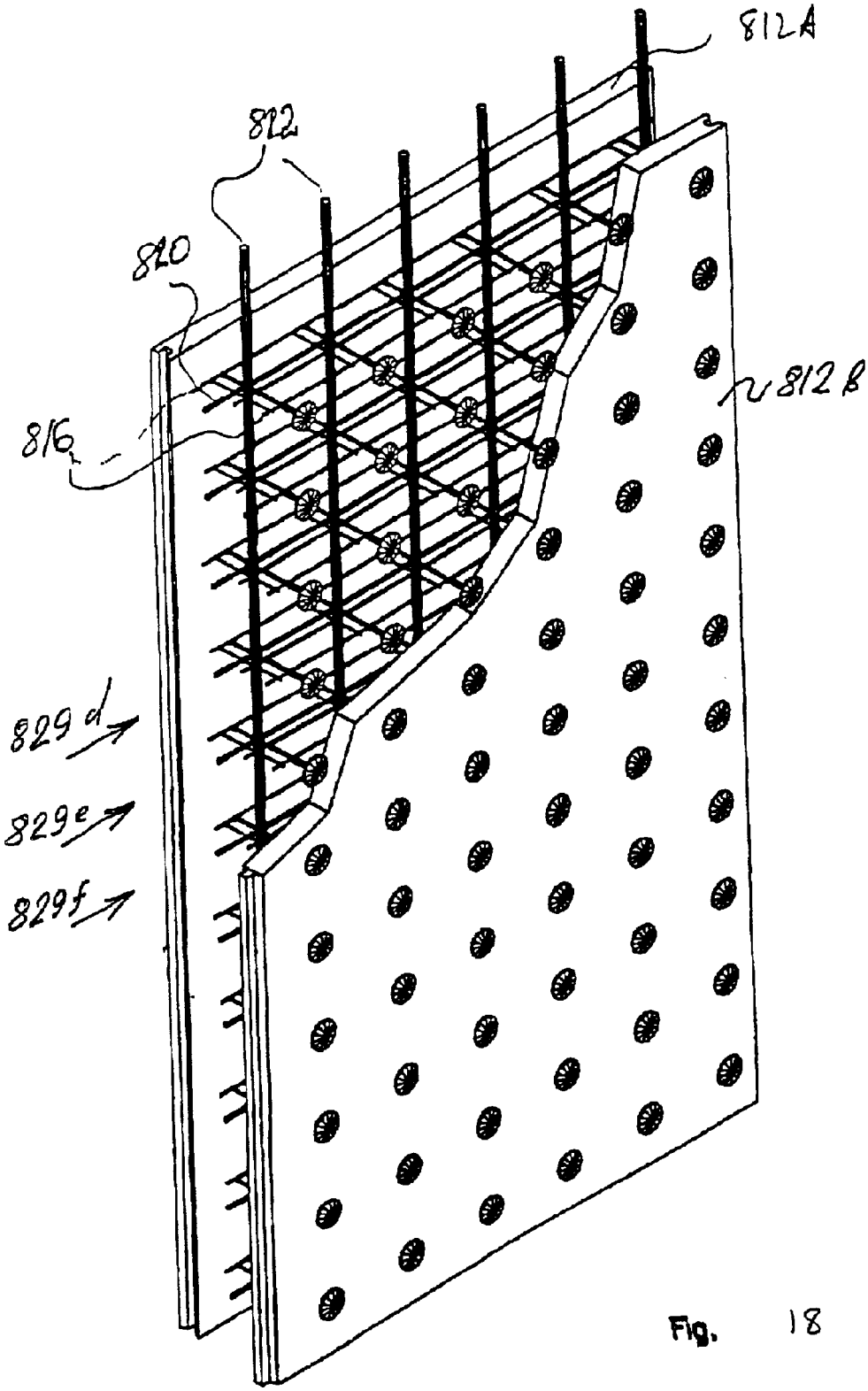
FIG. 18 is a perspective view, partially broken away, of the reinforcement system, a portion of which is shown in FIG. 2, with panels having butt-ends like those shown in FIG. 7.

FIG. 18, which is similar to FIGS. 2B and 2C, shows another embodiment, where each layer 829*d–f* has a frame assembly module that has a rod 816 abutting each inside surface of panels 812*a* and 812*b* and with only one rebar member 820 and a rod 818 forms retention cells 823 that are transversely only one deep. Additionally, the panels 112 are connected in end abutting relation such as is illustrated above in FIGS. 7 and 16.

Figure 19:
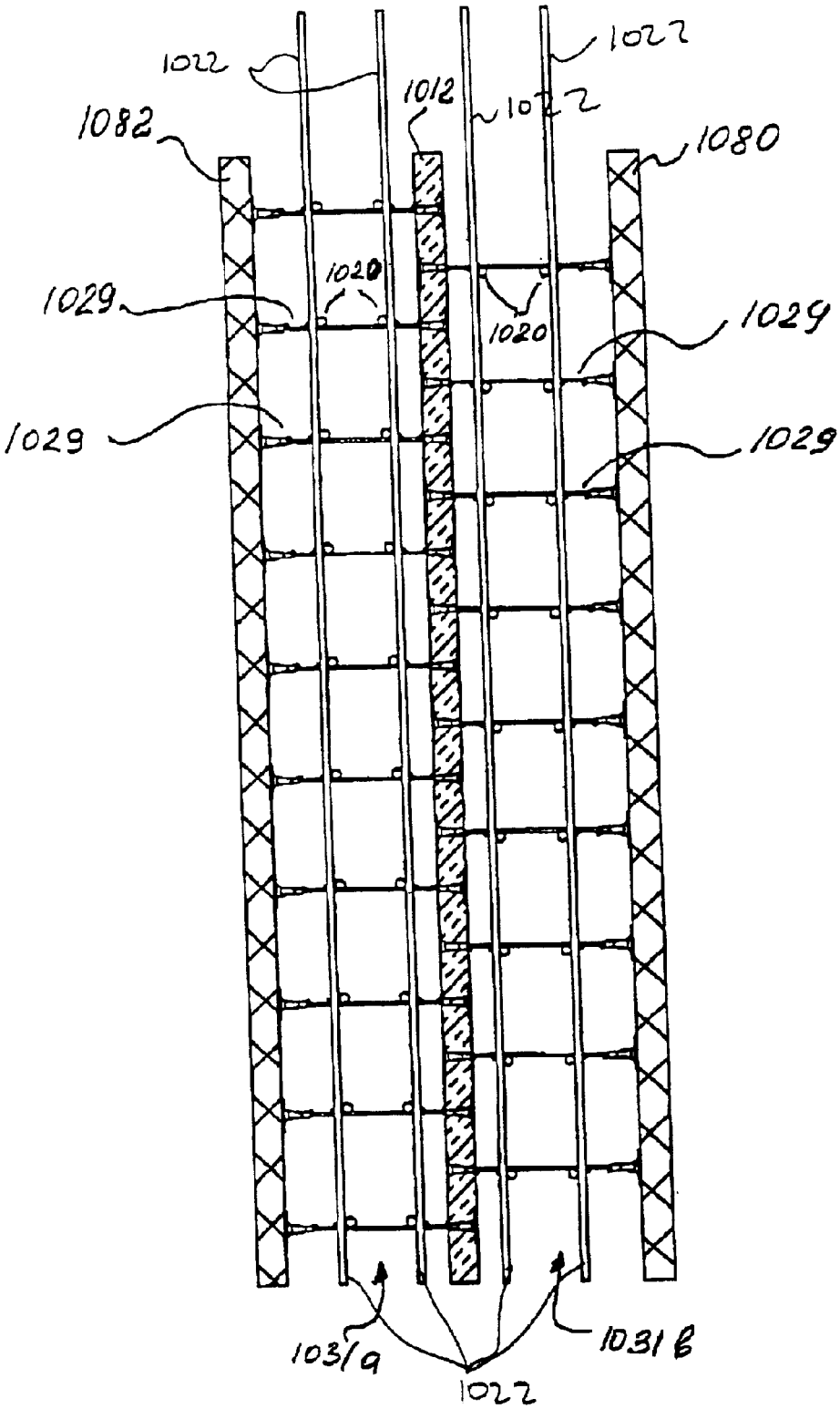
FIG. 19 is a side elevation view of a reinforcement system used in a conventional formwork system in accordance with another embodiment of the invention.

Finally, FIG. 19 shows how a panel 1012 (like panel 12 above) can be provided with reinforcement as described above, on both sides surfaces, with each side having web layers 1029 that include frame assembly modules and longitudinal rebar 1020, and vertical reinforcement bars 1022, as described above. Two form spaces 1031*a*, 1031*b* can thus be provided on each side of panel 1012, between two conventional form walls 1082 and 1080. Like other illustrations herein, for simplicity, in this drawing the bottom of the wall nor the ends are not shown to be closed, but it will of course be appreciated that the form spaces must be blocked in a manner that the unhardened concrete can be retained. In the embodiment shown in FIG. 19, two concrete walls can be created having an insulating panel between them. This has particular use in creating dividing walls between for example two semi-detached buildings or rooms.

I claim:

1. A system for reinforcing a concrete structural member comprising:

a) a panel oriented generally longitudinally;

b) at least one frame assembly module comprising:

first and second spaced, rod members oriented generally transversely to said panel, only one of said first and second rod members extending to said panel and being mounted thereto;

a third rod member oriented generally longitudinally, said first, second and third rod members being supported at least in part by said one rod member mounted to said panel, and said first, second and third rod members being joined together to form said frame assembly module;

c) a longitudinal reinforcement member extending generally longitudinally, crossing said first and second rod members, being generally spaced from said third rod member and said panel, and joined to at least one of said first and second rod members;

said frame assembly module and said longitudinal reinforcement member co-operating to define a retention cell having a generally vertically oriented opening for receiving a vertical reinforcement member, said first, second and third rod members and said longitudinal reinforcement member of said retention cell, configured to retain said vertical reinforcement member in a substantially vertical orientation.

2. A reinforcement system as claimed in claim 1 further comprising a fourth rod member oriented generally longitudinally, and wherein said third rod member is spaced apart from said panel, said fourth rod member being positioned in abutment with an interior surface of said panel.

3. A reinforcement system as claimed in claim 2 wherein said first, second, third and fourth rod members and said longitudinal reinforcement member are rigidly interconnected to provide a rigid frame structure.

4. A reinforcement system as claimed in claim 2 wherein said third rod member and said fourth rod members cross and are joined to both said first and second rod members and said first and second rod members, and the third and fourth rod member are oriented substantially in parallel transverse and longitudinally oriented planes.

5. A system as claimed in claim 2 further comprising a connector adapted to engage said one transverse rod member of said frame assembly module to mount said frame assembly module and said longitudinal reinforcement member to said panel and wherein said connector has a portion positioned proximate an outer surface of said panel and said portion of said connector and said fourth rod member compress a portion of said panel therebetween to provide a stiff connection between said frame assembly module and said panel.

6. A reinforcement system as claimed in claim 2 further comprising:

a plurality of said frame assembly modules, each of said frame assembly modules being spaced longitudinally from one or more other frame assembly modules of said plurality of frame assembly modules; and said third and fourth rod members of each of said plurality of modules comprising a continuous, common member extending through said plurality of frame assembly modules;

said longitudinal reinforcement member of each said plurality of modules also comprising a continuous, common member extending through said plurality of frame assembly modules to define with said plurality of frame assembly modules a plurality of longitudinally spaced retention cells providing a plurality of vertically oriented openings, each of said vertically oriented openings for receiving a vertically oriented reinforcement member.

7. A system as claimed in claim 6 wherein more than one of said vertically oriented openings receives a generally vertically oriented reinforcement member.

8. A system as claimed in claim 7 wherein each of said longitudinal reinforcement member and said common third and fourth rod members, and said first and second rod members of said plurality of frame assembly modules are rigidly interconnected to provide a rigid frame structure having a plurality of retention cells.

9. A reinforcement system as claimed in claim 2 wherein said panel member has a bottom face extending generally longitudinally, and said longitudinally oriented third and fourth rod members and said longitudinal reinforcement member are oriented at an angle relative to said bottom face of said panel member.

10. A reinforcement system claimed in claim 9 wherein said angle is between 0 and approximately 1 degree.

11. A reinforcement system as claimed in claim 2 comprising a first and a second web layer, each said first and second web layers comprising a plurality of said frame assembly modules, each of said frame assembly modules being spaced longitudinally from other said frame assembly modules in each said web layer, and said third and fourth rod members of each of said plurality of modules being a continuous, common member extending through said plurality of frame assembly modules, each of said first and web second layers having a longitudinal reinforcement member of each said plurality of modules that is a continuous, common member extending through said plurality of frame assembly modules of each said layer, to define with said plurality of frame assembly modules a plurality of longitudinally spaced retention cells providing a plurality of vertically oriented openings, each of said vertically oriented openings for receiving a vertically oriented reinforcement member, and said vertical openings of said first layer being vertically aligned with a vertical opening in said second layer.

12. A system as claimed in claim 11 wherein said web layers are oriented generally horizontal and generally parallel to the ground.

13. A system as claimed in claim 11 wherein each of said retention cells holds a vertical reinforcement member.

14. A reinforcement system as claimed in claim 11 wherein said frame assembly modules of each of said first and second web layer each comprise at least one additional generally longitudinally oriented rod member spaced from said reinforcement member, providing an additional row of longitudinally spaced plurality of retention cells, such that said systems provides a plurality of longitudinally and transversely spaced retention cells providing a plurality of longitudinally and transversely spaced vertically oriented openings.

15. A reinforcement system as claimed in claim 14 wherein said frame assembly modules of each of said first and second web layer each comprise a fifth generally longitudinally oriented rod member and a second generally longitudinally oriented reinforcement member, both spaced from said third and fourth rod members and said reinforcement member, said fifth rod member and said second reinforcement member co-operating with said first and second rod members of said plurality of longitudinally spaced frame assembly modules to provide an additional row of longitudinally spaced plurality of retention cells, such that said systems provides first and second web layers each web layer comprising a plurality of longitudinally and transversely spaced retention cells providing a plurality of longitudinally and transversely spaced vertically oriented openings permitting a plurality of vertical reinforcement members to be held in said retention cells in said first and second layers.

16. A reinforcement system as claimed in claim 1 further comprising a vertical reinforcement member held in said retention cell.

17. A reinforcement system as claimed in claim 1 wherein said panel has a body and wherein said system further comprises a connector contained in said body of said panel and being adapted to engage said one transverse rod member of said frame assembly module to mount said frame assembly module and said longitudinal reinforcement member to said panel.

18. A reinforcement system as claimed in claim 17 wherein said connector has a portion positioned proximate an outer surface of said panel and said portion of said connector and said fourth rod member compress a portion of said panel therebetween to provide a stiff connection between said frame assembly module and said panel.

19. A system as claimed claim 18 further comprising a longitudinally extending indentation in said inner face receiving at least a part of said fourth rod member, said indentation for assisting in supporting and stabilizing said frame assembly module.

20. A reinforcement system as claimed in claim 17 wherein said one transverse rod member is received into said body said panel and connects to said connector.

21. A reinforcement system as claimed in claim 17 wherein said connector has a blind cylindrical opening accessible from an inner surface of said panel, the shape of said connector being a figure of rotation of a line around a central transverse axis along said cylindrical opening, said shape of said connector comprising four consequently connected figures, a first figure having a shape of a cylinder, a second figure having a shape of a truncated toroid, a third figure having a shape of a truncated cone and said fourth figure having a shape of a cylinder, said first figure providing a surface preventing displacement of said connector towards said inner surface of said panel.

22. A system as claimed in claim 6 wherein said connector has an outer surface having a first, hollow generally cylindrical shaped portion with an opening at a first end, for receiving an end of said one transverse rod member, a second truncated cone shaped section longitudinally aligned with said cylindrical section and joined to said first portion at a second end opposite to said first end of said cylindrical portion, and a third toroid shaped portion, longitudinally aligned with said cylindrical section and said cone section, and said third portion joined to said second portion at an end opposite to said end connected to said cylindrical portion, end a cap portion having a longitudinal axis and said cap portion being connected to said toroid section.

23. A system as claimed claim 17 wherein said connector is formed with a cap portion and a leg portion, said cap portion being formed as a truncated cone with an inner diameter being less than an outer diameter, said truncated cone for distributing load from the cap of the connector to the panel body.

24. A system as claimed in claim 17 wherein said connector has an end that is in abutment with said fourth rod member to assist in properly positioning said frame module assembly.

25. A system as claimed in claim 1 wherein said third rod member is positioned between said panel and said longitudinal reinforcement member.

26. A system as claimed in claim 1 wherein said one of said first end second rod members extends to said panel and the other of said first and second rod members is integrally formed with and joined to said third rod member.

27. A system as claimed claim 26 wherein said other of said first and second rod members is formed with a loop portion to integrally connect said other of said first and second rod members to said third rod member.

28. A system as claimed in claim 27 wherein said loop portion forms a fourth rod member being positioned in abutment with an interior surface of said panel.

29. A reinforcement system as claimed in claim 1 wherein said panel has a body containing at least one connector positioned therein for rotation relative to said body for rotatably engaging said one transverse rod member of a frame assembly module, said connector adapted to also engage said panel whereby said connector will resist transversely outward forces and moments exerted against said inner surface of said panel.

30. A reinforcement system as claimed in claim 1 further comprising a connector for engaging said one transverse rod member that extends to said panel, through said panel, so said connector is connected to said panel at an inner surface of said panel.

31. A reinforcement system as claimed in claim 30 wherein said panel is made from a screw holding material and said connector is secured at an inner surface of said panel with screws.

32. A system as claimed in claim 1 wherein said panel is made from extruded or expanded polystyrene.

33. A system as claimed in claim 1 wherein said first and second transverse rod members have cut-out portions formed by welding at the joining locations of said first and second transverse rods to said reinforcement member.

34. A system for reinforcing a concrete structural member comprising:

a) a panel oriented generally longitudinally;

b) a plurality of frame assembly modules, each of said frame assembly modules comprising:

first and second spaced, rod members oriented generally transversely to said panel, at least one of said first and second rod members extending to said panel and being mounted thereto;

a third rod member oriented generally longitudinally;

said first, second and third rod members being supported at least in part by said at least one rod member mounted to said panel, and said first, second and third rod members being joined together to form said frame assembly module;

c) a longitudinal reinforcement member extending generally longitudinally, crossing said first and second rod members, being generally spaced from said third rod member and said panel, and joined to at least one of said first and second rod members;

said frame assembly module and said longitudinal reinforcement member co-operating to define a retention cell having a generally vertically oriented opening for receiving a vertical reinforcement member, said first second and third rod members and said longitudinal reinforcement member of said retention cell, configured to retain said vertical reinforcement member in a substantially vertical orientation, and wherein said panel has a body that contains a plurality of connectors having generally smooth outer surfaces and being mounted within said body, said plurality of connectors mounted within said body for rotatably engaging with said one transverse rod member of each of said plurality of frame assembly modules, to mount each of said frame assembly modules to said panel.

35. A system as claimed in claim 34 wherein said at least one rod member of each of said frame assembly modules has an end formed as a machine tap, and an inner cavity in said connector is adapted to receive said end of said one rod member, whereby rotation of said connector draws said end of said at least one rod into said body of the panel as said end taps said inner cavity of said connector to connect said connector to said one rod member.

36. A system as claimed in claim 34 further comprising a generally vertically oriented reinforcement member received through said generally vertically oriented opening.

37. A method of reinforcing a concrete structural member comprising:

a) providing a longitudinally oriented panel having an inner surface;

b) providing at least one frame assembly module mounted to said panel, said at least one frame assembly module comprising:

first and second rod members oriented generally transversely, only one of said first and second rod members extending to said panel and being mounted to said panel, said one member being adapted to assist in maintaining the orientation of said panel, said first and second rod members being spaced apart for each other, a third rod member spaced from said panel and oriented generally longitudinally and crossing both said first and second rod members, said first, second and third rod members being joined together to form said frame assembly module;

c) providing a reinforcement member extending generally longitudinally in generally spaced apart relation to said third rod member and apart from said panel, said frame assembly and said longitudinal reinforcement member defining a retention cell having a generally vertically oriented opening for receiving a vertical reinforcement member, said first, second and third rod members and said longitudinal reinforcement member of said retention cell, configured to maintain said vertical reinforcement member in a substantially vertical orientation;

d) placing a vertical reinforcement member through said vertical opening of said retention cell.

38. A method as claimed in claim 37 wherein said frame assembly module is provided with a fourth rod member that is positioned in abutment with an interior surface of said panel, said fourth rod member being joined with said first, second and third rod members to form said frame assembly module and said first and second rod members, and the third and fourth rod members are oriented substantially in parallel transverse and longitudinally oriented planes.

39. A method as claimed in claim 38 further comprising:

a) providing a plurally of said frame assembly modules, each of said frame assembly modules being spaced longitudinally from other said frame assembly modules; and said third and fourth rod members of each of said plurality of modules each being a continuous, common member extending through said plurality of frame assembly modules;

said longitudinal reinforcement member of said plurality of modules also being a continuous, common member extending through said plurality of frame assembly modules to define with said plurality of frame assembly modules a plurality of longitudinally spaced retention cells providing a plurality of vertically oriented openings;

b) placing a vertically oriented reinforcement member in at least some of said vertically oriented openings.

40. A method as claimed in claim 39 further comprising providing a longitudinally extending indentation in an inner face of said panel mid positioning at least a part of said fourth rod member in said indentation and generally being in abutment with said connector to assist in supporting said frame assembly module.

41. A method as claimed in claim 37 wherein said panel further comprises a body containing within a cavity therein, a connector for mounting said one rod member to said panel, and said method includes connecting said connector to said one rod member.

42. A method as claimed in claim 37 further comprising engaging a connector at an end of said one transversely oriented rod member, and moving said rod member and said frame assembly towards said panel whereby said connector will resist transversely outwardly forces and moments exerted against said inner surface.

43. A method of reinforcing a concrete structural member comprising:

a) providing a longitudinally oriented panel having an inner surface;

b) providing at least one frame assembly module mounted to said panel, said at least one frame assembly module comprising;

first and second rod members oriented generally transversely, at least one of said first and second rod members extending to said panel and being mounted to said panel, said one member being adapted to assist in maintaining the orientation of said panel, said first and second rod members being spaced apart for each other, a third rod member spaced from said panel and oriented generally longitudinally and crossing both said first and second rod members said first, second and third rod members being joined together to form said frame assembly module;

c) providing a reinforcement member extending generally longitudinally in generally spaced apart relation to said third rod member, and said panel said frame assembly and said longitudinal reinforcement member defining a retention cell having a generally vertically oriented opening for receiving a vertical reinforcement member, said first, second and third rod members and said longitudinal reinforcement member of said retention cell, configured to maintain said vertical reinforcement member in a substantially vertical orientation;

d) placing a vertical reinforcement member through said vertical opening of said retention cell;

e) providing a fourth rod member that is positioned generally longitudinally and in abutment with an interior surface of said panel, said fourth member being joined with said first, second and third rod members to form said frame assembly module;

f) tightening the connection between the connector and the panel by compressing said panel between said fourth rod member and said connector.

44. A method of building a concrete structural member with reinforcement positioned in a form space, comprising:

a) providing a panel unit to a construction site, said panel unit comprising:

i) a panel having an inner surface;

ii) at least one frame assembly module in connection with said form space, said at least one frame assembly module comprising:

first and second rod members oriented generally transversely to said panel, at least one of said first and second rod members extending to said panel and being mounted to said panel, said at least one member being adapted to assist in maintaining the orientation of said panel, said first and second rod members being spaced apart from each other, said at least one frame assembly module further comprising third and fourth spaced, rod members oriented generally longitudinally and crossing both said first and second rod members, said third and fourth rod members spaced from said panel, said fourth rod member positioned in close proximity with and interior surface of said panel, said first, second, third and fourth rod members being joined together to form said frame assembly module;

said panel unit further comprising:

iii) a reinforcement member extending generally longitudinally and being generally spaced apart from said third rod member and said panel and rigidly engaged with at least one of said first and second rod members, said third rod member being positioned between said panel and said rod member, said frame assembly and said longitudinal reinforcement member defining a retention cell having a generally vertically oriented opening for receiving a vertical reinforcement member, said first, second and third rod members and said longitudinal reinforcement member of said retention cell, configured to maintain said vertical reinforcement member in a substantially vertical orientation;

wherein said panel in its body includes said connector for connecting said frame assembly module to said panel in such a way that said frame assembly and said longitudinal reinforcement member are supported on said panel;

said method further comprising b) completing a form for said concrete structure to create a form space;

c) placing said frame assembly module with said longitudinally oriented reinforcement member in said form space;

d) placing a vertical reinforcement member in said retention cell; and e) placing pour concrete in said form apace.

45. A method as claimed in claim 44 wherein said panel unit is pre-constructed a location other than said construction site prior to being provided to said construction site.

46. A system for reinforcing a concrete structural member comprising:

a) a panel member oriented longitudinally and having an interior surface;

b) first and second spaced, rod members oriented generally transversely to said panel member, said first rod member extending to said panel and being mounted thereto;

c) a reinforcement member extending generally longitudinally, crossing said first and second rod members said first and second rod members being joined together with said longitudinal reinforcement member;

said second rod member having a loop portion, which overlaps said first rod member in two places is fixedly connected with said first rod member where it crosses with said first rod member, said loop portion configured to co-operate with said first rod member and said longitudinal reinforcement member and defining a retention call having a generally vertically oriented opening for receiving a vertical reinforcement member.

47. A reinforcement system for a concrete structural member comprising:

a) a first panel oriented generally longitudinally b) a second panel spaced from said first panel and oriented generally longitudinally, said first and second panels partly defining a form space between an inner surface of said first panel and an inner surface of said second panel;

c) at least one frame assembly module comprising:

first and second rod members spaced apart and oriented generally transversely between said first and second panels, at least one of said first and second rod members being mounted to said first panel and said second panel with first and second connectors respectively, and extending between said first and second panels, said one member adapted to assist in maintaining the positioning of said first panel relative to said second panel;

a third and a fourth spaced, rod members oriented generally longitudinally and crossing both said first and second rod members, said third rod member spaced from said panel, said fourth rod member is positioned in abutment with an interior surface of said panel;

said first, second, third and fourth rod members being joined together to form said frame assembly module;

d) a reinforcement member extending generally longitudinally, crossing said first and second rod members and being spaced from said third rod member;

said first, second and third rod members and said longitudinal reinforcement member defining a retention cell having a generally vertically oriented opening for receiving a vertical reinforcement member, said first, second and third rod members and said longitudinal reinforcement member of said retention cell, configured to maintain said vertical reinforcement member in a substantially vertical orientation.

48. A reinforcement system as claimed in claim 47 comprising a first and second web layer, each of said first and second web layer comprising a plurality of said frame assembly modules, each of said frame assembly modules being spaced longitudinally from other said frame assembly modules in each said layer; and said third and fourth rod members of each of said plurality of modules in a web layer being a continuous, common member extending through said frame assembly modules, each of said first and second layers having a longitudinal reinforcement member of each said plurality of modules that is a continuous, common member extending through said plurality of frame assembly modules of each said web layer, to define with said plurality of frame assembly modules a plurality of longitudinally spaced retention cells providing a plurality of vertically oriented openings, each of said vertically oriented openings for receiving a vertically oriented reinforcement member, and said vertical openings of said first layer being vertically aligned with a vertical opening in said second layer.

49. A reinforcement system as claimed in claim 48 wherein said frame assembly modules of each of said first and second web layer provide for a plurality of longitudinally and transversely spaced retention cells providing a plurality of longitudinally and transversely spaced vertically oriented openings.

50. A method of reinforcing a concrete structural member comprising:

a) providing first and second panels each having an inner surface at least in part defining a form space therebetween b) providing at least one frame assembly module in connection within said form space, said at least one frame assembly comprising:

first and second spaced rod members oriented generally transversely to said first and second panels, at least one of said first and second rod members mounted to said first and second panels and extending therebetween, said one member being adapted to assist in maintaining the orientation of said panel;

third and fourth spaced, rod members oriented generally longitudinally and crossing both said first and second rod members, said third rod member spaced from said panel, said first, second, third and fourth rod members being joined together to form said frame assembly module;

c) providing a longitudinal reinforcement member extending generally longitudinally in spaced apart relation to said third rod member, said longitudinal reinforcement member being positioned between said panel and said third rod member, said longitudinal reinforcement member being joined to said frame assembly module, first, second and third rod members and said longitudinal reinforcement member defining a retention cell having a generally vertically oriented opening for receiving a vertical reinforcement member, said first, second and third rod members and said longitudinal reinforcement member of said retention cell, configured to maintain said vertical reinforcement member in a substantially vertical orientation;

d) placing a vertical reinforcement member through said vertical opening of said retention cell.

51. A system for reinforcing a concrete structural member comprising:

i) first and second panel units, each panel unit comprising:

a) a panel member oriented longitudinally;

b) at least one frame assembly module comprising first and second spaced, rod members oriented generally transversely, at least one of said first and second rod members extending to said panel and being mounted thereto;

third and fourth spaced, rod members oriented generally longitudinally and crossing both said first and second rod members, said third rod member spaced from said panel, said fourth rod member is positioned in abutment with an interior surface of said panel;

said first, second, third and fourth rod members being joined together to form said frame assembly module;

c) a reinforcement member extending generally longitudinally and being spaced from said third rod member, said third rod member being positioned between said panel and said rod member;

said frame assembly and said longitudinal reinforcement member defining a retention cell having a generally vertically oriented opening for receiving a vertical reinforcement member;

d) a connector secured to the end of said one rod member;

said first and second panel units arranged in longitudinal abutting, alignment;

ii) a bracer interconnecting said connectors of said first and second panel units, whereby said first panel unit is joined to said second panel unit.

52. A system as claimed in claim 51 wherein each said connector has shaft portion having a central axis, and wherein said bracer is generally c-shaped and has externally positioned legs, each of said externally positioned legs being located at an outer side of each said shaft portion of one of said connectors associated with one of each said panels, each of said connectors movable from a first position to a second position, whereby in moving from said first position to said second position, a compression force is exerted between each of the connectors and the its respective leg that is transferred to each said panel, such that in such second position, said distance between the central axis of said connectors is narrowed, thereby drawing said first panel toward said second panel.

53. A system for reinforcing a concrete structural member comprising:

a) a panel member oriented longitudinally and having an interior surface;

b) first and second spaced, rod members oriented generally transversely to said panel member, said first rod member extending to said panel and being mounted thereto;

c) a reinforcement member extending generally longitudinally, crossing said first and second rod members;

said first and second rod members being joined together with said longitudinal reinforcement member;

said second rod member being fixedly connected to said reinforcement member and having a longitudinally oriented extension portion, configured to co-operat with said first rod member and said longitudinal reinforcement member to define a retention cell having a generally vertically oriented opening for receiving a vertical reinforcement member.

54. A system for reinforcing a concrete structural member comprising:

i) first and second panel units, each panel unit comprising a) a panel oriented longitudinally;

b) at least one frame assembly module comprising:

first and second spaced, rod members oriented generally transversely, at least one of said first and second rod members extending to said panel and being mounted thereto;

third and fourth spaced, rod members oriented generally longitudinally and crossing both said first and second rod members, said third rod member spaced from said panel, said fourth rod member is positioned in abutment with an interior surface of said panel;

said first, second, third and fourth rod members being joined together to form said frame assembly module;

c) a reinforcement member extending generally longitudinally and being generally spaced from said third rod member and said panel, said third rod member being positioned between said panel and said rod member;

said frame assembly and said longitudinal reinforcement member defining a retention cell having a generally vertically oriented opening for receiving a vertical reinforcement member;

said first and second panel units being connected in longitudinal abutting, alignment, said longitudinal reinforcement member of said first panel not extending to said longitudinal reinforcement member of said second panel;

ii) a reinforcement connector having a pair of vertical reinforcement members each received in a slot between said third rod member and said longitudinal reinforcement member of each said frame assembly module of said first and second panel units, and said reinforcement connector also having a longitudinal reinforcement member positioned in overlapping relationship with said longitudinal reinforcement member of said first panel unit and said longitudinal reinforcement member of said second panel unit.

55. A system for reinforcing a concrete structural member comprising:

i) first and second panel units, each panel unit comprising a) a panel member oriented longitudinally;

b) at least one frame assembly module comprising a rod member oriented generally transversely to said panel member and extending to said panel end being mounted thereto;

c) a connector secured to an end of said rod member;

said first and second panel units arranged in longitudinal abutting, alignment;

ii) a bracer interconnecting said connectors of said first and second panel units, whereby said first panel unit is joined to said second panel unit, said bracer comprising a generally c-shaped structure having a pair of spaced apart legs extending from a body proximate each end of said body, externally positioned legs, each of said legs positioned on an opposite side of a shaft portion of one of said connectors secured to an end of said rod member mounted to one of said panels of said first and second panel units, whereby rotation of said connector on each panel will cause said bracer to create a force on each connector tending to push said first and second panels together.

56. A system as claimed in claim 55 wherein said connector is generally mushroom shaped.

57. A panel unit for use in connection with forming a concrete structural member, said panel unit comprising:

i) a panel oriented longitudinally and having upper and lower substantially parallel faces;

ii) at least one frame assembly module comprising a plurality of longitudinally spaced rod members oriented transversely to said panel, and extending to said panel and being mounted thereto;

said plurality of rod members supporting at least one longitudinal reinforcement member each of said plurality of rod members having a connector secured to the end of each said rod member to mount each of said rod members to said panel; said connectors being arranged such that said longitudinal reinforcement member supported by said rod members, is oriented at an angle of between 0 and approximately one degrees to said lower face of said panel to permit overlapping of said reinforcement member with a reinforcement member of an adjacent panel unit.

58. A system of form work using a reinforcement system, said reinforcement system comprising:

a) a panel oriented generally longitudinally;

b) at least one frame assembly module comprising:

first and second spaced, rod members oriented generally transversely to said panel, only one of said first and second rod members extending to said panel and being mounted thereto;

a third rod member oriented generally longitudinally;

said first, second and third rod members being joined together to form said frame assembly module;

c) a longitudinal reinforcement member extending generally longitudinally, crossing said first and second rod members, being generally spaced from said third rod member and said panel, and joined to at least one of said first and second rod members said frame assembly module and said longitudinal reinforcement member co-operating to define a retention cell having a generally vertically oriented opening that can retain a vertical reinforcement member.

59. A form work system as claimed in claim 58, wherein said panel is comprised as part of the form work.

60. A form work system as claimed in claim 58 wherein said reinforcement system is positioned within the form space provided by conventional form work.

61. A system for reinforcing a concrete structural member comprising:

i) first and second panel units, each panel unit comprising a) a panel member oriented longitudinally and having a lower longitudinal face; and a front face and a rear face;

b) at least one frame assembly module comprising:

first and second spaced, rod members oriented generally transversely, at least one of said first and second rod members extending to said panel and being mounted thereto;

a third rod member oriented generally longitudinally and crossing both said first and second rod members, said third rod member spaced from said panel, said first, second and third rod members being joined together to form said frame assembly module;

c) a reinforcement member extending generally longitudinally beyond said leading face of said panel and being generally spaced from said third rod member and said panel, said reinforcement member being oriented at an angle to said lower face of said panel, said third rod member being positioned between said panel and said rod member;

said frame assembly and said longitudinal reinforcement member defining a retention cell having a generally vertically oriented opening for receiving a vertical reinforcement member, said first and second panel units being connected in longitudinal abutting, alignment, said longitudinal reinforcement member of said first panel extending from said front face of said first panel past said rear face of said second panel in overlapping relation to said longitudinal reinforcement member of said second panel.

62. A system for reinforcing a concrete structural member comprising:

i) first and second panel units, each panel unit comprising:

a) a panel member oriented longitudinally and having a lower longitudinal face; and a front face and a rear face;

b) at least one frame assembly module comprising:

first and second spaced, rod members oriented generally transversely, at least one of said first and second rod members extending to said panel and being mounted thereto;

a third rod member oriented generally longitudinally and crossing both said first and second rod members, said third rod member spaced from said panel, said first, second, and third rod members being joined together to form said frame assembly module;

c) a reinforcement member extending generally longitudinally beyond said leading face of said panel and being generally spaced from said third rod member and said panel, said reinforcement member having an end portion that is angled, said third rod member being positioned between said panel and said rod member;

said frame assembly and said longitudinal reinforcement member defining a retention cell having a generally vertically oriented opening for receiving a vertical reinforcement member;

said first and second panel units being connected in longitudinal abutting, alignment, said end portion of said longitudinal reinforcement member of said first panel extending beyond said front face of said first panel and said rear face of said second panel in overlapping relation to said longitudinal reinforcement member of said second panel.

63. A system for reinforcing a concrete structural member comprising:

a) a panel oriented generally longitudinally;

b) at least one frame assembly module comprising:

first and second spaced, rod members each having a first end and a second end and being oriented generally transversely to said panel, only one of said first and second rod members extending between said first end which is vertically unsupported, and said second end which is mounted to said panel;

a third rod member oriented generally longitudinally;

said first, second and third rod members being joined together to form said frame assembly module;

c) a longitudinal reinforcement member extending generally longitudinally, crossing said first and second rod members, being generally spaced from said third rod member and said panel, and joined to at least one of said first and second rod members;

said frame assembly module and said longitudinal reinforcement member being supported in a cantilever configuration from said panel on said one of said first and second rod members, said first, second and third rod members and said longitudinal reinforcement member co-operating to define a retention cell having a generally vertically oriented opening for receiving a vertical reinforcement member, so as to retain said vertical reinforcement member.

64. A system as claimed in claim 63 wherein said first, second and third rod members and said longitudinal reinforcement member of said retention cell, are configured to retain said vertical reinforcement member in a substantially vertical orientation.

65. A system for reinforcing a concrete structural member comprising:

a) a panel oriented longitudinally;

b) at least one frame assembly module comprising:

first and second spaced, rod members oriented generally transversely to said panel, said first rod member having a first end portion which is mounted to said panel, said second rod member having an end positioned proximate an inner surface of said panel, but not being mounted to said panel;

a third rod member oriented generally longitudinally;

said first, second and third rod members being joined together to form said frame assembly module;

c) a longitudinal reinforcement member extending generally longitudinally, crossing said first and second rod members, being generally spaced from said third rod member and said panel, and joined to at least one of said first and second rod members;

said first, second and third rod members and said longitudinal reinforcement member co-operating to define a retention cell having a generally vertically oriented opening for receiving a vertical reinforcement member, so as to retain said vertical reinforcement member.

66. A system for as claimed in claim 65 wherein said first, second and third rod members and said longitudinal reinforcement member of said retention cell, are configured to retain said vertical reinforcement member in a substantially vertical orientation.

67. A system for reinforcing a concrete structural member comprising:

a) a panel oriented longitudinally;

b) at least one frame assembly module comprising:

first and second spaced, rod members oriented generally transversely to said panel, only one of said first and second rod members extending to said panel and being mounted thereto;

a third rod member oriented generally longitudinally;

said first, second and third rod members being joined together at a plurality of joints and said plurality of joints lying in substantially in a common transversely and longitudinally oriented plane, to form said frame assembly module;

c) a longitudinal reinforcement member extending generally longitudinally, crossing said first and second rod members, being generally spaced from said third rod member and said panel, and joined to at least one of said first and second rod members and also oriented in substantially in said plane;

said frame assembly module and said longitudinal reinforcement member co-operating to define a retention cell having a generally vertically oriented opening for receiving a vertical reinforcement member, said first, second and third rod members and said longitudinal reinforcement member of said retention cell, configured to restrict said vertical reinforcement member from a significant amount of movement in said transverse and longitudinal directions.

* * * * *

UNITED STATES PATENT AND TRADEMARK OFFICE

CERTIFICATE OF CORRECTION

PATENT NO. : 6,898,912 B2
DATED : May 31, 2005
INVENTOR(S) : Leonid G. Bravinski It is certified that error appears in the above-identified patent and that said Letters Patent is hereby corrected as shown below:

Column 24,
Line 16, replace “longitudinally,” with -- longitudinally: --.
Line 46, replace “rod member are” with -- rod members are --.

Column 26,
Line 33, replace “body said panel” with -- body of said panel --.
Line 43, replace “a cylinder, said” with -- a cylinder: said --.
Line 56, replace “end a cap portion” with -- and a cap portion --.
Line 58, replace “as claimed claim 17” with -- as claimed in claim 17 --.

Column 27,
Line 5, replace “first end second” with -- first and second --.

Column 29,
Line 10, replace “panel mid positioning” with -- panel and positioning --.

Column 33,
Line 15, replace “the its” with -- its --.
Line 36, replace “co-operat” with -- co-operate --.

Column 34,
Line 18, replace “panel end being” with -- panel and being --.

Signed and Sealed this

Twenty-eighth Day of March, 2006

JON W. DUDAS
*Director of the United States Patent and Trademark Office*